US006170829B1

(12) United States Patent
Harvey

(10) Patent No.: US 6,170,829 B1
(45) Date of Patent: Jan. 9, 2001

(54) BASEBALL GAME

(76) Inventor: Marshall Harvey, 59 Boulder Dr., Londonderry, NH (US) 03053

( * ) Notice: Under 35 U.S.C. 154(b), the term of this patent shall be extended for 0 days.

(21) Appl. No.: 09/249,507

(22) Filed: Feb. 12, 1999

(51) Int. Cl.[7] ..... A63F 1/00

(52) U.S. Cl. ..... 273/298; 273/277; 273/244; 273/308

(58) Field of Search ..... 273/245, 244.1, 273/244.2, 247, 292, 277, 308, 298, 244

(56) References Cited

U.S. PATENT DOCUMENTS

| | | | |
|---|---|---|---|
| 367,991 | | 8/1887 | McGill . |
| 950,810 | | 3/1910 | Watterson . |
| 1,324,037 | | 12/1919 | de Tamble . |
| 1,536,639 | | 5/1925 | Van Beek . |
| 1,550,692 | | 8/1925 | Gorman . |
| 1,661,216 | | 3/1928 | Destafano . |
| 2,528,029 | | 11/1950 | Brown . |
| 2,812,181 | * | 11/1957 | Richman . |
| 2,886,319 | | 5/1959 | Henderson . |
| 3,043,594 | * | 7/1962 | Seitz . |
| 3,224,773 | | 12/1965 | Roed . |
| 3,260,526 | | 7/1966 | Seitz . |
| 3,428,317 | | 2/1969 | Pulcifer . |
| 3,528,661 | | 9/1970 | Warner . |
| 3,649,017 | | 3/1972 | Kirkpatrick . |
| 3,734,501 | | 5/1973 | La Monica . |
| 3,817,524 | | 6/1974 | Board . |
| 3,819,185 | | 6/1974 | Lowthe . |
| 3,957,269 | | 5/1976 | Bouchard . |
| 4,261,569 | | 4/1981 | Frohlich . |
| 4,452,453 | | 6/1984 | Daley . |
| 4,822,043 | * | 4/1989 | Carter . |
| 5,129,651 | | 7/1992 | Tobias . |
| 5,145,173 | * | 9/1992 | Crowder . |
| 5,632,488 | * | 5/1997 | Sturm . |

* cited by examiner

*Primary Examiner*—Sebastiano Passaniti
*Assistant Examiner*—Vishu Mendiratta

(57) ABSTRACT

A baseball board game is disclosed consisting of a deck of result cards, sets of cards that represent pitchers (FIG. 2) and batters (FIG. 1) for a real-life team, and tables FIGS. 4–14). Each player chooses a team. Play is controlled by the drawing of result cards (FIGS. 15–128) and by the selection of strategies that represent managerial decisions. Drawing a result card randomly selects a type of batter, pitcher, or fielder rating. The current batter, pitcher, or fielder has a rating of the selected type. If the current player's rating of that type is active on the result card, the type of result controlled by that rating type occurs. For example, if the rating type on the selected result card is B1 (11), the batter's B1 rating (2) is active on the result card, and a B1 rating controls singles on the current result card (13), then a single occurs. The method used to store information about real-life player performance is highly compact. As a result, the game easily incorporates features, including English language play descriptions, that would otherwise be excluded from a table game or difficult to use.

14 Claims, 70 Drawing Sheets

10

Bruce Sutter 1984 Cardinals

ERA 1.54 Sv 45 L 4

B R T R

| Adv Pitching | | | Sit n | none on | 1st only | scor pos | Basic Pitching | |
|---|---|---|---|---|---|---|---|---|
| P1 | h | GB | | | | | P1 | J |
| P2 | m | GB | | | | | P2 | p |
| P3 | a | | | | | | P3 | a |
| P4 | b | GB | 1-3 | p | j | f | P4 | g |
| | | | 4-6 | l | e | a | | |
| SN | + | | 7- | p | p | m | SN | + |
| DL | + | | | | | | DL | |
| TE | + | | | | | | SN | + |
| HM | + | | | | | | DL | |
| HP | | | | | | | TE | |
| WP | + | | | | | | HM | |
| BK | | | | | | | Pitcher Batting | |
| PT | | | | | | | Sit | p |
| | | | | | | | HR | * |

| Fielding | |
|---|---|
| CH | + |
| AR | |
| ER | |
| MV | |

FIG. 3

1996

| Expos | Pos | CH | AR | ER | EB | PB | SL | PT | SD | GS | G |
|---|---|---|---|---|---|---|---|---|---|---|---|
| Moises Alou | RF | + | + | | | | * | | + | 109 | 123 |
| | LF | + * | * | * | | | | | | 27 | 33 |
| | CF | | | | | | | | | 5 | 7 |
| Shane Andrews | 3B | + * | + | * | * | | * | | + | 107 | 123 |
| Darrin Fletcher | C | + | + | * | | * | | | | 104 | 112 |
| Cliff Floyd | LF | | + | * | | | + * | | + * | 36 | 69 |
| | CF | | | + * | | | | | | 7 | 16 |
| | RF | | | | | | | | | 2 | 7 |
| Mark Grudzielanek | SS | * | * | + * | * | | + * | | + * | 153 | 153 |
| Mike Lansing | 2B | | | + | + | | * | | * | 158 | 159 |
| | SS | | | + * | + * | | | | | 1 | 2 |
| Sherman Obando | RF | * | + | * | | | + * | | + | 36 | 47 |
| Henry Rodriguez | LF | | + | * | | | + * | | | 88 | 89 |
| | 1B | + | + | + | + | | | | | 48 | 51 |
| | RF | + * | | | | | | | | 0 | 2 |
| F. P. Santangelo | CF | + * | + | * | | | * | | + * | 66 | 76 |
| | 3B | + * | + | * | + | | | | | 17 | 23 |
| | 2B | + * | + * | | + | | | | | 1 | 5 |
| | SS | | | | + | | | | | 0 | 0 |
| David Segui | 1B | * | * | + | | | | | + | 113 | 114 |
| Dave Silvestri | 3B | * | + | + * | + * | | + | | + | 37 | 47 |
| Tim Spehr | C | | | + * | | * | + * | | * | 7 | 58 |
| | RF | | | | | | | | | 0 | 0 |
| Andy Stankiewicz | SS | | | * | + | | + * | | + * | 7 | 13 |
| | 2B | + * | * | * | * | | | | | 3 | 19 |
| Lenny Webster | C | + * | + * | | | * | | | | 50 | 63 |
| Rondell White | CF | | + | | | | * | | + * | 83 | 86 |

FIG. 4

1998 Ballpark Ratings

| Team | League | Park Rating | Park Name |
|---|---|---|---|
| Atlanta Braves | NL | j | Atlanta-Fulton County Stadium |
| Florida Marlins | NL | n | Pro Players Stadium |
| Montreal Expos | NL | n | Olympic Stadium |
| New York Mets | NL | m | Shea Stadium |
| Philadelphia Phillies | NL | m | Veterans Stadium |
| Chicago Cubs | NL | l | Wrigley Field |
| Cincinnati Reds | NL | m | Cinergy Field |
| Houston Astros | NL | o | The Astrodome |
| Pittsburgh Pirates | NL | l | Three Rivers Stadium |
| St. Louis Cardinals | NL | m | Busch Stadium |
| Colorado Rockies | NL | b | Coors Field |
| Los Angeles Dodgers | NL | o | Dodger Stadium |
| San Diego Padres | NL | l | San Diego/Jack Murphy Stadium |
| San Francisco Giants | NL | m | 3Com Park |
| Baltimore Orioles | AL | k | Oriole Park at Camden Yards |
| Boston Red Sox | AL | m | Fenway Park |
| Detroit Tigers | AL | k | Tiger Stadium |
| New York Yankees | AL | l | Yankee Stadium |
| Toronto Blue Jays | AL | k | SkyDome |
| Chicago White Sox | AL | o | Comiskey Park |
| Cleveland Indians | AL | m | Jacobs Field |
| Kansas City Royals | AL | o | Ewing M. Kauffman Stadium |
| Milwaukee Brewers | AL | n | County Stadium |
| Minnesota Twins | AL | k | Hubert H. Humphrey Metrodome |
| California Angels | AL | j | Anaheim Stadium |
| Oakland Athletics | AL | n | Oakland-Alameda County Coliseum |
| Seattle Mariners | AL | l | The Kingdome |
| Texas Rangers | AL | m | The Ballpark in Arlington |

FIG. 5

HIT-AND-RUN TABLE

| Play Indicated | Use |
|---|---|
| ground ball (– result) to position of player covering base on steal attempt | "up the middle" is out at first, A1, "in the hole" is SINGLE A2, otherwise get a result from the far right of the CHANCES line: + is a SINGLE A2, anything else is a groundout, A1 |
| ground ball double play or FC at second | out at first, A1 |
| liner caught by infielder | lead runner out on double play |
| infield hit | lead runner SD:CP for A2 |
| single to outfield | A2 |
| double | A3 |
| ground ball, out at first | A1 |
| wild pitch or passed ball | SD:A2 (check lead runner) |
| liner caught by rightfielder | doubles up runner on second or first |
| liner caught by centerfielder or leftfielder | doubles up runner on second or CP to double up runner on first |
| outfielder misplays a single or double | add one base to the result |
| wild pitch or passed ball | perform an SD test on the lead runner to see if the runners advance another base |
| strike, ball, strikeout | steal attempt |

FIG. 6

PICKOFF TABLE

| 1-65 | 66-85 | 86-114 |
|---|---|---|
| use Rundown table | ER(baseman):safe on error or out, if error, use Rundown table and assign error to any fielder who participated, runner advancing to next base. If out, use rundown table to get play result. If out and random number is 61-97, all preceding runners advance unless runner in rundown is not lead runner. In that case, restart rundown to try to get lead runner for a DP. | out |

RUNDOWN TABLE

The letter "t" means the fielder who started the pickoff.

| | 1-40 | 41-65 | 66-85 | 86-95 | 96-100 | 101-114 |
|---|---|---|---|---|---|---|
| 1st base | t-3-4 | t-3-4-1 | t-3-4-1-6 | t-3-4-1-6-3 | t-3-4-1-6-3-4 | use this table again (get a number between 1 and 97) to get the play result, then optionally, player with ball catches slowest runner (or if more than one are equally slow, the farthest advanced of the slow runners) in rundown, use pickoff table again |
| 2nd base | t-6-5 | t-6-5-4 | t-6-5-4-1 | t-6-5-4-1-6 | t-6-5-4-1-6-5 | |
| 3rd base | t-5-2 | t-5-2-6 | t-5-2-6-1 | t-5-2-6-1-5 | t-5-2-6-1-5-2 | |

FIG. 7

INFIELD IN OR CORNERS IN TABLE

| | 1-4 | 5-8 | 9-45 | 46-53 | 54-69 | 70-76 | 77-83 | 84-114 |
|---|---|---|---|---|---|---|---|---|
| firstbaseman | AR:PO 3 A1 or FC all safe A1 | CP:3-2 or all safe | FC 3-2 A1 or DP 3-2-3 if full | AR:DP 3-2-3 or FC 3-2 | SINGLE A2 | SINGLE | CH:FC 3-2 A1 or SINGLE A2 | R3:holds, if bases are full FC 3-2 |
| thirdbaseman | AR:5-3 A1 or FC all safe A1 | CP:5-2 or all safe | FC 5-2 A1 or DP 5-2-3 if full | AR:DP 5-2-3 or FC 5-2 | SINGLE A2 | SINGLE | CH:FC 5-2 A1 or SINGLE A2 | R3:holds, if bases are full FC 5-2 |

| | 1-10 | 11-18 | 19-45 | 46-70 | 71-78 | 79-96 | 97-114 |
|---|---|---|---|---|---|---|---|
| secondbaseman | AR:4-3 A1 or FC all safe | CP:4-2 or all safe | FC 4-2 A1 or DP 4-2-3 if full | SINGLE A2 | SINGLE | CH:FC 4-2 A1 or SINGLE A2 | R3:holds, if bases are full FC 4-2 |
| shortstop | AR:6-3 A1 or FC all safe | CP:6-2 or all safe | FC 6-2 A1 or DP 6-2-3 if full | SINGLE A2 | SINGLE | CH:FC 6-2 A1 or SINGLE A2 | R3:holds, if bases are full FC 6-2 |

OUTFIELD ASSISTS TABLE

| Outfield Box | Meaning |
|---|---|
| AR: | The runner (and batter if PLB appears) are going. Test the outfielder's AR rating for play result on the one the defense chooses to try for. |
| CP | Regardless of the inning, the offense can choose to hold the runner or send the runner. If a runner goes, get a CP result. If PLB appears and the runner goes, the offense can send or hold the batter on the throw. The defense can choose not to throw and thus prevent the batter from taking an extra base. |
| SD: | The runner (and batter if PLB appears) are going. Test the SD rating of the one the defense chooses to try for. |
| safe | The runner (and batter if PLB appears) are safe on the throw. |

FIG. 8

INVENT PLAY TABLE

| | Who Invents Play | End Result |
|---|---|---|
| 1-6 | home team | 3 out, 0 runs |
| 7-12[1] | home team | 2 out, 0 runs |
| 13-18 | home team | 2 out, 1 runs |
| 19-24[2] | home team | 1 out, 0 run |
| 25-30 | home team | 2 out, 2 runs |
| 31-37[2] | home team | 1 out, 1 runs |
| 38-44 | home team | 1 outs, 2 runs |
| 45-51 | home team | 1 out, 3 run |
| 52-58 | visiting team | 0 outs, 3 runs |
| 59-65 | visiting team | 0 outs, 4 runs |
| 66-72 | visiting team | 1 error, 0 runs |
| 73-79 | visiting team | 1 error, 1 run |
| 80-86 | visiting team | 1 error, 2 runs |
| 87-93 | visiting team | 2 errors, 0 runs |
| 94-100 | visiting team | 2 errors, 1 run |
| 101-107 | visiting team | 2 errors, 1 run |
| 108-114 | visiting team | 2 errors, 2 runs |

FIG. 9

EJECTION TABLE

| | 1-57 | 58-85 | 86-95 | 96-104 | 105-114 |
|---|---|---|---|---|---|
| Who Invents Play | home team | | visiting team | | |
| Player Ejected | manager for arguing | player of choice for arguing | fight, see next row | fight, benches clear, see next row | |
| Number of Players of Choice Ejected for Fighting | 1 home team player | 1 visiting team player | 1 home team player, 1 visiting team player | 1 hm, 2 vis | 1 vis, 2 hm |

FIG. 10

GREAT PLAY TABLE

| | 1-28 | 29-77 | 78-114 |
|---|---|---|---|
| 1B/3B | out at 1st A1, playing in:out at home | AR:DP 3A, if hit to first 2A | FC, if hit to first 2A |
| 2B/SS | out at 1st A1 | AR:DP 3A, 3A playing in:out at home | |
| OF | if shallow runners hold, if hit deep 2A, 3A, otherwise 3A | | if hit deep, 2A, 3A, deep to left, 3A, otherwise CP at home |

FIG. 11

OUTCOME TABLE

| | 1-12 | 13-24 | 25-36 | 37-49 | 50-62 | 63-75 | 76-88 | 89-101 | 102-114 |
|---|---|---|---|---|---|---|---|---|---|
| **play result if unknown (such as cards 29, 33, 34, and 35, or 76 without error)** | infield grounder, if runner on first, successful FC at second before error | | infield grounder | | outfield flyout | | outfield single | | double |
| **throw from or to or misplay by** | P/LF | C/CF | 1B/RF | 2B/LF | 3B/CF | SS/RF | LF/2B | CF/3B | RF/SS |

| **INFIELD PLAYS** | | | | | | | | | |
|---|---|---|---|---|---|---|---|---|---|
| **bobble or loses the handle** | safe at first, 3A 2G2A | | safe at first, 3A 2G2A, if to first or secondbaseman, 2A | | safe at first, 2A, 3A | | | safe at first, 2A2, 3A , if to P or C: A1 BA1 | safe at first, SD:A2, SD:BA2, if to P or C:A1 BA1 |
| **contact misplay** | pulls foot off, BA1, 2GA1 | | | | | misses base, BA1, 2A, 3A | | misses tag, BA1, 2A, 3A | |
| **grounder, misplay receiving throw** | drops ball, runner safe, BA1 | | | | | | ball off glove and past fielder, get a number and see throwing misplay row for runner advance | | |
| **throwing misplay by infielder** | bad throw, A1 BA1 | | | | | | bad throw A2 BA2 | overthrow A2 BA2, if pitcher or catcher throwing to first CP:A3 SD:BA3 | |
| **drops pop** | foul pop | | A1 BA1 2GA2 2GBA2, if to first or thirdbaseman, foul pop | | A1 BA1 2GA2 2GBA2 | | A1 BA1 2GA2 2GSD:A3 2GBA2 | | |
| **errorless result, if not known, with runner on first** | DP | | | FC, DP attempt at first fails | | | A1 | | R2 or R1:SD: CP:A2 |
| **errorless result, if not known, with runner on second only** | holds second | | | | | 2A | | | SD:CP:A2 |
| **errorless result, if not known, for runner on third** | out at home | | holds third, playing in:out at home | | holds third | | 3A | | |

| **OUTFIELD PLAYS** | | | | | | | | | |
|---|---|---|---|---|---|---|---|---|---|
| **drops fly** | A1 BA1 | | A1 BA1 2GA2 BA2 | | | 1A1 2A2 BA2 (if 2nd open) 2GA2 BA2 | | CP:A2 CP:BA2 | CP:A3 SD:BA3 |
| **misplays double** | A3 BA2 | | | A3 BA3 | | | | BA3 CP:B scores | |
| **misplays single** | 2A2 1SD:A2 B holds first | | | A2 BA2 | | | CP:A3 SD:BA3 | | BA3 SD:B scores |
| **bad throw by outfielder or throws runner out** | stretch double or out at second | stretch triple or out at third | flyout, close play at base, lead runner safe on error 2A1 3A1, or DP, lead runner out; if bases empty, same as random number 1 | | single, close play at base, runner safe on error 2A2 1A2, or lead runner (or batter) out | | | | double, R1 scores on error, or lead runner (or batter) out |
| **errorless result, if not known, on single** | A2 SD:1A3 | | | | | 2A2 2GA2 | | A2 | |
| **errorless result, if not known, on double** | | | | | | 2GA3 | | A3 | |
| **errorless result, if not known, on flyout** | R1:A1 R2:SD:CP:A2 3A | | | | | lead runner caught off second or first for DP | | | |

FIG. 12

INJURY TABLE

| | Player Injured | Duration |
|---|---|---|
| 1-6 | batter | short-term |
| 7-12 | bone injury on hit-by-pitch, use medium-term injury | short-term |
| 13-18 | runner on first or if none, take another number | short-term |
| 19-24 | runner on second or if none, take another number | short-term |
| 25-30 | runner on third or if none, take another number | short-term |
| 31-36 | pitcher | short-term |
| 37-42 | pitcher develops sore arm and leaves game, get duration | short-term |
| 43-48 | pitcher develops sore arm and leaves game, get duration | short-term |
| 49-54 | pitcher develops blister and leaves game, use short-term injury | short-term |
| 55-60 | firstbaseman | short-term |
| 61-66 | secondbaseman | short-term |
| 67-72 | thirdbaseman | medium-term |
| 73-78 | shortstop | medium-term |
| 79-85 | leftfielder | medium-term |
| 86-93 | centerfielder | indefinite-term |
| 94-100 | rightfielder | indefinite-term |
| 101-107 | offense manager's choice outfielder and infielder | season |
| 108-114 | offense manager's choice of two outfielders | season |

FIG. 13

TYPE OF INJURY (PLAYERS EXCEPT PITCHER)

| | 1-19 | 10-38 | 39-57 | 58-76 | 77-95 | 96-114 |
|---|---|---|---|---|---|---|
| Short-Term | sore muscle | sore muscle | muscle strain | bruise | jammed bone | invent injury or illness |
| Medium-Term | bone injury | dislocation | muscle strain | bruise | tendonitis | |
| Indefinite-Term | bone injury | inflammation | muscle strain | bruise | tendonitis | |
| Season | tear | tear | invent injury that requires surgery | invent injury that requires surgery | invent injury | |

TYPE OF INJURY (PITCHER)

| | 1-19 | 20-38 | 39-57 | 58-77 | 78-95 | 96-114 |
|---|---|---|---|---|---|---|
| Short-Term | sore muscle | sore muscle | muscle strain | muscle strain | use other table | invent injury or illness |
| Medium-Term and Indefinite-Term | muscle strain | muscle strain | tendonitis | tendonitis | use other table | |
| Season | tear | tear | bone chips | invent injury that requires surgery | invent injury | |

FIG. 14

11 26 12 27 13

| B1 | 1 | a b c d e f g h i j k l m n o p<br>Check BSR or PSR, on BLAST check park | | | | | |
|---|---|---|---|---|---|---|---|
| ! | | ON | | | | | |
| - | | GD:6-4-3 DP 3A, or one-bouncer to the mound, CH( ):take another card, AR:1-6-3, 2A, full:SD(batter):1-2-3 DP | | | | | |
| ON | | liner by thirdbaseman into left, CH(3B*):diving stop or SINGLE SD:A2 | | | | | |
| TROUBLE | | smash down thirdbase line, CH:thirdbaseman snares liner (and doubles up lead runner) or DOUBLE SD:A3 | | | | | |
| DEEP TROUBLE | | liner to deep leftcenter, fielders misplay carom, ER(cf):inside-the-park HOME RUN or TRIPLE | | | | | |
| BLAST | | long drive to power field, HOME RUN 1', CH:leaping catch at wall | | | | | |
| !? | | half-swing, soft liner to pitcher | | | | | |
| SAC BUNT | | 1-4 A1, CRN:pop to pitcher | | | | | |
| BUNT FOR HIT | | toward third, A1, ER:safe on bobble or 5-3, CRN:out at first, 5-3, sacrifice? | | | | | |
| HIT&RUN | | runner misses sign, get play result and ignore Hit-and-Run table | | | | | |
| HIT/ERROR | | rhb:ER(1B):drops pop, see Outcome table<br>lhb:ER(3B):drops pop, see Outcome table | | | | | |
| FB | | foul popup on the right side (PO 3) | | | | | |
| CHANCES | | safe | on steal ER(c): overthrow A2, on steal of home drops ball | AR: | WP +, SD for advance | ER + | + |

38

FIG. 15

| B1 | 2 | a b c d e f g h i j k l m n o p<br>Check BSR or PSR, on BLAST check park | | | | | |
|---|---|---|---|---|---|---|---|
| ! | | ON | | | | | |
| - | | grounder gloved by pitcher, CH( ):take another card, 1-6-3 DP, R-12:choice of (CP 1-5 FC or all safe) or 1-3, R3:1-2 , full:1-2-3 DP | | | | | |
| ON | | smash in the hole to left/to right, SINGLE 2A2 1PL 7-5/9-5 | | | | | |
| TROUBLE | | smash down thirdbase line, CH:thirdbaseman snares liner (and doubles up lead runner) or DOUBLE | | | | | |
| DEEP TROUBLE | | fly to deep leftcenter lost in lights, ER(cf):inside-the-park HOME RUN or TRIPLE | | | | | |
| BLAST | | deep drive to power field HOME RUN 1', 20HR:off wall SD:DOUBLE A3 or SINGLE A2 | | | | | |
| !? | | swinging bunt, 1-3 A1 | | | | | |
| SAC BUNT | | 1-4 A1, CRN:pop to pitcher | | | | | |
| BUNT FOR HIT | | SH:toward third, throwing misplay, see Outcome table, or called strike, CRN:lead runner out | | | | | |
| HIT&RUN | | get play result and ignore Hit-and-Run table | | | | | |
| HIT/ERROR | | ER(1B):grounder, misplay receiving throw, see Outcome table | | | | | |
| FB | | foul popup near the leftfield line (PO 5) | | | | | |
| CHANCES | | safe | on steal except home ER(c):overthrow A2, on steal of home drops ball | AR: | WP +, SD for advance | ER + | + |

FIG. 16

| B1 | 3 | a bcdefghijklmnop<br>Check BSR or PSR, on BLAST check park | | | | | |
|---|---|---|---|---|---|---|---|
| ! | | ON | | | | | |
| - | | grounder to pitcher, CH( ):take another card, AR:1-6-3 DP 3A, R-12:1-5 FC, full:1-2-3 DP | | | | | |
| ON | | bouncer in the hole to left/to right, SINGLE 2PL 7-2/9-2 1A2 PLB 7-5-4/9-3-6 2GA2 | | | | | |
| TROUBLE | | smash down thirdbase line/firstbase line, DOUBLE SD:A3 R1:PLB 7-6-1-5/9-4-1-5 | | | | | |
| DEEP TROUBLE | | fly to deep leftcenter, ER(cf):inside-the-park HOME RUN or TRIPLE | | | | | |
| BLAST | | deep drive to power field HOME RUN 1', 25HR:off wall SD:DOUBLE or SINGLE A2 | | | | | |
| !? | | swinging bunt, 1-3 A1 | | | | | |
| SAC BUNT | | 1-4 A1, CRN:AR:lead runner out on FC or 1-4 A1 | | | | | |
| BUNT FOR HIT | | SH:toward third CPB, A1, or called strike, if not first attempt this at bat then lear runner out on FC | | | | | |
| HIT&RUN | | get play result | | | | | |
| HIT/ERROR | | ER(1B):grounder, misplay receiving throw, see Outcome table | | | | | |
| FB | | rhb:popup back of first (PO 3)<br>lhb:liner to first | | | | | |
| CHANCES | | safe | on steal except home<br>ER(c):overthrow A2 | AR: | WP + | ER + | + |

28 29 30 31 32 33

FIG. 17

| B1 | 4 | a bcdefghijklmnop<br>Check BSR or PSR, on BLAST check park | | | | | |
|---|---|---|---|---|---|---|---|
| ! | | ON | | | | | |
| - | | rhb:popup on the right side (PO 3)<br>lhb:bouncer to the mound, R2:CH:hold | | | | | |
| ON | | grounder in the hole to left, CH(3B+*):stopped or SINGLE 2A2 2GA2 | | | | | |
| TROUBLE | | liner down leftfield line/rightfield line, DOUBLE SD:A3 | | | | | |
| DEEP TROUBLE | | fly to deep center, centerfielder slips, ER(cf):inside-the-park HOME RUN or TRIPLE | | | | | |
| BLAST | | deep drive to power field HOME RUN 1', 30HR:off wall SD:DOUBLE or SINGLE A2 | | | | | |
| !? | | swinging bunt, 1-3 A1 | | | | | |
| SAC BUNT | | to the mound AR:lead runner out on FC or 1-4 A1, SFT:foul | | | | | |
| BUNT FOR HIT | | SH:toward third CPB, A1, or called strike, CRN:lead runner out on FC | | | | | |
| HIT&RUN | | get play result | | | | | |
| HIT/ERROR | | ER(1B):grounder, misplay receiving throw, see Outcome table | | | | | |
| GB/FB | | use - result above | | | | | |
| CHANCES | | safe | on steal except home<br>ER(c):overthrow A2 | AR: | WP + | ER + | + |

FIG. 18

| B1 | 5 | ab cdefghijklmnop<br>Check BSR or PSR, on BLAST check park | | | | | |
|---|---|---|---|---|---|---|---|
| ! | | ON | | | | | |
| – | | rhb:liner to first<br>lhb:bouncer to the mound CH( ):take another card | | | | | |
| ON | | grounder in the hole to left, SINGLE 2PL 7-2 1A2 PLB 7-5-4 2GA2 | | | | | |
| TROUBLE | | looper down leftfield line/rightfield line, DOUBLE 2GA3 R1:PLB 7-6-1-5/9-6-1-5 advancing on throw | | | | | |
| DEEP TROUBLE | | fly to deep center, centerfielder collides with wall, ER(cf):CP 8-6-5 at home for inside-the-park HOME RUN or TRIPLE | | | | | |
| BLAST | | deep drive to power field, HOME RUN 5' | | | | | |
| !? | | swinging bunt, 2-3 A1 | | | | | |
| SAC BUNT | | 1-4 A1, SFT:foul | | | | | |
| BUNT FOR HIT | | SH:toward third CPB, A1, or ball, CRN:lead runner out on FC | | | | | |
| HIT&RUN | | get play result | | | | | |
| HIT/ERROR | | ER(1B):grounder, misplay receiving throw, see Outcome table | | | | | |
| GB/FB | | use - result above | | | | | |
| CHANCES | | safe | on steal except home ER(c):overthrow A1 only or out | AR: | WP + | ER + | + |

14

41

FIG. 19

| B1 | 6 | ab cdefghijklmnop<br>Check BSR or PSR, on BLAST check park | | | | | |
|---|---|---|---|---|---|---|---|
| ! | | ON | | | | | |
| – | | use HIT/ERROR result on this card; bouncer to firstbaseman, 3-6 or 3-1, SD:2A, R3:CH:3-2 or 3-1 A1 | | | | | |
| ON | | grounder in the hole to left, SINGLE 2PL 7-2 1A2 PLB 7-5-4 2GA2 | | | | | |
| TROUBLE | | liner down leftfield line/rightfield line, SINGLE A2, PL 7-4/9-4 or stretched DOUBLE | | | | | |
| DEEP TROUBLE | | fly to deep center, ER(cf):CP 8-6-5 at home for inside-the-park HOME RUN or TRIPLE | | | | | |
| BLAST | | deep drive to power field, HOME RUN 5' | | | | | |
| !? | | swinging bunt, 2-3 A1 | | | | | |
| SAC BUNT | | 1-4 A1, SFT:called strike | | | | | |
| BUNT FOR HIT | | SH:left of plate CPB(c), A1, or ball | | | | | |
| HIT&RUN | | get play result | | | | | |
| HIT/ERROR | | bouncer to firstbaseman ER/EB:bobble, see Outcome table or use – result on this card | | | | | |
| FB | | fly to center, SD:2A, 3A | | | | | |
| CHANCES | | safe | on steal except home ER(c): overthrow A1 or out | AR: | WP + | ER + | + |

45

FIG. 20

| B1 | 7 | ab cdefghijklmnop<br>Check BSR or PSR, on BLAST check park | | | | | |
|---|---|---|---|---|---|---|---|
| ! | | ON | | | | | |
| – | | grounder to first base, CH( ):SINGLE A2 or scooped, AR:3-6-3 DP 3A or 3-6, if first is empty or two out PO 3, R2:CH:hold, full:3-2-3 DP | | | | | |
| ON | | grounder in the hole to left, CH(SS*):half-hopped on routine play or SINGLE 2GA2 | | | | | |
| TROUBLE | | liner down leftfield line/rightfield line, DOUBLE 1PL 7-6-2/9-4-2 2GA3 PLB 7-6-1-5/9-4-1-5 | | | | | |
| DEEP TROUBLE | | fly to deep rightcenter, rightfielder slips, ER(cf):CP 8-4-5 at home for inside-the-park HOME RUN or TRIPLE | | | | | |
| BLAST | | deep drive to power field, HOME RUN 5' | | | | | |
| !? | | swinging bunt, 2-3 A1 | | | | | |
| SAC BUNT | | SH:1-4 A1 or called strike SUI: misses pitch SFT:called strike | | | | | |
| BUNT FOR HIT | | toward first ER(2B):safe on bobble, A1, or out at first | | | | | |
| HIT&RUN | | get play result | | | | | |
| HIT/ERROR | | grounder in the hole between first and second stopped by secondbaseman, SINGLE A1 | | | | | |
| FB | | GD:4-6-3 DP 3A, or popup near third base (PO 5) | | | | | |
| CHANCES | | safe | on steal attempt ER:baseman, drops ball or out | AR: | WP + | ER + | + |

39

FIG. 21

| B1 | 8 | ab cdefghijklmnop<br>Check BSR or PSR, on BLAST check park | | | | | |
|---|---|---|---|---|---|---|---|
| ! | | ON | | | | | |
| – | | rhb:hard grounder to thirdbaseman, AR:5-4-3 DP, R-12:5 FC or try for DP, SD:5-3 3A or 5-2 lhb:hard grounder scooped by firstbaseman, AR:SD:3-6 or PO 3, 2A, SD: PO 3 3A or 3-2 | | | | | |
| ON | | liner in the hole to left, SINGLE 2PL 7-2 2G2A2 | | | | | |
| TROUBLE | | liner down leftfield line/rightfield line, CH(LF*/RF*):running catch or DOUBLE 2GA3 | | | | | |
| DEEP TROUBLE | | fly to deep rightcenter, rightfielder collides with wall, ER(rf):inside-the-park HOME RUN or TRIPLE | | | | | |
| BLAST | | deep drive to power field, HOME RUN 5' | | | | | |
| !? | | swinging bunt, 2-3 A1 | | | | | |
| SAC BUNT | | SH:1-4 A1 or ball SUI:misses pitch SFT:FC 1-2 | | | | | |
| BUNT FOR HIT | | SH:toward first CPB, A1, or misses pitch, CRN:lead runner out on FC | | | | | |
| HIT&RUN | | get play result | | | | | |
| HIT/ERROR | | ER(1B):grounder, misplay receiving throw, see Outcome table | | | | | |
| FB | | popup to short rightcenter (PO 4) | | | | | |
| CHANCES | | safe | on steal attempt ER:baseman, drops ball or out | AR: | WP + | ER + | + |

42

44

FIG. 22

| B1 | 9 | a b c d e f g h i j k l m n o<br>Check BSR or PSR, on BLAST check park | | | | |
|---|---|---|---|---|---|---|
| ! | | ON | | | | |
| - | | rhb:high bouncer to thirdbaseman, AR:SD:5-4, R-12:5 FC, R3:5-2<br>lhb:bouncer to firstbaseman PO 3, R3:choice of (CP 3-2 or all safe) or (3-1 A1) | | | | |
| ON | | liner to left, CH(LF*):running catch or SINGLE 2G2A2 | | | | |
| TROUBLE | | liner down leftfield line/rightfield line, DOUBLE | | | | |
| DEEP TROUBLE | | fly to deep rightcenter, ER(rf):inside-the-park HOME RUN or TRIPLE | | | | |
| BLAST | | deep drive to power field, HOME RUN 10' | | | | |
| !? | | swinging bunt, 2-3 A1 | | | | |
| SAC BUNT | | SH:1-4 A1 or ball SUI: misses pitch SFT:FC 1-2 | | | | |
| BUNT FOR HIT | | SH:toward first CPB, A1, or misses pitch, CRN:lead runner out on FC | | | | |
| HIT&RUN | | get play result | | | | |
| HIT/ERROR | | ER(1B):grounder, contact misplay, see Outcome table | | | | |
| FB | | rhb:popup near second base (PO 4)<br>lhb:liner to second | | | | |
| CHANCES | safe | on steal attempt check WP, BK, or PB rating, on WP R2 | AR: | WP + | ER + | + |

FIG. 23

| B1 | 10 | a b c d e f g h i j k l m n o<br>Check BSR or PSR, on BLAST check park | | | | |
|---|---|---|---|---|---|---|
| ! | | ON | | | | |
| - | | rhb:grounder gloved by thirdbaseman, AR:5-4-3 or 5-3, 2A, SD:3A<br>lhb:hard grounder to firstbaseman, AR:SD:3-6 or PO 3, SD:PO 3 3A or 3-2 | | | | |
| ON | | liner in hole to left, SINGLE 2PL 7-2 1A2 PLB 7-5-4 | | | | |
| TROUBLE | | outfielder of choice makes fine catch of fly (and doubles up lead runner on second or first) | | | | |
| DEEP TROUBLE | | fly to deep rightcenter TRIPLE, ER(rf):CP 9-4-5 at home for inside-the-park HOME RUN | | | | |
| BLAST | | deep drive to power field, HOME RUN 10' | | | | |
| !? | | swinging bunt, 2-3 A1 | | | | |
| SAC BUNT | | SH:1-4 A1 or misses pitch, SFT:FC 1-2 | | | | |
| BUNT FOR HIT | | toward first ER(1B):safe on bobble, A1, or out at first, CRN:out at first as firstbaseman tags batter, sacrifice? | | | | |
| HIT&RUN | | get play result | | | | |
| HIT/ERROR | | rhb:ER(2B):drops pop, see Outcome table<br>lhb:ER(ss):drops pop, see Outcome table | | | | |
| FB | | GD:6-4-3 DP 3A, popup between first and second (PO 4) | | | | |
| CHANCES | safe | on steal attempt check HB:hit-by-pitch | AR: | WP + | ER + | + |

FIG. 24

| B1 | 11 | a b c d e f g h i j k l m n o p<br>Check BSR or PSR, on BLAST check park | | | | |
|---|---|---|---|---|---|---|
| ! | | ON | | | | |
| - | | rhb:GD:6-4-3 DP 3A, or grounder to thirdbaseman, AR:5-4-3 or 5-3, 3A<br>lhb:GD:6-4-3 DP 3A, or slow grounder to firstbaseman, 3-1 | | | | |
| ON | | liner to left, CH(LF*):routine play or SINGLE 2A2 | | | | |
| TROUBLE | | liner down leftfield line/rightfield line, CH(LF+*/RF+*):running catch or DOUBLE SD:A3 | | | | |
| DEEP TROUBLE | | fly to deep rightfield, rightfielder misplays carom, TRIPLE | | | | |
| BLAST | | deep drive to power field, HOME RUN 10' | | | | |
| !? | | swinging bunt, 2-3 A1 | | | | |
| SAC BUNT | | SH:1-4 A1 or foul, SFT:FC 1-2 | | | | |
| BUNT FOR HIT | | SH:near mound CPB, A1, or foul | | | | |
| HIT&RUN | | get play result | | | | |
| HIT/ERROR | | ER(1B):grounder to first, throwing misplay, see Outcome table | | | | |
| FB | | rhb:GD:4-6-3 DP 3A, or foul popup in shallow right (PO 4 or 9)<br>lhb:GD:4-6-3 DP 3A, or foul popup in shallow left (PO 6 or 7) | | | | |
| CHANCES | safe | on steal of second test MV for out at second, but out at third or home | AR: | WP + | ER + | + |

FIG. 25

| B1 | 12 | a b c d e f g h i j k l m n o p<br>Check BSR or PSR, on BLAST check park | | | | |
|---|---|---|---|---|---|---|
| ! | | ON | | | | |
| - | | rhb:bouncer to thirdbaseman, AR:5-4-3 or 5-3, R3:CH:5-2<br>lhb:hard grounder to firstbaseman, AR:3-6-3 DP, if first is empty or two out PO 3 | | | | |
| ON | | liner to left, CH(LF+*):running catch or SINGLE SD:A2 | | | | |
| TROUBLE | | looper to left, CH(LF+*/RF+*):running catch or DOUBLE 2GA3 | | | | |
| DEEP TROUBLE | | fly to deep rightfield, lost in lights, TRIPLE | | | | |
| BLAST | | deep drive to power field, HOME RUN 10' | | | | |
| !? | | swinging bunt fielded by catcher, SINGLE | | | | |
| SAC BUNT | | SH:1-4 A1 or foul, SFT:FC 1-2 | | | | |
| BUNT FOR HIT | | SH:near mound CPB, A1, or foul | | | | |
| HIT&RUN | | get play result | | | | |
| HIT/ERROR | | ER(2B):grounder, see Outcome table, throwing misplay | | | | |
| FB | | GD:6-4-3 DP 3A, or high popup between first and second (PO 4) | | | | |
| CHANCES | safe | on steal of second test MV for out at second, but out at third or home | AR: | WP + | ER + | + |

FIG. 26

| B1 | 13 | a b c d e f g h i j k l m n o p<br>Check BSR or PSR, on BLAST check park | | | | |
|---|---|---|---|---|---|---|
| ! | | ON | | | | |
| – | | rhb:bouncer to thirdbaseman, AR:SD:5-4, CH:R3:hold or 3A<br>lhb:bouncer in the hole to firstbaseman, 3-1, 2A | | | | |
| ON | | hard liner to left, CH(3B+*):diving stop or SINGLE SD:A2 | | | | |
| TROUBLE | | liner rolls to leftfield corner/to rightfield wall, DOUBLE 2GA3 | | | | |
| DEEP TROUBLE | | fly to deep rightfield, rightfielder collides with wall, TRIPLE | | | | |
| BLAST | | deep drive to power field, HOME RUN 10' | | | | |
| !? | | swinging bunt fielded by pitcher, SINGLE | | | | |
| SAC BUNT | | SH:1-4 A1 or foul, SFT:FC 1-2 | | | | |
| BUNT FOR HIT | | SH:past mound on firstbase side CPB, A1, or called strike, CRN:out at first, 3-1, sacrifice? | | | | |
| HIT&RUN | | get play result | | | | |
| HIT/ERROR | | ER(2B):hard grounder in the hole, infield hit and bad throw, A2 BA2, or 4-6 | | | | |
| FB | | rhb:liner to shortstop<br>lhb:high popup on the infield grass (PO 6) | | | | |
| CHANCES | safe | on steal of second test MV for out at second, but out at third or home | AR: | WP + | ER + | + |

FIG. 27

| B1 | 14 | a b c d e f g h i j k l m n o p<br>Check BSR or PSR, on BLAST check park | | | | |
|---|---|---|---|---|---|---|
| ! | | ON | | | | |
| – | | rhb:bouncer in the hole to thirdbaseman, AR:5-4-3 DP, R-12:5 FC or try for DP, SD:3A<br>lhb:bouncer to firstbaseman, 3-1, R2:CH:hold | | | | |
| ON | | looper into left, CH(LF+*):routine play or SINGLE 2A2 2GA2 | | | | |
| TROUBLE | | liner rolls to leftfield corner/to rightfield wall, DOUBLE 1PL 7-6-2/9-4-2 2GA3 | | | | |
| DEEP TROUBLE | | liner to right skips past rightfielder and rolls to the wall, TRIPLE | | | | |
| BLAST | | deep drive to power field, HOME RUN 10' | | | | |
| !? | | foul pop behind home plate, drops it | | | | |
| SAC BUNT | | 1-3 A1, SFT:FC 3-2 | | | | |
| BUNT FOR HIT | | SH:past mound on firstbase side CPB, A1, or called strike | | | | |
| HIT&RUN | | get play result | | | | |
| HIT/ERROR | | slow roller, ER(2B):infield hit and bad throw, A2 BA2, or 4-3 A1 | | | | |
| FB | | rhb:foul popup near the crowd (PO 2)<br>lhb:popup back of shortstop (PO 6) | | | | |
| CHANCES | safe | on steal of second test MV for out at second, but out at third or home | AR: | WP + | ER + | + |

FIG. 28

| B1 | 15 | a b c d e f g h i j k l m n o p<br>Check BSR or PSR, on BLAST check park | | | | | |
|---|---|---|---|---|---|---|---|
| ! | | ON | | | | | |
| - | | rhb:grounder to thirdbaseman, AR:5-4-3 DP, SD:5-3 3A or 5-2<br>lhb:bouncer to firstbaseman, AR:SD:3-6 or PO 3, R2:CH:hold | | | | | |
| ON | | liner to left/to right, SINGLE 2PL 7-2/9-2 1A2 2GA2 | | | | | |
| TROUBLE | | liner to left, CH(LF*):sliding catch or sliding catch misses/to right DOUBLE | | | | | |
| DEEP TROUBLE | | liner to right, rightfielder slips and ball rolls to the wall, TRIPLE | | | | | |
| BLAST | | deep drive to power field, HOME RUN 10' | | | | | |
| !? | | swinging bunt, catcher bobbles it A1 | | | | | |
| SAC BUNT | | to the mound AR:lead runner out on FC or 1-3 A1 SFT:FC 3-2 | | | | | |
| BUNT FOR HIT | | invent play details | | | | | |
| HIT&RUN | | get play result | | | | | |
| HIT/ERROR | | ER(ss):grounder, see Outcome table, throwing misplay | | | | | |
| FB | | GD:6-4-3 DP 3A, or foul popup near home (PO 2) | | | | | |
| CHANCES | | safe | on steal of second test MV for out at second, but out at third or home | AR: | WP + | ER + | + |

46

52

FIG. 29

| B1 | 16 | a b c d e f g h i j k l m n o p<br>Check BSR or PSR, on BLAST check park | | | | | |
|---|---|---|---|---|---|---|---|
| ! | | ON | | | | | |
| - | | rhb:hard grounder gloved by thirdbaseman, AR:5-4-3 DP<br>lhb:hard grounder gloved by firstbaseman, AR:SD:3-6 or 3-1, R2:CH:hold | | | | | |
| ON | | liner to left, CH(3B*):knocked down or SINGLE 2G2A2 | | | | | |
| TROUBLE | | liner to leftfield warning track/rightfield, CH(LF*/RF*):running catch or DOUBLE SD:A3 | | | | | |
| DEEP TROUBLE | | liner to right, rightfielder misses sliding catch, TRIPLE | | | | | |
| BLAST | | deep drive to power field, HOME RUN 10' | | | | | |
| !? | | strikeout, catcher drops ball, throwing misplay, see Outcome table, or 2-3 A1, if first is occupied before two are out, batter is out and runners hold | | | | | |
| SAC BUNT | | SH:1-3 A1 or called strike CRN:called strike SUI:foul | | | | | |
| BUNT FOR HIT | | toward first ER(2B):safe on bobble, A1, or out at first | | | | | |
| HIT&RUN | | get play result | | | | | |
| HIT/ERROR | | ER(ss):grounder, see Outcome table, throwing misplay | | | | | |
| FB | | GD:4-6-3 DP 3A, or fly to deep left, 3A | | | | | |
| CHANCES | | safe | on steal, out at third or home | AR: | WP + | ER + | + |

FIG. 30

| B2 | 17 | a b c d e f g h i j k l m n o p<br>Check BSR or PSR, on BLAST check park | | | | | |
|---|---|---|---|---|---|---|---|
| ! | | ON | | | | | |
| - | | rhb:hard grounder to thirdbaseman, AR:5-4-3 DP<br>lhb:high bouncer to firstbaseman, 3-1, 2A | | | | | |
| ON | | liner to left/to right, SINGLE SD:2PL 7-2/9-2 | | | | | |
| TROUBLE | | liner to leftfield wall/to rightfield wall, CH(LF*/RF*):routine play or DOUBLE 2GA3 | | | | | |
| DEEP TROUBLE | | liner to right skips past rightfielder and rolls to the wall, TRIPLE | | | | | |
| BLAST | | deep drive to power field, HOME RUN 10' | | | | | |
| !? | | swinging bunt, catcher makes bad throw to first, A1 | | | | | |
| SAC BUNT | | SH:1-3 A1 or called strike CRN:strikeout SUI:foul | | | | | |
| BUNT FOR HIT | | SH:pop to pitcher or called strike | | | | | |
| HIT&RUN | | get play result | | | | | |
| HIT/ERROR | | slow roller ER(ss):infield hit and bad throw, A2 BA2, or 6-4, A1 | | | | | |
| FB | | fly to leftcenter (PO 7) SD:2A, 3A | | | | | |
| CHANCES | | safe | on steal, out at third or home | AR: | WP + | ER + | + |

FIG. 31

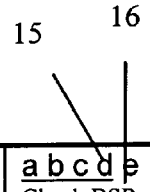

| B2 | 18 | a b c d e f g h i j k l m n o p<br>Check BSR or PSR, on BLAST check park | | | | | |
|---|---|---|---|---|---|---|---|
| ! | | TROUBLE | | | | | |
| - | | use HIT/ERROR result on this card; grounder to thirdbaseman, AR:SD:5-4-3 DP, SD:2A, R3:CH:5-2 | | | | | |
| ON | | looper to leftcenter/to right, SINGLE A2 R2:PLB 7-5-4/9-3-4 | | | | | |
| TROUBLE | | liner to leftfield wall/to rightfield wall, SINGLE A2 2GA3, PL 7-4/9-6 or stretched DOUBLE | | | | | |
| DEEP TROUBLE | | liner to right, rightfielder slips and ball rolls to the wall, TRIPLE | | | | | |
| BLAST | | deep drive to power field, HOME RUN 10' | | | | | |
| !? | | ground-rule DOUBLE on fan interference, fan ejected for touching ball, invent play details | | | | | |
| SAC BUNT | | 3-4 A1, SFT:FC 3-2 | | | | | |
| BUNT FOR HIT | | called strike, CRN:pop to pitcher | | | | | |
| HIT&RUN | | get play result | | | | | |
| HIT/ERROR | | grounder to thirdbaseman ER/EB:bobble, see Outcome table or use – result on this card | | | | | |
| FB | | fly near the leftfield line, SD:2A, 3A | | | | | |
| CHANCES | | safe | on steal, out at third or home | AR: | WP + | ER * | + |

FIG. 32

| B2 | 19 | a b c d e f g h i j k l m n o p<br>Check BSR or PSR, on BLAST check park | | | | | |
|---|---|---|---|---|---|---|---|
| ! | | TROUBLE | | | | | |
| - | | hard grounder to third base, CH( ):SINGLE 2GA2 or gloved AR:SD:5-4-3 DP, R-12:5 FC, SD:2A, R3:CH:hold | | | | | |
| ON | | infielder of choice snares line drive (and doubles up lead runner) | | | | | |
| TROUBLE | | liner to leftfield wall/to rightfield wall, CH(LF+*/RF+*):routine play or DOUBLE 2GA3 | | | | | |
| DEEP TROUBLE | | liner to right, rightfielder misses sliding catch, TRIPLE | | | | | |
| BLAST | | deep drive to power field, HOME RUN 15' | | | | | |
| !? | | interference, BA1, invent play details | | | | | |
| SAC BUNT | | 3-4 A1, SFT:FC 3-2 | | | | | |
| BUNT FOR HIT | | SH:pop to firstbaseman or ball | | | | | |
| HIT&RUN | | get play result | | | | | |
| HIT/ERROR | | rhb:grounder in the hole at shortstop, late throw, SINGLE A1<br>lhb:slow grounder on the left side past the mound, SINGLE A1 | | | | | |
| FB | | fly to shallow left, 3PL 7-2 DP | | | | | |
| CHANCES | | safe | on steal, out at third or home | AR: | WP *, SD for advance | ER * | + |

FIG. 33

| B2 | 20 | a b c d e f g h i j k l m n o p<br>Check BSR or PSR, on BLAST check park | | | | | |
|---|---|---|---|---|---|---|---|
| ! | | TROUBLE | | | | | |
| - | | bouncer to thirdbaseman, AR:5-4-3 DP 3A, full:5-2-3 DP | | | | | |
| ON | | liner to leftcenter/to right, SINGLE 2PL 8-2/9-2 1A2 PLB 8-5-4/9-3-4 | | | | | |
| TROUBLE | | liner to leftfield wall/to rightfield wall, DOUBLE SD:A3 | | | | | |
| DEEP TROUBLE | | liner down leftfield line, left fielder misses diving catch, DOUBLE A3, PL 7-5 or stretched TRIPLE | | | | | |
| BLAST | | deep drive to power field, HOME RUN 15' | | | | | |
| !? | | game suspended due to rain, then stopped | | | | | |
| SAC BUNT | | 3-4 A1, SFT:ball | | | | | |
| BUNT FOR HIT | | SH:pop to thirdbaseman or ball | | | | | |
| HIT&RUN | | get play result | | | | | |
| HIT/ERROR | | hard grounder in the hole, ER(ss):infield hit and bad throw, A2 BA2, or 6-4, A1 | | | | | |
| FB | | fly to left, CH(-):SINGLE 2A2 2GA2 or caught, 3A | | | | | |
| CHANCES | | safe | on steal, out at third or home | AR: | WP *, SD:advance 2 or 1 | ER * | + |

FIG. 34

| B2 | 21 | a b c d e f g h i j k l m n o p<br>Check BSR or PSR, on BLAST check park | | | | | |
|---|---|---|---|---|---|---|---|
| ! | | TROUBLE | | | | | |
| - | | foul popup on the right side (PO 3) | | | | | |
| ON | | bouncer up the middle/into right, CH(2B*):half-hopped on routine play or SINGLE SD:A2 | | | | | |
| TROUBLE | | smash up the middle CH:pitcher snares liner (and doubles up lead runner) or 1-3 | | | | | |
| DEEP TROUBLE | | liner to leftcenter skips past leftfielder, DOUBLE A3, PL 7-5 or stretched TRIPLE | | | | | |
| BLAST | | deep drive to power field, HOME RUN 15' | | | | | |
| !? | | injury, for specifics see Injury table, invent play details | | | | | |
| SAC BUNT | | 3-4 A1, SFT:misses pitch | | | | | |
| BUNT FOR HIT | | pop to catcher | | | | | |
| HIT&RUN | | get play result | | | | | |
| HIT/ERROR | | ER(3B):grounder, see Outcome table, throwing misplay | | | | | |
| GB | | rhb:chopper to shortstop, 6-4, R2:CH:hold, 3A<br>lhb:bouncer in the hole gloved by secondbaseman, AR:SD:4-6-3 DP 3A, 2A, 3A | | | | | |
| CHANCES | | safe | on steal, out at third or home | AR: | WP *, SD for advance | ER * | + |

FIG. 35

| B3 | 22 | a b c d e f g h i j k l m n o p<br>Check BSR or PSR, on BLAST check park | | | | | |
|---|---|---|---|---|---|---|---|
| ! | | DEEP TROUBLE | | | | | |
| - | | rhb:popup back of first (PO 3)<br>lhb:liner to first | | | | | |
| ON | | grounder up the middle/into right, SINGLE 2A2 1PL 8-5/9-5 | | | | | |
| TROUBLE | | looper to leftcenter/to right, CH(CF*/RF*): routine play or DOUBLE SD:A3 | | | | | |
| DEEP TROUBLE | | fly to deep leftcenter, leftfielder and centerfielder collide, TRIPLE | | | | | |
| BLAST | | deep drive to power field, HOME RUN 15' | | | | | |
| !? | | injury, for specifics see Injury table, invent play details | | | | | |
| SAC BUNT | | 3-4 A1, CRN:strikeout | | | | | |
| BUNT FOR HIT | | popup to pitcher, lead runner doubled up | | | | | |
| HIT&RUN | | get play result | | | | | |
| HIT/ERROR | | ER(3B):grounder, see Outcome table, throwing misplay | | | | | |
| GB | | smash half-hopped by shortstop, AR:6-4-3 DP 3A, R2:CH:hold, R3:CH:6-2 or 6-3 A1 | | | | | |
| CHANCES | | safe | on steal, out at third or home | AR: | WP *, SD for advance | ER * | + |

FIG. 36

47

| B3 | 23 | a b c d e f g h i j k l m n o p<br>Check BSR or PSR, on BLAST check park | | | | | |
|---|---|---|---|---|---|---|---|
| ! | | BLAST | | | | | |
| - | | foul popup near the leftfield line (PO 5) | | | | | |
| ON | | grounder up the middle, SINGLE A2 R2:PLB 8-1-4 | | | | | |
| TROUBLE | | fly to deep leftcenter, DOUBLE 1PL 7-6-2 | | | | | |
| DEEP TROUBLE | | fly to deep center, centerfielder loses ball in lights, TRIPLE | | | | | |
| BLAST | | deep drive to power field, HOME RUN 15' | | | | | |
| !? | | game suspended due to rain, then stopped | | | | | |
| SAC BUNT | | 3-4 A1, CRN:foul | | | | | |
| BUNT FOR HIT | | SH:1-3 A1 sacrifice? | | | | | |
| HIT&RUN | | get play result | | | | | |
| HIT/ERROR | | slow roller ER(3B):infield hit and bad throw, A2 BA2 or 5-3, A1 | | | | | |
| GB | | GD:4-6-3 DP 3A, or high bouncer to shortstop, 2A, 3A | | | | | |
| CHANCES | | safe | on steal walk, out<br>on steal of home | AR: | WP * | ER * | + |

FIG. 37

| B3 | 24 | a b c d e f g h i j k l m n o p<br>Check BSR or PSR, on BLAST check park | | | | | |
|---|---|---|---|---|---|---|---|
| ! | | BLAST | | | | | |
| - | | GD:4-6-3 DP 3A, or popup back of third (PO 5) | | | | | |
| ON | | grounder up the middle, SINGLE A2 R2:PLB 8-1-6 | | | | | |
| TROUBLE | | fly to deep leftcenter/liner down rightfield line, CH(CF+*/RF+*):routine play or DOUBLE 2GA3 | | | | | |
| DEEP TROUBLE | | fly to deep center, centerfielder collides with wall, TRIPLE | | | | | |
| BLAST | | deep drive to power field, HOME RUN 15' | | | | | |
| !? | | fan on the field, game delayed | | | | | |
| SAC BUNT | | SH:3-4 A1or foul, SFT:FC 1-2 | | | | | |
| BUNT FOR HIT | | 4-3 A1 sacrifice? | | | | | |
| HIT&RUN | | get play result | | | | | |
| HIT/ERROR | | hard shot at thirdbaseman, ER(3B):infield hit and bad throw, A2 BA2 or 5-4, A1 | | | | | |
| GB | | grounder to third, AR:5-4 FC, R-12:5 FC, full: 5-1-2 DP | | | | | |
| CHANCES | | safe | on steal walk, out<br>on steal of home | AR: | WP * | ER * | + |

FIG. 38

| B3 | 25 | a b c d e f g h i j k l m n o p<br>Check BSR or PSR, on BLAST check park | | | | | |
|---|---|---|---|---|---|---|---|
| ! | | BLAST | | | | | |
| - | | GD:4-6-3 DP 3A, or popup near third base (PO 5) | | | | | |
| ON | | grounder up the middle, CH(SS*):stopped or SINGLE 2A2 2GA2 | | | | | |
| TROUBLE | | fly to deep leftcenter/down rightfield line, DOUBLE 2GA3 | | | | | |
| DEEP TROUBLE | | liner to center, centerfielder slips and ball rolls on, TRIPLE | | | | | |
| BLAST | | deep drive to power field, HOME RUN 15' | | | | | |
| !? | | object on field, game delayed | | | | | |
| SAC BUNT | | SH:3-4 A1 or foul, SFT:FC 3-2 | | | | | |
| BUNT FOR HIT | | to the mound, lead runner out on FC | | | | | |
| HIT&RUN | | get play result | | | | | |
| HIT/ERROR | | grounder in the hole pursued by secondbaseman, bad hop, SINGLE A1 | | | | | |
| GB | | grounder up the middle gloved by shortstop, AR:SD:6-4-3 DP 3A, SD:2A, 3A | | | | | |
| CHANCES | | safe | on steal walk, out on steal of home | AR: | WP * | ER * | + |

FIG. 39

| B3 | 26 | a b c d e f g h i j k l m n o p<br>Check BSR or PSR, on BLAST check park | | | | | |
|---|---|---|---|---|---|---|---|
| ! | | BLAST | | | | | |
| - | | hard grounder gloved by secondbaseman, AR:SD(R1):4-6-3 DP 3A, CH:R2:hold, 3A | | | | | |
| ON | | grounder up the middle, SINGLE 2PL 8-2 1A2 PLB 8-1-6 2GA3 | | | | | |
| TROUBLE | | liner to deep leftcenter/down rightfield line, DOUBLE 1PL 8-6-2/9-4-2 | | | | | |
| DEEP TROUBLE | | liner to center, centerfielder misses sliding catch, TRIPLE | | | | | |
| BLAST | | deep drive to power field, HOME RUN 15' | | | | | |
| !? | | hard grounder glances off pitcher, SINGLE R1 | | | | | |
| SAC BUNT | | SH:3-4 A1 or called strike SUI:foul SFT:FC 3-2 | | | | | |
| BUNT FOR HIT | | SH:to the mound, lead runner out on FC or misses pitch | | | | | |
| HIT&RUN | | get play result | | | | | |
| HIT/ERROR | | ER(2B):grounder, flip to secondbaseman who pulls foot off second but still out at first or DP, see Outcome table (throw from), if first is empty 6-3 | | | | | |
| FB | | GD:4-6-3 DP 3A, or fly to left, 3A | | | | | |
| CHANCES | | safe | on steal safe at third, out at home | AR: | WP * | ER * | + |

FIG. 40

| B3 | 27 | a b c d e f g h i j k l m n o p<br>Check BSR or PSR, on BLAST check park | | | | | |
|---|---|---|---|---|---|---|---|
| ! | | BLAST | | | | | |
| – | | use HIT/ERROR result on this card; grounder gloved by secondbaseman, AR:4-6-3 DP 3A, CH:R2:hold, 3A | | | | | |
| ON | | liner up the middle, CH(SS+*):diving stop or SINGLE 2A2 | | | | | |
| TROUBLE | | fly to deep leftcenter/down rightfield line, CH(CF+*/RF+*):running catch or DOUBLE 2GA3 | | | | | |
| DEEP TROUBLE | | liner to center skips past centerfielder and rolls to wall, TRIPLE | | | | | |
| BLAST | | deep drive to power field, HOME RUN 15' | | | | | |
| !? | | runner out on pickoff play, invent play details, see Pickoff table | | | | | |
| SAC BUNT | | SH:3-4 A1 or called strike SUI:foul SFT:FC 3-2 | | | | | |
| BUNT FOR HIT | | misses pitch, CRN:to the mound, lead runner out on FC | | | | | |
| HIT&RUN | | get play result | | | | | |
| HIT/ERROR | | grounder to secondbaseman ER/EB:bobble, see Outcome table or use – result on this card | | | | | |
| FB | | fly to left, 2PL 7-5 DP, 3PL 7-2 DP | | | | | |
| CHANCES | | safe | on steal safe at third, out at home | AR: | WP * | ER * | + |

48

FIG. 41

| B3 | 28 | a b c d e f g h i j k l m n o p<br>Check BSR or PSR, on BLAST check park | | | | | |
|---|---|---|---|---|---|---|---|
| ! | | BLAST | | | | | |
| – | | grounder half-hopped by secondbaseman, AR:4-6-3 DP, CH:R2:hold, full:4-2-3 DP | | | | | |
| ON | | liner up the middle, CH(SS+*):half-hopped on routine play or SINGLE 2A2 | | | | | |
| TROUBLE | | shortstop snares liner (and doubles up lead runner) | | | | | |
| DEEP TROUBLE | | fly to deep rightcenter, centerfielder and rightfielder collide, TRIPLE | | | | | |
| BLAST | | deep drive to power field, HOME RUN 15' | | | | | |
| !? | | runner out on pickoff play, invent play details, see Pickoff table | | | | | |
| SAC BUNT | | SH:3-4 A1 or called strike SUI:foul SFT:FC 5-2 | | | | | |
| BUNT FOR HIT | | toward third, lead runner out on FC | | | | | |
| HIT&RUN | | get play result | | | | | |
| HIT/ERROR | | ER(p):covers first on grounder, drops toss from firstbaseman, for runner advance see Outcome table (misplay receiving throw) | | | | | |
| FB | | liner to left, CH( ) or (-):SINGLE 2A2 2GA2 or caught, 3A | | | | | |
| CHANCES | | safe | on steal safe at third, out at home | AR: | WP * | ER * | + |

17

FIG. 42

| B3 | 29 | a b c d e f g h i j k l m n o p<br>Check BSR or PSR, on BLAST check park | | | | | |
|---|---|---|---|---|---|---|---|
| ! | | BLAST | | | | | |
| - | | rhb:bouncer in the hole gloved by shortstop, AR:SD:6-4, R2:CH:hold, 3A<br>lhb:grounder to secondbaseman, AR:SD:4-6-3 DP, 2A, 3A | | | | | |
| ON | | liner up the middle, CH(2B+*):stopped or SINGLE 2A2 | | | | | |
| TROUBLE | | liner to deep leftcenter/down rightfield line, SINGLE A2, PL 7-4/9-6 or stretched DOUBLE | | | | | |
| DEEP TROUBLE | | liner to the leftcenterfield wall, DOUBLE A3, PL 8-6-5 or stretched TRIPLE | | | | | |
| BLAST | | deep drive to power field, HOME RUN 15' | | | | | |
| !? | | runner out on pickoff play, invent play details, see Pickoff table | | | | | |
| SAC BUNT | | SH:3-4 A1 or ball SUI:foul SFT:FC 5-2 | | | | | |
| BUNT FOR HIT | | toward third, lead runner out on FC | | | | | |
| HIT&RUN | | get play result | | | | | |
| HIT/ERROR | | ER(c):play at home, drops ball, see first row of Outcome table, if bases empty ER(c):swinging bunt, throwing misplay, see Outcome table | | | | | |
| FB | | fly to center, 3A | | | | | |
| CHANCES | | safe | on steal safe at third, out at home | AR: | WP * | ER * | + |

FIG. 43

| B4 | 30 | a b c d e f g h i j k l m n o p<br>Check BSR or PSR, on BLAST check park | | | | | |
|---|---|---|---|---|---|---|---|
| ! | | BLAST | | | | | |
| - | | rhb:slow grounder to shortstop, CH:6 FC, 2A, 3A<br>lhb:smash to secondbaseman, AR:4-3 DP 3A | | | | | |
| ON | | liner up the middle, SINGLE 2PL 8-2 | | | | | |
| TROUBLE | | deep fly (PO 7, 8, or 9), 1PL, 2A, 3A | | | | | |
| DEEP TROUBLE | | fly to deep leftcenter, CH(CF*):out or off the wall, TRIPLE | | | | | |
| BLAST | | deep drive to power field, HOME RUN 15' | | | | | |
| !? | | liner to outfield, fielder traps ball, invent play details, SINGLE R1 2GA2 | | | | | |
| SAC BUNT | | 2-4 A1, CRN:ball SUI:misses pitch | | | | | |
| BUNT FOR HIT | | SH:toward third, lead runner out on FC or misses pitch | | | | | |
| HIT&RUN | | get play result | | | | | |
| HIT/ERROR | | grounder up the middle fielded by secondbaseman, late throw SINGLE A1 | | | | | |
| FB | | GD:5-4-3 DP 3A, or fly to deep center, 2A, 3A | | | | | |
| CHANCES | | safe | on steal safe at third, out at home | AR: | WP * | ER * | + |

FIG. 44

| HB | 31 | a b c d e f g h i j k l m n o p<br>Check BSR or PSR, on BLAST check park | | | | |
|---|---|---|---|---|---|---|
| ! | | HB:hit-by-pitch | | | | |
| - | | rhb:chopper to shortstop, AR:6-4-3 DP 3A, 3A<br>lhb:chopper to secondbaseman, CH:4 FC, 2A, 3A | | | | |
| ON | | liner up the middle/to right, CH(2B+*):diving stop or SINGLE 2G2A2 SD:A2 | | | | |
| TROUBLE | | liner to deep leftcenter, SINGLE A2, PL 8-4 or stretched DOUBLE | | | | |
| DEEP TROUBLE | | liner to deep leftcenter, DOUBLE A3, PL 8-6-5 or stretched TRIPLE | | | | |
| BLAST | | deep drive to power field, HOME RUN 15' | | | | |
| !? | | liner off pitcher's glove into centerfield, SINGLE A2 | | | | |
| SAC BUNT | | SH:2-4 A1 or ball SUI:misses pitch SFT:FC 5-2 | | | | |
| BUNT FOR HIT | | SH:toward third, lead runner out or misses pitch | | | | |
| HIT&RUN | | get play result | | | | |
| HIT/ERROR | | ER(p):grounder, see Outcome table, throwing misplay | | | | |
| FB | | fly to leftcenter (PO 8) 2A, 3A | | | | |
| CHANCES | | safe | on steal safe at third, out at home | AR: | WP * | ER * | + |

FIG. 45

| B4 | 32 | a b c d e f g h i j k l m n o p<br>Check BSR or PSR, on BLAST check park | | | | |
|---|---|---|---|---|---|---|
| ! | | SO called | | | | |
| - | | grounder to secondbaseman, AR:4-6-3 DP 3A, 2A, 3A | | | | |
| ON | | hard liner to center/to right, SINGLE 2PL 8-2/9-2 | | | | |
| TROUBLE | | liner to deep leftcenter, DOUBLE SD:A3 R1:PLB 8-6-5-4 | | | | |
| DEEP TROUBLE | | liner to deep leftcenter, CH(CF+*):running catch or TRIPLE | | | | |
| BLAST | | deep drive to power field, HOME RUN 20' | | | | |
| !? | | liner to left, leftfielder misjudges it, ER:SINGLE 2A2 or 7 | | | | |
| SAC BUNT | | SH:2-4 A1 or misses pitch | | | | |
| BUNT FOR HIT | | near plate, lead runner out on FC | | | | |
| HIT&RUN | | get play result | | | | |
| HIT/ERROR | | grounder to pitcher ER(p):bobble A1 | | | | |
| FB | | fly to rightcenter (PO 8) 2A, 3A | | | | |
| CHANCES | | safe | on steal, strikeout DP | AR: | WP * | ER * | + |

FIG. 46

| B4 | 33 | a b c d e f g h i j k l m n o p<br>Check BSR or PSR, on BLAST check park | | | | | |
|---|---|---|---|---|---|---|---|
| ! | | SO swinging | | | | | |
| - | | grounder up the middle gloved by secondbaseman, AR:SD:4-6-3 DP 3A, 2A | | | | | |
| ON | | looper into center, CH(CF*):running catch or SINGLE 2A2 | | | | | |
| TROUBLE | | liner to wall in leftcenter, DOUBLE A3 R1:PLB 7-6-1-5 | | | | | |
| DEEP TROUBLE | | liner to deep leftcenter, CH(CF+*):running catch or TRIPLE | | | | | |
| BLAST | | deep drive to power field, HOME RUN 20' | | | | | |
| !? | | liner to center, centerfielder misjudges it ER:SINGLE A2 or 8 | | | | | |
| SAC BUNT | | 5-4 A1, CRN:foul | | | | | |
| BUNT FOR HIT | | SH:near plate, lead runner out on FC or ball | | | | | |
| HIT&RUN | | get play result | | | | | |
| HIT/ERROR | | contact misplay, invent play details, see first row of Outcome table | | | | | |
| FB | | fly to center, SD:2A, 3A | | | | | |
| CHANCES | | safe | on steal, strikeout DP | AR: | WP * | ER * | + |

FIG. 47

| B4 | 34 | a b c d e f g h i j k l m n o p<br>Check BSR or PSR, on BLAST check park | | | | | |
|---|---|---|---|---|---|---|---|
| ! | | SO called | | | | | |
| - | | rhb:fly to left, 3A<br>lhb:fly to right, 3A | | | | | |
| ON | | liner to center, SINGLE A2 R2:PLB 8-3-6 | | | | | |
| TROUBLE | | looper to center, CH(CF+*):routine play or DOUBLE 2GA3 | | | | | |
| DEEP TROUBLE | | liner to deep leftcenter, TRIPLE | | | | | |
| BLAST | | deep drive to power field, HOME RUN 20' | | | | | |
| !? | | liner to right, rightfielder misjudges it ER:SINGLE A2 or 9 | | | | | |
| SAC BUNT | | 5-4 A1, CRN:foul | | | | | |
| BUNT FOR HIT | | SH:near plate, lead runner out on FC or ball | | | | | |
| HIT&RUN | | get play result | | | | | |
| HIT/ERROR | | misplay receiving throw, invent play details, see first row of Outcome table | | | | | |
| GB | | use - result above | | | | | |
| CHANCES | | safe | on steal, strikeout DP | AR: | WP * | ER * | * |

FIG. 48

| B4 | 35 | a b c d e f g h i j k l m n o p<br>Check BSR or PSR, on BLAST check park | | | | | |
|---|---|---|---|---|---|---|---|
| ! | | SO swinging | | | | | |
| - | | chopper to secondbaseman, 4-6-3 DP 3A, SD:2A, R3:CH:4-2 or 4-3 A1 | | | | | |
| ON | | liner to center, CH(CF*):routine play or SINGLE A2 | | | | | |
| TROUBLE | | fly to deep center/deep right, DOUBLE 1PL 8-4-2/9-6-2 PLB 8/9-4-3-5 2GA3 | | | | | |
| DEEP TROUBLE | | fly to deep leftcenter, TRIPLE | | | | | |
| BLAST | | deep drive to power field, HOME RUN 20' | | | | | |
| !? | | grounder off pitcher's glove to infielder, test AR rating of secondbaseman or shortstop for DP | | | | | |
| SAC BUNT | | 5-4 A1, SFT:foul | | | | | |
| BUNT FOR HIT | | toward first, lead runner out on FC | | | | | |
| HIT&RUN | | get play result | | | | | |
| HIT/ERROR | | throwing misplay by infielder, invent play details, see second row of Outcome table | | | | | |
| FB | | fly to center, 3PL 8-2 DP | | | | | |
| CHANCES | | baseman + | | AR: | WP * | ER * | * |

FIG. 49

| B4 | 36 | a b c d e f g h i j k l m n o p<br>Check BSR or PSR, on BLAST check park | | | | | |
|---|---|---|---|---|---|---|---|
| ! | | SO swinging | | | | | |
| - | | GD:6-4-3 DP 3A, or slow grounder to secondbaseman, 2A, 3A | | | | | |
| ON | | liner to center/to right, CH(2B*):stopped or SINGLE A2 | | | | | |
| TROUBLE | | liner to center, CH(CF*):sliding catch or sliding catch misses, DOUBLE | | | | | |
| DEEP TROUBLE | | fly to deep leftcenter, DOUBLE A3, PL 8-6-5 or stretched TRIPLE | | | | | |
| BLAST | | deep drive to power field, HOME RUN 20' | | | | | |
| !? | | grounder off pitcher's glove, AR(p):1-4-3 DP or 1-4-3 no DP | | | | | |
| SAC BUNT | | SH:5-4 A1 or misses pitch, SFT:foul | | | | | |
| BUNT FOR HIT | | toward first (tags batter) A1 | | | | | |
| HIT&RUN | | get play result | | | | | |
| HIT/ERROR | | swinging bunt to firstbaseman, CP SINGLE or 3-1 | | | | | |
| FB | | fly to center, 3A | | | | | |
| CHANCES | | baseman + | | AR: | WP * | ER * | * |

FIG. 50

| B4 | 37 | a b c d e f g h i j k l m n o p<br>Check BSR or PSR, on BLAST check park | | | | | |
|---|---|---|---|---|---|---|---|
| ! | | SO swinging | | | | | |
| – | | rhb:popup in short left (PO 5)<br>lhb:bouncer in the hole gloved by secondbaseman, AR:SD:4-6-3 DP 3A, 2A, 3A | | | | | |
| ON | | liner to center, CH(CF+*):running catch or SINGLE 2A2 | | | | | |
| TROUBLE | | liner to wall in rightcenter, DOUBLE SD:A3 R1:PLB 8-4-3-6 | | | | | |
| DEEP TROUBLE | | fly to deep leftcenter, TRIPLE | | | | | |
| BLAST | | deep drive to power field, HOME RUN 20' | | | | | |
| !? | | smash over third, CH:thirdbaseman knocks it down, 5-3 or slow reaction by thirdbaseman, DOUBLE | | | | | |
| SAC BUNT | | SH:5-4 A1 or called strike SUI:foul | | | | | |
| BUNT FOR HIT | | strikeout on missed bunt | | | | | |
| HIT&RUN | | get play result | | | | | |
| HIT/ERROR | | grounder to firstbaseman, bad hop SINGLE A2 | | | | | |
| GB/FB | | use - result above | | | | | |
| CHANCES | | baseman * | | AR: | WP * | ER * | * |

FIG. 51

| B4 | 38 | a b c d e f g h i j k l m n o p<br>Check BSR or PSR, on BLAST check park | | | | | |
|---|---|---|---|---|---|---|---|
| ! | | SO called | | | | | |
| – | | grounder to secondbaseman CH( ):SINGLE 2GA2 or gloved SD:2A, 3A | | | | | |
| ON | | liner to center, CH(CF+*):routine play or SINGLE 2A2 | | | | | |
| TROUBLE | | liner to wall in rightcenter, CH(CF*):running catch or DOUBLE SD:A3 | | | | | |
| DEEP TROUBLE | | hard liner to leftcenter, TRIPLE | | | | | |
| BLAST | | deep drive to power field, HOME RUN 20' | | | | | |
| !? | | smash over first, CH:firstbaseman knocks it down, 3-1 or slow reaction by firstbaseman, DOUBLE A3 | | | | | |
| SAC BUNT | | SH:5-4 A1 or called strike SUI:foul | | | | | |
| BUNT FOR HIT | | toward first ER(p):safe on bobble, A1, or out at first, if not first attempt this at bat then out at first 1-3, sacrifice? | | | | | |
| HIT&RUN | | get play result | | | | | |
| HIT/ERROR | | smash to firstbaseman who knocks it down, SINGLE A1 | | | | | |
| FB | | liner to center, CH( ):SINGLE A2 or caught, 3A | | | | | |
| CHANCES | | baseman * | | AR: | WP * | ER * | * |

FIG. 52

| B4 | 39 | a b c d e f g h i j k l m n o p<br>Check BSR or PSR, on BLAST check park | | | | | |
|---|---|---|---|---|---|---|---|
| ! | | SO, catcher holds foul tip | | | | | |
| - | | hard grounder gloved by shortstop, 6-4-3 DP 3A, R2:choice of (CP 6-5 or all safe OR 6-3 | | | | | |
| ON | | liner to center, CH(SS*):diving stop or SINGLE A2 | | | | | |
| TROUBLE | | looper to rightcenter, CH(RF*):running catch or DOUBLE | | | | | |
| DEEP TROUBLE | | hard liner to leftcenter, TRIPLE | | | | | |
| BLAST | | deep drive to power field, HOME RUN 20' | | | | | |
| !? | | ground-rule double, invent play details | | | | | |
| SAC BUNT | | SH:5-3 A1, CRN:ball SUI:misses pitch | | | | | |
| BUNT FOR HIT | | toward first ER(p):throwing misplay, see Outcome table, or out at first | | | | | |
| HIT&RUN | | get play result | | | | | |
| HIT/ERROR | | ER(ss):grounder, flip to shortstop who pulls foot off second but still out at first (see Outcome table, throw from) or DP, if first is empty 4-3 | | | | | |
| FB | | fly to center, 2PL 8-5 DP, 3PL 8-2 DP | | | | | |
| CHANCES | | baseman * | | AR: | WP * | ER * | * |

FIG. 53

| B5 | 40 | a b c d e f g h i j k l m n o p<br>Check BSR or PSR, on BLAST check park | | | | | |
|---|---|---|---|---|---|---|---|
| ! | | SO swinging | | | | | |
| - | | use HIT/ERROR result on this card; grounder to shortstop, 6-4-3 DP 3A | | | | | |
| ON | | liner to center, CH(SS+*):stopped or SINGLE 2A2 2GA2 | | | | | |
| TROUBLE | | fly to deep rightcenter, DOUBLE 1PL 8-4-2 PLB 8-4-3-5 | | | | | |
| DEEP TROUBLE | | hard liner to leftcenter, TRIPLE | | | | | |
| BLAST | | deep drive to power field, HOME RUN 20' | | | | | |
| !? | | ground-rule double, invent play details | | | | | |
| SAC BUNT | | SH:5-3 A1, SFT:ball | | | | | |
| BUNT FOR HIT | | toward mound ER(p):safe on bad throw, A1, or out at first | | | | | |
| HIT&RUN | | hard ground ball rhb:6-4-3 or 4-3 DP lhb:4-6-3 or 6-3 DP | | | | | |
| HIT/ERROR | | grounder to shortstop ER/EB:bobble, see Outcome table or use – result on this card | | | | | |
| FB | | liner to center (PO 8), SD:3A, R1:AR(P)1-6-3 DP | | | | | |
| CHANCES | | baseman * | | AR: | WP * | ER * | * |

FIG. 54

| B5 | 41 | a b c d e f g h i j k l m n o p<br>Check BSR or PSR, on BLAST check park | | | | | |
|---|---|---|---|---|---|---|---|
| ! | | BB | | | | | |
| - | | grounder gloved by shortstop, AR:SD:6-4-3 DP 3A, full:6-2-3 DP | | | | | |
| ON | | liner to center, SINGLE 2A2 2GA2 | | | | | |
| TROUBLE | | fly to deep rightcenter, DOUBLE 1PL 9-4-2 PLB 9-4-3-5 2GA3 | | | | | |
| DEEP TROUBLE | | hard liner to leftcenter, TRIPLE | | | | | |
| BLAST | | deep drive to power field, HOME RUN 20' | | | | | |
| !? | | ground-rule double, invent play details | | | | | |
| SAC BUNT | | SH:5-3 A1 or ball SUI:misses pitch | | | | | |
| BUNT FOR HIT | | safe on throwing misplay, invent play details, see Outcome table | | | | | |
| HIT&RUN | | foul | | | | | |
| HIT/ERROR | | grounder in the hole at shortstop fielded by thirdbaseman, late throw SINGLE A1 | | | | | |
| FB | | liner to center (PO 8), 3A | | | | | |
| CHANCES | | runner + | out on steal of home | AR: | WP * | ER * | * |

FIG. 55

| B5 | 42 | a b c d e f g h i j k l m n o p<br>Check BSR or PSR, on BLAST check park | | | | | |
|---|---|---|---|---|---|---|---|
| ! | | BB | | | | | |
| - | | rhb:chopper to shortstop, AR:6-4-3 DP 3A, 3A<br>lhb:smash to secondbaseman, AR:4-6-3 DP 3A | | | | | |
| ON | | liner to center/to right, SINGLE 2PL 8-2/9-2 | | | | | |
| TROUBLE | | outfielder of choice makes fine catch of fly (and doubles up lead runner on second or first) | | | | | |
| DEEP TROUBLE | | liner to leftcenter, TRIPLE | | | | | |
| BLAST | | deep drive to power field, HOME RUN 20' | | | | | |
| !? | | ground-rule double, invent play details | | | | | |
| SAC BUNT | | SH:5-3 A1 or misses pitch | | | | | |
| BUNT FOR HIT | | pop to pitcher, lead runner doubled up | | | | | |
| HIT&RUN | | foul | | | | | |
| HIT/ERROR | | slow grounder to secondbaseman, SINGLE A1 | | | | | |
| FB | | liner to right, SD:3A | | | | | |
| CHANCES | | runner + | out on steal of home | AR: | WP * | ER * | * |

FIG. 56

| B5 | 43 | a b c d e f g h i j k l m n o p<br>Check BSR or PSR, on BLAST check park | | | | | |
|---|---|---|---|---|---|---|---|
| ! | | BB | | | | | |
| – | | rhb:hopper to shortstop, AR:6-4-3 DP3A, 3A<br>lhb:chopper to secondbaseman, CH:4 FC, 2A, 3A | | | | | |
| ON | | liner to center, SINGLE 2PL 8-2 | | | | | |
| TROUBLE | | secondbaseman snares liner (and doubles up runner on second or first) | | | | | |
| DEEP TROUBLE | | liner to leftcenter, TRIPLE | | | | | |
| BLAST | | deep drive to power field, HOME RUN 20' | | | | | |
| !? | | check swing blooper, SINGLE 2GA2 | | | | | |
| SAC BUNT | | 3 (tags batter) A1, CRN:misses pitch | | | | | |
| BUNT FOR HIT | | misses pitch | | | | | |
| HIT&RUN | | foul | | | | | |
| HIT/ERROR | | slow grounder to secondbaseman, SINGLE A1 | | | | | |
| FB | | rhb:popup to shallow right (PO 9), 3A<br>lhb:fly to left, 3A | | | | | |
| CHANCES | | runner + | out on steal of home | AR: | WP * | ER * | * |

FIG. 57

| B5 | 44 | a b c d e f g h i j k l m n o p<br>Check BSR or PSR, on BLAST check park | | | | | |
|---|---|---|---|---|---|---|---|
| ! | | BB | | | | | |
| – | | hard grounder near shortstop, CH( ):SINGLE 2G2A2 or gloved SD:2A, 3A | | | | | |
| ON | | liner to center, SINGLE 2A2 | | | | | |
| TROUBLE | | liner to deep rightcenter, SINGLE A2, PL 8-4 or stretched DOUBLE | | | | | |
| DEEP TROUBLE | | liner to leftcenter, TRIPLE | | | | | |
| BLAST | | deep drive to power field, HOME RUN 25' | | | | | |
| !? | | liner under thirdbaseman's glove into left, SINGLE 2A2 CP at third | | | | | |
| SAC BUNT | | SH:3 (tags batter) A1 or foul | | | | | |
| BUNT FOR HIT | | pop to pitcher | | | | | |
| HIT&RUN | | foul | | | | | |
| HIT/ERROR | | grounder to secondbaseman, bad hop CP SINGLE or 4-3 A1 | | | | | |
| FB | | rhb:liner to right (PO 9), 2A, 3A<br>lhb:liner to left (PO 7), 3A | | | | | |
| CHANCES | | runner + | ER(p):on steal, low throw on pickoff attempt, runner safe or no pickoff attempt | AR: | WP * | ER * | * |

FIG. 58

| B5 | 45 | a b c d e f g h i j k l m n o p<br>Check BSR or PSR, on BLAST check park | | | | | |
|---|---|---|---|---|---|---|---|
| ! | | BB | | | | | |
| - | | grounder gloved by shortstop, AR:6-3 DP 3A, 2A, 3A | | | | | |
| ON | | liner to center, SINGLE 2A2 | | | | | |
| TROUBLE | | liner to deep rightcenter, SINGLE A2, PL 8-6 or stretched DOUBLE | | | | | |
| DEEP TROUBLE | | liner to leftcenter, TRIPLE | | | | | |
| BLAST | | deep drive to power field, HOME RUN 25' | | | | | |
| !? | | liner under firstbaseman's glove into right, SINGLE A2 | | | | | |
| SAC BUNT | | rolls past pitcher, SINGLE, CRN:foul | | | | | |
| BUNT FOR HIT | | foul | | | | | |
| HIT&RUN | | foul | | | | | |
| HIT/ERROR | | smash to secondbaseman handcuffs him, SINGLE A1 | | | | | |
| FB | | rhb:fly to right (PO 9), 2A, 3A<br>lhb:fly to left (PO 7), 3A | | | | | |
| CHANCES | | runner + | on steal, AR:lead stealer picked off by catcher | AR: | WP * | ER * | * |

FIG. 59

| B5 | 46 | a b c d e f g h i j k l m n o p<br>Check BSR or PSR, on BLAST check park | | | | | |
|---|---|---|---|---|---|---|---|
| ! | | BB | | | | | |
| - | | bouncer to shortstop, rhb:6 FC and 3A, lhb:3A | | | | | |
| ON | | liner to center, SINGLE 2A2 | | | | | |
| TROUBLE | | liner to deep rightcenter, SINGLE A2, PL 9-6 or stretched DOUBLE | | | | | |
| DEEP TROUBLE | | liner to leftcenter, TRIPLE | | | | | |
| BLAST | | deep drive to power field, HOME RUN 25' | | | | | |
| !? | | grounder to firstbaseman takes bad hop, hits fielder, and bounces into short outfield, SINGLE R1 | | | | | |
| SAC BUNT | | SH:hugs the foul line SINGLE, or foul | | | | | |
| BUNT FOR HIT | | foul | | | | | |
| HIT&RUN | | foul | | | | | |
| HIT/ERROR | | slow grounder to shortstop, SINGLE A1 | | | | | |
| FB | | fly to right, CH(-):SINGLE A2 or caught 2A, 3A | | | | | |
| CHANCES | | runner + | on steal, walk | AR: | WP * | ER * | * |

FIG. 60

| B5 | 47 | a b c d e f g h i j k l m n o p<br>Check BSR or PSR, on BLAST check park | | | | | |
|---|---|---|---|---|---|---|---|
| ! | | BB | | | | | |
| - | | rhb:bouncer in the hole gloved by shortstop, 6-4, R2:CH:hold, 3A<br>lhb:grounder to secondbaseman, AR:SD:4-6-3 DP 3A, 2A, 3A | | | | | |
| ON | | liner to center, SINGLE 2A2 | | | | | |
| TROUBLE | | looper to right, CH(RF*):routine play or DOUBLE SD:A3 | | | | | |
| DEEP TROUBLE | | liner to leftcenter, TRIPLE | | | | | |
| BLAST | | deep drive to power field, HOME RUN 25' | | | | | |
| !? | | grounder to secondbaseman takes bad hop, hits fielder, and bounces into short outfield, SINGLE R1 | | | | | |
| SAC BUNT | | pop to thirdbaseman, SUI:5-6 DP | | | | | |
| BUNT FOR HIT | | pop to pitcher | | | | | |
| HIT&RUN | | foul | | | | | |
| HIT/ERROR | | slow grounder to shortstop, SINGLE A1 | | | | | |
| FB | | fly to shallow rightcenter (PO 9) 2PL 9-5 DP, 3PL 7-2 DP | | | | | |
| CHANCES | | runner + | on steal, pickoff attempt by pitcher MV: | AR: | WP * | ER * | * |

FIG. 61

| B5 | 48 | a b c d e f g h i j k l m n o p<br>Check BSR or PSR, on BLAST check park | | | | | |
|---|---|---|---|---|---|---|---|
| ! | | BB | | | | | |
| - | | rhb:chopper to shortstop, 6-4, R2:CH:hold, 3A<br>lhb:bouncer in the hole gloved by secondbaseman, AR:SD:4-6-3 DP 3A, 2A, 3A | | | | | |
| ON | | liner to center, SINGLE 2A2 | | | | | |
| TROUBLE | | fly to deep right, DOUBLE SD:A3 R1:PLB 9-4-3-5 | | | | | |
| DEEP TROUBLE | | liner to deep center, off the wall, CH(CF*):out or TRIPLE | | | | | |
| BLAST | | deep drive to power field, HOME RUN 25' | | | | | |
| !? | | grounder to shortstop takes bad hop, hits fielder, and bounces into short outfield, SINGLE R1 | | | | | |
| SAC BUNT | | to pitcher 1-4 A1, SUI:misses pitch SFT:FC 3-2 | | | | | |
| BUNT FOR HIT | | called strike | | | | | |
| HIT&RUN | | foul | | | | | |
| HIT/ERROR | | grounder to shortstop, bad hop, CP use – result on this card or if safe, SINGLE A1 | | | | | |
| FB | | fly near rightfield line, 3PL 9-2 DP | | | | | |
| CHANCES | | runner + | on steal, pickoff attempt by pitcher MV: | AR: | WP * | ER * | * |

FIG. 62

| B5 | 49 | a b c d e f g h i j k l m n o p<br>Check BSR or PSR, on BLAST check park | | | | | |
|---|---|---|---|---|---|---|---|
| ! | | BB | | | | | |
| - | | smash half-hopped by shortstop, AR:6-4-3 DP 3A, R2:CH:hold, R3:CH:6-2 or 6-3 A1 | | | | | |
| ON | | liner to center, SINGLE 2A2 | | | | | |
| TROUBLE | | liner to right, CH(RF+*):sliding catch or sliding catch misses, DOUBLE 2GA3 | | | | | |
| DEEP TROUBLE | | fly to deep center, off the wall, DOUBLE A3, PL 8-6-5 or stretched TRIPLE | | | | | |
| BLAST | | deep drive to power field, HOME RUN 25' | | | | | |
| !? | | grounder to thirdbaseman takes bad hop, hits fielder, and bounces into short outfield, SINGLE R1 | | | | | |
| SAC BUNT | | to pitcher 1-4 A1, SUI:foul SFT:FC 5-2 | | | | | |
| BUNT FOR HIT | | called strike | | | | | |
| HIT&RUN | | foul | | | | | |
| HIT/ERROR | | smash to shortstop handcuffs him, SINGLE R2:holds, 3A | | | | | |
| FB | | liner to rightfield, CH( ) or (-):SINGLE A2 or caught, SD:2A, 3A | | | | | |
| CHANCES | | runner + | runner + | CP | WP * | ER * | * |

FIG. 63

| B5 | 50 | a b c d e f g h i j k l m n o p<br>Check BSR or PSR, on BLAST check park | | | | | |
|---|---|---|---|---|---|---|---|
| ! | | BB | | | | | |
| - | | GD:4-6-3 DP 3A, or high bouncer to shortstop, 2A, 3A | | | | | |
| ON | | liner to center, SINGLE 2A2 | | | | | |
| TROUBLE | | liner to rightfield wall, SINGLE A2, PL 9-6 or stretched DOUBLE | | | | | |
| DEEP TROUBLE | | liner to deep center, CH(CF+*):running catch orTRIPLE | | | | | |
| BLAST | | deep drive to power field, HOME RUN 25' | | | | | |
| !? | | liner to outfield, outfielder drops shoestring catch, SINGLE 2GA2 | | | | | |
| SAC BUNT | | pop to firstbaseman, SUI:3-6 DP | | | | | |
| BUNT FOR HIT | | called strike | | | | | |
| HIT&RUN | | foul | | | | | |
| HIT/ERROR | | smash to shortstop handcuffs him, SINGLE SD:A2 | | | | | |
| FB | | GD:1-6(or 4)-3 DP or fly to rightfield, SD:2A, 3A | | | | | |
| CHANCES | | runner + | | CP | WP * | ER * | * |

FIG. 64

| B5 | 51 | a b c d e f g h i j k l m n o p<br>Check BSR or PSR, on BLAST check park | | | | | |
|---|---|---|---|---|---|---|---|
| ! | | BB | | | | | |
| - | | grounder to firstbaseman | | | | | |
| ON | | liner to center, CH:pitcher knocks it down FC 1-6 or SINGLE 2A2 | | | | | |
| TROUBLE | | smash down firstbase line, CH:firstbaseman snares liner (and doubles up runner at second or first) or DOUBLE | | | | | |
| DEEP TROUBLE | | liner to deep center, DOUBLE A3, PL 8-4-5 or stretched TRIPLE | | | | | |
| BLAST | | deep drive to power field, HOME RUN 25', 30HR:power-center 1' | | | | | |
| !? | | grounder to first, firstbaseman tags batter, 2A | | | | | |
| SAC BUNT | | to the mound 1-4 A1, SUI:foul | | | | | |
| BUNT FOR HIT | | SH:toward third CPB, A1, or called strike, CRN:out at first, 5-3, sacrifice? | | | | | |
| HIT&RUN | | foul | | | | | |
| HIT/ERROR | | swinging bunt to thirdbaseman, CP 5-3 A1 or if safe, SINGLE A1 | | | | | |
| FB | | use - result above | | | | | |
| CHANCES | | runner * | out on steal of home | CP | WP * | EB + | * |

FIG. 65

| B6 | 52 | a b c d e f g h i j k l m n o p<br>Check BSR or PSR, on BLAST check park | | | | | |
|---|---|---|---|---|---|---|---|
| ! | | BB | | | | | |
| - | | grounder up the middle gloved by shortstop, AR:SD:6-4-3 DP 3A, SD:2A, 3A | | | | | |
| ON | | liner to center, SINGLE 2PL 8-2 2G2A2 | | | | | |
| TROUBLE | | smash down firstbase line, CH:firstbaseman snares liner (and doubles up runner at second or first) or DOUBLE | | | | | |
| DEEP TROUBLE | | liner to deep center, TRIPLE | | | | | |
| BLAST | | deep drive to power field, HOME RUN 25', 30HR:power-center 1' | | | | | |
| !? | | grounder to first, firstbaseman tags runner, 2A | | | | | |
| SAC BUNT | | to pitcher 1-3 A1, SUI:foul SFT:FC 5-2 | | | | | |
| BUNT FOR HIT | | ball | | | | | |
| HIT&RUN | | foul | | | | | |
| HIT/ERROR | | grounder to thirdbaseman, bad hop SINGLE SD:A2 | | | | | |
| FB | | GD:1-6(or 4)-3 DP or fly to right, SD:3A | | | | | |
| CHANCES | | runner * | out on steal of home | CP | WP * | EB + | * |

FIG. 66

| SG | 53 | a b c d e f g h i j k l m n o p<br>Check BSR or PSR, on BLAST check park | | | | | |
|---|---|---|---|---|---|---|---|
| ! | | SG(batter):ON | | | | | |
| - | | popup to short rightcenter (PO 4) | | | | | |
| ON | | infielder of choice snares line drive (and doubles up lead runner) | | | | | |
| TROUBLE | | smash down rightfield line to corner, CH(1B*):diving stop or DOUBLE SD:A3 | | | | | |
| DEEP TROUBLE | | liner to deep center, or TRIPLE | | | | | |
| BLAST | | deep drive to power field, HOME RUN 25', 30HR:power-center 5' | | | | | |
| !? | | invent play details | | | | | |
| SAC BUNT | | to firstbaseman 3-4 A1, SUI:foul SFT:FC 5-2 | | | | | |
| BUNT FOR HIT | | ball | | | | | |
| HIT&RUN | | foul | | | | | |
| HIT/ERROR | | smash near thirdbaseman who makes diving stop CP 5-3 or if safe, SINGLE A1 | | | | | |
| GB | | GD:6-4-3 DP, 3A, or one-bouncer to the mound, CH( ):take another card, AR:1-6-3 DP, 2A, full:SD(batter):1-2-3 DP | | | | | |
| CHANCES | | runner * | out on steal of home | CP | WP * | EB + | * |

FIG. 67

18

| DB | 54 | a b c d e f g h i j k l m n o p<br>Check BSR or PSR | | | | | |
|---|---|---|---|---|---|---|---|
| ! | | DB(batter):TROUBLE | | | | | |
| - | | rhb:popup near second base (PO 4)<br>lhb:liner to second | | | | | |
| ON | | looper to rightcenter, SINGLE A2 R2:PLB 9-3-6 | | | | | |
| TROUBLE | | looper down rightfield line, CH(1B*):running catch or DOUBLE 2GA3 | | | | | |
| DEEP TROUBLE | | fly to deep center, TRIPLE | | | | | |
| BLAST | | deep drive to power field, HOME RUN 25', 30HR:power-center 5' | | | | | |
| !? | | invent play details | | | | | |
| SAC BUNT | | pop to pitcher, SFT:ball SUI:1-5 DP | | | | | |
| BUNT FOR HIT | | ball | | | | | |
| HIT&RUN | | foul | | | | | |
| HIT/ERROR | | grounder in the hole between first and second handcuffs secondbaseman, CP 4-3 A1 or if safe, SINGLE A1 | | | | | |
| GB | | grounder gloved by pitcher, CH( ):take another card, 1-6-3 DP, R-12:choice of (CP 1-5 FC or all safe) or 1-3, R3:1-2 , full:1-2-3 DP | | | | | |
| CHANCES | | runner * | out on steal of home | CP | WP * | EB + | * |

FIG. 68

| TL | 55 | a b c d e f g h i j k l m n o p<br>Check BSR or PSR, on BLAST check park | | | | | |
|---|---|---|---|---|---|---|---|
| ! | | TL(batter):DEEP TROUBLE, zero triple batter or pitcher: get – result | | | | | |
| - | | GD:6-4-3 DP 3A, or popup between first and second (PO 4) | | | | | |
| ON | | liner to rightcenter, SINGLE 2A2 | | | | | |
| TROUBLE | | smash down rightfield line, CH(1B*):stopped or DOUBLE 2GA3 | | | | | |
| DEEP TROUBLE | | fly to deep center, TRIPLE | | | | | |
| BLAST | | deep drive to power field, HOME RUN 25', 30HR:power-center 10' | | | | | |
| !? | | invent play details | | | | | |
| SAC BUNT | | to first 3-4 A1 SFT:ball SUI:foul | | | | | |
| BUNT FOR HIT | | called strike | | | | | |
| HIT&RUN | | foul | | | | | |
| HIT/ERROR | | hard grounder in the hole between first and second handcuffs secondbaseman, SINGLE A1=98 | | | | | |
| GB | | grounder to pitcher, CH( ):take another card, AR:1-6-3 DP 3Ab , R-12:1-5 FC, full:1-2-3 DP | | | | | |
| CHANCES | | runner * | out on steal of home | CP | WP * | EB + | * |

36

FIG. 69

19

| HR | 56 | a b c d e f g h i j k l m n o p<br>Check BSR or PSR, on BLAST check park | | | | | |
|---|---|---|---|---|---|---|---|
| ! | | HR(batter):BLAST | | | | | |
| - | | rhb:GD:4-6-3 DP 3A, or foul popup in shallow right (PO 4 or 9)<br>lhb:GD:4-6-3 DP 3A, or foul popup in shallow left (PO 6 or 7) | | | | | |
| ON | | liner to rightcenter, SINGLE 2PL 9-2 1A2 PLB 9-3-6 or 9-5-6 | | | | | |
| TROUBLE | | smash down rightfield line, DOUBLE 1PL 9-4-2 PLB 9-4-3-5 | | | | | |
| DEEP TROUBLE | | fly to deep center, TRIPLE | | | | | |
| BLAST | | deep drive to power field, HOME RUN 25', 30HR:power-center 15' | | | | | |
| !? | | fly to left, leftfielder slides and misses catch, SINGLE A2 | | | | | |
| SAC BUNT | | to first AR:lead runner out on FC or 3-4 A1, SUI:foul SFT:FC 5-2 | | | | | |
| BUNT FOR HIT | | called strike | | | | | |
| HIT&RUN | | foul | | | | | |
| HIT/ERROR | | bouncer up the middle fielded by shortstop, SINGLE A1 | | | | | |
| GB | | bouncer to firstbaseman ER/EB:bobble, see Outcome table or 3-6 or 3-1, SD:2A, R3:CH:3-2 or 3-1 A1 | | | | | |
| CHANCES | | runner * | out on steal of home | CP | BK + | EB + | * |

20

FIG. 70

| P1 | 57 | a b c d e f g h i j k l m n o p<br>Check BSR or PSR, on BLAST check park | | | | | |
|---|---|---|---|---|---|---|---|
| ! | | ON | | | | | |
| - | | GD:6-4-3 DP 3A, or high popup between first and second (PO 4) | | | | | |
| ON | | liner to rightcenter, SINGLE 2PL 9-2 | | | | | |
| TROUBLE | | smash down rightfield line, CH(1B+*):diving stop or DOUBLE SD:A3 | | | | | |
| DEEP TROUBLE | | hard liner to deep center, DOUBLE A3, PL 8-4-5 or stretched TRIPLE | | | | | |
| BLAST | | deep drive to power field, HOME RUN 25', 30HR:power-center 20' | | | | | |
| !? | | fly to center, centerfielder slides and misses catch, SINGLE A2 | | | | | |
| SAC BUNT | | in front of plate 2-4 A1 SFT:misses pitch SUI:misses pitch | | | | | |
| BUNT FOR HIT | | called strike | | | | | |
| HIT&RUN | | foul | | | | | |
| HIT/ERROR | | bouncer up the middle fielded by secondbaseman, SINGLE A1 | | | | | |
| GB | | grounder to first base, CH( ):SINGLE A2 or scooped, AR:3-6-3 DP 3A or 3-6, if first is empty or two out PO 3, R2:CH:hold, full:3-2-3 DP | | | | | |
| CHANCES | | runner * | out on steal of home | CP | BK + | EB + | * |

FIG. 71

| P1 | 58 | a b c d e f g h i j k l m n o p<br>Check BSR or PSR, on BLAST check park | | | | | |
|---|---|---|---|---|---|---|---|
| ! | | ON | | | | | |
| - | | rhb:liner to shortstop<br>lhb:high popup on the infield grass (PO 6) | | | | | |
| ON | | hard liner to right, CH(RF*):running catch or SINGLE SD:A2 | | | | | |
| TROUBLE | | smash down leftfield line, SINGLE A2, PL 7-6 or stretched DOUBLE 2GA3 | | | | | |
| DEEP TROUBLE | | hard liner to deep center, TRIPLE | | | | | |
| BLAST | | deep drive to power field, HOME RUN 30', 30HR:power-center 25' | | | | | |
| !? | | fly to right, rightfielder slides and misses catch, SINGLE A2 | | | | | |
| SAC BUNT | | misses bunt attempt for strikeout, SFT:foul | | | | | |
| BUNT FOR HIT | | called strike | | | | | |
| HIT&RUN | | foul | | | | | |
| HIT/ERROR | | grounder up the middle fielded by shortstop CP 6-3 A1 or if safe, SINGLE A1 | | | | | |
| GB | | rhb:hard grounder to thirdbaseman, AR:5-4-3 DP, R-12:5 FC or try for DP, SD:5-3 3A or 5-2<br>lhb:hard grounder scooped by firstbaseman, AR:SD:3-6 or PO 3, 2A, SD:PO 3 3A or 3-2 | | | | | |
| CHANCES | | runner * | ER(p):on steal, high throw on pickoff attempt A1 or no pickoff attempt | CP | BK + | EB + | * |

FIG. 72

| P1 | 59 | a b c d e f g h i j k l m n o p<br>Check BSR or PSR, on BLAST check park | | | | | |
|---|---|---|---|---|---|---|---|
| ! | | ON | | | | | |
| - | | rhb:foul popup near the crowd (PO 2)<br>lhb:popup back of shortstop (PO 6) | | | | | |
| ON | | looper to right, CH(RF+*):running catch or SINGLE SD:A2 | | | | | |
| TROUBLE | | smash down rightfield line, CH(1B+*):stopped or DOUBLE | | | | | |
| DEEP TROUBLE | | hard liner to deep center, TRIPLE | | | | | |
| BLAST | | deep drive to power field, HOME RUN 30', 30HR:power-center 30' | | | | | |
| !? | | strikeout called, offensive manager argues and is ejected | | | | | |
| SAC BUNT | | to thirdbaseman (if playing for runner on second, pitcher fields bunt)<br>AR:lead runner out on FC or 5-4 A1, SUI:foul SFT:FC 1-2 | | | | | |
| BUNT FOR HIT | | ball | | | | | |
| HIT&RUN | | foul | | | | | |
| HIT/ERROR | | grounder up the middle, diving stop by shortstop CP 6-4 or 6-3 or if safe, SINGLE A1 | | | | | |
| GB | | rhb:grounder gloved by thirdbaseman, AR:SD:5-4, R-12:5 FC, R3:5-2<br>lhb:bouncer to firstbaseman PO 3, R3:choice of (CP 3-2 or all safe) or (3-1 A1) | | | | | |
| CHANCES | | runner * | on steal, pickoff attempt by pitcher MV: | CP | BK + | EB + | * |

FIG. 73

| P1 | 60 | a b c d e f g h i j k l m n o p<br>Check BSR or PSR, on BLAST check park | | | | | |
|---|---|---|---|---|---|---|---|
| ! | | ON | | | | | |
| - | | GD:6-4-3 DP 3A, or foul popup near home (PO 2) | | | | | |
| ON | | liner to right, SINGLE 2A2 1PL 9-5 | | | | | |
| TROUBLE | | smash down rightfield line, CH(1B+*):half-hopped on routine play or DOUBLE | | | | | |
| DEEP TROUBLE | | hard liner to deep center, TRIPLE | | | | | |
| BLAST | | deep drive to power field, HOME RUN 30', 30HR:power-center 35' | | | | | |
| !? | | injury, for specifics see Injury table, invent play details | | | | | |
| SAC BUNT | | to thirdbaseman 5-4 A1, SUI:foul SFT:FC 1-2 | | | | | |
| BUNT FOR HIT | | ball | | | | | |
| HIT&RUN | | foul | | | | | |
| HIT/ERROR | | grounder up the middle, diving stop by shortstop, late throw, SINGLE A1 | | | | | |
| GB | | rhb:grounder gloved by thirdbaseman, AR:5-4-3 or 5-3, 2A, SD:3A<br>lhb:hard grounder to firstbaseman, AR:SD:3-6 or PO 3, SD:PO 3 3A or 3-2 | | | | | |
| CHANCES | | runner * | on steal, pickoff attempt by pitcher MV: | CP | BK + | EB + | * |

FIG. 74

| P1 | 61 | a b c d e f g h i j k l m n o p<br>Visitor | | | | | |
|---|---|---|---|---|---|---|---|
| ! | | ON | | | | | |
| – | | GD:4-6-3 DP 3A, or fly to deep left, 3A | | | | | |
| ON | | liner to right, SINGLE A2 R2:PLB 9-3-6 | | | | | |
| TROUBLE | | rhb:smash down thirdbase line,<br>CH(3B*):diving stop or DOUBLE 2GA3<br>lhb:liner to deep left, DOUBLE 2GA3 | | | | | |
| DEEP TROUBLE | | liner to deep center, TRIPLE | | | | | |
| BLAST | | deep drive to power field, HOME RUN 30', 30HR:centerfield 1' | | | | | |
| !? | | injury, for specifics see Injury table, invent play details | | | | | |
| SAC BUNT | | to thirdbaseman 5-3 A1, SUI:foul SFT:FC 1-2 | | | | | |
| BUNT FOR HIT | | ball | | | | | |
| HIT&RUN | | foul | | | | | |
| HIT/ERROR | | ER(lf):misplays DOUBLE or DOUBLE without error, see Outcome table | | | | | |
| GB | | rhb:GD:6-4-3 DP 3A, or grounder to thirdbaseman, AR:5-4-3 or 5-3, 3A<br>lhb:GD:6-4-3 DP 3A, or slow grounder to firstbaseman, 3-1 | | | | | |
| CHANCES | | runner * | on steal, pickoff attempt by pitcher MV: | CP | BK + | EB + | * |

FIG. 75

| P1 | 62 | a b c d e f g h i j k l m n o p<br>Visitor | | | | | |
|---|---|---|---|---|---|---|---|
| ! | | ON | | | | | |
| – | | in advanced game, take another card, fly to leftcenter (PO 7) SD:2A, 3A | | | | | |
| ON | | liner to right, SINGLE 2PL 9-2 1A2 | | | | | |
| TROUBLE | | rhb:smash down thirdbase line,<br>CH(3B*):stopped or DOUBLE 2GA3<br>lhb:liner to deep left, DOUBLE 2GA3 | | | | | |
| DEEP TROUBLE | | liner to deep center, TRIPLE | | | | | |
| BLAST | | deep drive to power field, HOME RUN 30', 30HR:opposite-centerfield 1' | | | | | |
| !? | | if first and second are occupied, triple play, invent play details, otherwise take another card | | | | | |
| SAC BUNT | | invent play details | | | | | |
| BUNT FOR HIT | | ball | | | | | |
| HIT&RUN | | foul | | | | | |
| HIT/ERROR | | ER(lf):misplays DOUBLE or DOUBLE without error, see Outcome table | | | | | |
| GB | | rhb:bouncer to thirdbaseman, AR:5-4-3 or 5-3, R3:CH:5-2<br>lhb:hard grounder to firstbaseman, AR:3-6-3 DP, if first is empty or two out PO 3 | | | | | |
| CHANCES | | runner * | | CP | BK + | EB + | * |

FIG. 76

| P1 | 63 | a b c d e f g h i j k l m n o p<br>Visitor | | | | | |
|---|---|---|---|---|---|---|---|
| ! | | ON | | | | | |
| - | | fly near the leftfield line, SD:2A, 3A | | | | | |
| ON | | liner to right, CH(RF*):routine play or SINGLE 2A2 2GA2 | | | | | |
| TROUBLE | | rhb:smash down thirdbase line, CH(3B*):routine play or DOUBLE 2GA3<br>lhb:fly to deep left, DOUBLE 2GA3 | | | | | |
| DEEP TROUBLE | | liner to deep center, TRIPLE | | | | | |
| BLAST | | deep drive to power field, HOME RUN 30', 30HR:opposite-centerfield 5' | | | | | |
| !? | | if first and second are occupied, triple play, invent play details, otherwise take another card | | | | | |
| SAC BUNT | | toward the mound 1-4 A1, SUI:foul SFT:FC 1-2 | | | | | |
| BUNT FOR HIT | | misses pitch | | | | | |
| HIT&RUN | | batter misses sign, ball, runners try to steal | | | | | |
| HIT/ERROR | | ER(lf):drops fly, see Outcome table, or flyout, no advance | | | | | |
| GB | | rhb:bouncer to thirdbaseman, AR:SD:5-4, CH:hold or 3A<br>lhb:bouncer in the hole to firstbaseman, 3-1 , 2A | | | | | |
| CHANCES | | runner * | | CP | BK + | EB + | * |

FIG. 77

| P1 | 64 | a b c d e f g h i j k l m n o p<br>Visitor | | | | | |
|---|---|---|---|---|---|---|---|
| ! | | ON | | | | | |
| - | | fly to shallow left, 3PL 7-2 DP | | | | | |
| ON | | liner to right, SINGLE 2PL 9-2 1A2 2GA2 | | | | | |
| TROUBLE | | rhb:smash down thirdbase line, CH(3B+*):diving stop or DOUBLE 2GA3<br>lhb:fly to deep left, DOUBLE 2GA3 | | | | | |
| DEEP TROUBLE | | liner to deep center, TRIPLE | | | | | |
| BLAST | | deep drive to power field, HOME RUN 30', 30HR:opposite-centerfield 10' | | | | | |
| !? | | if first and second are occupied, triple play, invent play details, otherwise take another card | | | | | |
| SAC BUNT | | to firstbaseman 3-4 A1, SUI:foul SFT:FC 1-2 | | | | | |
| BUNT FOR HIT | | misses pitch | | | | | |
| HIT&RUN | | batter misses sign, ball, runners try to steal | | | | | |
| HIT/ERROR | | leftfielder misplays SINGLE, see Outcome table | | | | | |
| GB | | rhb:bouncer in the hole to thirdbaseman, AR:5-4-3 DP, R-12:5 FC or try for DP, SD:3A<br>lhb:bouncer to firstbaseman, 3-1, R2:CH:hold | | | | | |
| CHANCES | | runner * | | CP | BK + | EB + | * |

FIG. 78

| P1 | 65 | a b c d e f g h i j k l m n o p | | | | | |
|---|---|---|---|---|---|---|---|
| ! | | ON | | | | | |
| - | | fly to left, CH(-):SINGLE 2A2 2GA2 or caught, 3A | | | | | |
| ON | | liner to right, SINGLE 2PL 9-2 2G2A2 | | | | | |
| TROUBLE | | smash down thirdbase line, CH(3B+*):stopped or DOUBLE | | | | | |
| DEEP TROUBLE | | liner to deep center, TRIPLE | | | | | |
| BLAST | | deep drive to power field, HOME RUN 30', 30HR:opposite-centerfield 15' | | | | | |
| !? | | strikeout called, batter argues and throws bat | | | | | |
| SAC BUNT | | bunt to the mound, lead runner out on FC | | | | | |
| BUNT FOR HIT | | foul | | | | | |
| HIT&RUN | | batter misses sign, called strike, runners try to steal | | | | | |
| HIT/ERROR | | ER(lf):drops fly, see Outcome table or flyout, no advance | | | | | |
| GB | | rhb:grounder to thirdbaseman, AR:5-4-3 DP, SD:5-3 3A or 5-2<br>lhb:bouncer to firstbaseman, AR:SD:3-6 or PO 3, R2:CH:hold | | | | | |
| CHANCES | | runner * | | CP | BK * | EB + | * |

FIG. 79

| P1 | 66 | a b c d e f g h i j k l m n o p | | | | | |
|---|---|---|---|---|---|---|---|
| ! | | ON | | | | | |
| - | | GD:4-6-3 DP 3A, or fly to left, 3A | | | | | |
| ON | | liner to right, SINGLE 2G2A2 SD:A2 | | | | | |
| TROUBLE | | rhb:smash down thirdbase line, CH(3B+*):one-hopped on routine play or DOUBLE<br>lhb:liner to leftfield corner, DOUBLE 2GA3 | | | | | |
| DEEP TROUBLE | | liner to deep center, TRIPLE, ER(cf):mishandles ball, batter scores | | | | | |
| BLAST | | deep drive to power field, HOME RUN 30', 30HR:opposite-centerfield 20' | | | | | |
| !? | | collision, invent play details | | | | | |
| SAC BUNT | | SH:foul or bunt to the mound, lead runner out on FC | | | | | |
| BUNT FOR HIT | | foul | | | | | |
| HIT&RUN | | batter misses sign, called strike, runners try to steal | | | | | |
| HIT/ERROR | | grounder up the middle fielded by secondbaseman, late throw SINGLE A1 | | | | | |
| GB | | rhb:hard grounder gloved by thirdbaseman, AR:5-4-3 DP<br>lhb:hard grounder gloved by firstbaseman, AR:SD:3-6 or 3-1, R2:CH:hold | | | | | |
| CHANCES | | runner * | on steal, walk | CP | BK * | EB + | * |

FIG. 80

| P1 | 67 | a b c d e f g h i j k l m n o p | | | | | |
|---|---|---|---|---|---|---|---|
| ! | | ON | | | | | |
| - | | fly to left, 2PL 7-5 DP, 3PL 7-2 DP | | | | | |
| ON | | liner to right, CH(RF+*):routine play or SINGLE SD:A2 | | | | | |
| TROUBLE | | rhb:smash through third to corner, CH(3B+*): diving stop or DOUBLE A3<br>lhb:liner to leftfield corner, DOUBLE | | | | | |
| DEEP TROUBLE | | liner to deep rightcenter, off the wall, DOUBLE A3, PL 9-6-5 or stretched TRIPLE | | | | | |
| BLAST | | deep drive to power field, HOME RUN 30', 30HR:opposite-centerfield 25' | | | | | |
| !? | | with runner on first, soft liner to secondbaseman who lets it drop, AR:4-6-3 DP, otherwise take another card, secondbaseman playing in:lineout | | | | | |
| SAC BUNT | | pop to pitcher, SFT:to the mound, out at home on FC, SUI:foul | | | | | |
| BUNT FOR HIT | | foul | | | | | |
| HIT&RUN | | batter misses sign, called strike, runners try to steal | | | | | |
| HIT/ERROR | | grounder up the middle, diving stop by secondbaseman CP 4-6 or if safe, SINGLE A1 | | | | | |
| GB | | rhb:hard grounder to thirdbaseman, AR:5-4-3 DP<br>lhb:high bouncer to firstbaseman, 3-1, 2A | | | | | |
| CHANCES | | runner * | on steal, walk | CP | BK * | EB + | * |

FIG. 81

| P1 | 68 | a b c d e f g h i j k l m n o p | | | | | |
|---|---|---|---|---|---|---|---|
| ! | | ON | | | | | |
| - | | liner to left, CH( ) or (-):SINGLE 2A2 2GA2 or caught, 3A | | | | | |
| ON | | smash in the hole to right CH(1B*):diving stop or SINGLE SD:A2 | | | | | |
| TROUBLE | | rhb:smash through third to corner, CH(3B+*):stopped or DOUBLE 2GA3<br>lhb:liner to leftfield corner, DOUBLE | | | | | |
| DEEP TROUBLE | | fly to deep rightcenter, off the wall, CH(CF*):out or TRIPLE | | | | | |
| BLAST | | deep drive to power field, HOME RUN 30', 30HR:opposite field 1' | | | | | |
| !? | | with runner on first, soft liner to shortstop who lets it drop, AR:6-4-3 DP, otherwise take another card, shortstop playing in:lineout | | | | | |
| SAC BUNT | | pop to pitcher SFT:to the mound, out at home on FC, SUI:foul | | | | | |
| BUNT FOR HIT | | foul | | | | | |
| HIT&RUN | | swing and miss, runners try to steal | | | | | |
| HIT/ERROR | | ER(lf):misplays SINGLE or SINGLE without error, for advance see Outcome table | | | | | |
| GB | | grounder to thirdbaseman ER/EB:bobble, see Outcome table or AR:SD:5-4-3 DP, SD:2A, R3:CH:5-2 | | | | | |
| CHANCES | | runner * | | CP | BK * | EB * | * |

FIG. 82

| P1 | 69 | a b c d e f g h i j k l m n o p | | | | | |
|---|---|---|---|---|---|---|---|
| ! | | ON | | | | | |
| - | | grounder to third, AR:5-4 FC, R-12:5 FC, full: 5-1-2 DP | | | | | |
| ON | | bouncer in the hole to right, SINGLE SD:A2 | | | | | |
| TROUBLE | | rhb:smash through third to corner, CH(3B+*):one-hopped on routine play or DOUBLE 2GA3<br>lhb:liner to wall in leftcenter, DOUBLE 2GA3 | | | | | |
| DEEP TROUBLE | | fly to deep rightcenter, off the wall, TRIPLE | | | | | |
| BLAST | | deep drive to power field, HOME RUN 35', 30HR:opposite field 5' | | | | | |
| !? | | groundout, 2A, 3A backing away from pitch, invent play details | | | | | |
| SAC BUNT | | to the mound, lead runner out on FC, SUI:foul | | | | | |
| BUNT FOR HIT | | called strike | | | | | |
| HIT&RUN | | swing and miss, runners try to steal | | | | | |
| HIT/ERROR | | ER(lf):drops fly, see Outcome table, or flyout 3A | | | | | |
| FB | | GD:4-6-3 DP 3A, or popup back of third (PO 5) | | | | | |
| CHANCES | | runner * | | CP | BK * | EB * | * |

FIG. 83

| P1 | 70 | a b c d e f g h i j k l m n o p | | | | | |
|---|---|---|---|---|---|---|---|
| ! | | ON | | | | | |
| - | | GD:5-4-3 DP 3A, or fly to deep center, 2A, 3A | | | | | |
| ON | | grounder in the hole to right CH(1B*):half-hopped on routine play or SINGLE A2 R2:PLB 9-3-6 | | | | | |
| TROUBLE | | rhb:smash through third to corner, DOUBLE<br>lhb:liner to wall in leftcenter, DOUBLE | | | | | |
| DEEP TROUBLE | | fly to deep rightcenter, DOUBLE A3, PL 9-4-5 or stretched TRIPLE | | | | | |
| BLAST | | deep drive to power field, HOME RUN 35', 30HR:opposite field 10' | | | | | |
| !? | | hard grounder to third takes bad hop into left, SINGLE R2 | | | | | |
| SAC BUNT | | SH:to firstbaseman, tags batter or called strike, SUI:misses pitch | | | | | |
| BUNT FOR HIT | | called strike | | | | | |
| HIT&RUN | | swing and miss, runners try to steal | | | | | |
| HIT/ERROR | | ER(cf):misplays DOUBLE or DOUBLE without error, see Outcome table | | | | | |
| GB | | bouncer to thirdbaseman, AR:5-4-3 DP 3A, full:5-2-3 DP | | | | | |
| CHANCES | | runner * | | CP | BK * | EB * | * |

34

FIG. 84

| P2 | 71 | a b c d e f g h i j k l m n o p | | | | | |
|---|---|---|---|---|---|---|---|
| ! | | TROUBLE | | | | | |
| - | | fly to center (PO 8) 2A, 3A | | | | | |
| ON | | grounder in the hole to right, CH(1B+*):diving stop or SINGLE A2 PLB 9-3-5 | | | | | |
| TROUBLE | | rhb:smash through third to corner, DOUBLE<br>lhb:liner to wall in leftcenter, DOUBLE | | | | | |
| DEEP TROUBLE | | fly to deep rightcenter, CH(RF*):running catch orTRIPLE | | | | | |
| BLAST | | deep drive to power field, HOME RUN 35', 30HR:opposite field 15' | | | | | |
| !? | | infielder of choice drops pop fly, see Outcome table. | | | | | |
| SAC BUNT | | pop to pitcher CRN:to the mound, lead runner out on FC,SUI:foul | | | | | |
| BUNT FOR HIT | | called strike | | | | | |
| HIT&RUN | | swing and miss, runners try to steal | | | | | |
| HIT/ERROR | | ER(cf):misplays DOUBLE or DOUBLE without error, see Outcome table | | | | | |
| GB | | hard grounder gloved by secondbaseman, AR:SD(R1):4-6-3 DP 3A, CH:R2:hold, 3A | | | | | |
| CHANCES | | thrower + | out on steal of home | CP | BK * | EB * | * |

FIG. 85

| P2 | 72 | a b c d e f g h i j k l m n o p | | | | | |
|---|---|---|---|---|---|---|---|
| ! | | TROUBLE | | | | | |
| - | | fly to rightcenter (PO 8) 2A, 3A | | | | | |
| ON | | liner in the hole to right, SINGLE 2PL 9-2 2G2A2 | | | | | |
| TROUBLE | | rhb:liner down leftfield line, DOUBLE A3<br>lhb:liner to deep center, DOUBLE A3 | | | | | |
| DEEP TROUBLE | | fly to deep rightcenter, CH(RF+*):running catch orTRIPLE | | | | | |
| BLAST | | deep drive to power field, HOME RUN 35', 30HR:opposite field 20' | | | | | |
| !? | | if player on opposing team was hit by pitch, pitcher warned for retaliation, otherwise pitcher warned for throwing at batter | | | | | |
| SAC BUNT | | called strike, CRN:to the mound, lead runner out on FC,SUI:foul | | | | | |
| BUNT FOR HIT | | called strike | | | | | |
| HIT&RUN | | swing and miss, runners try to steal | | | | | |
| HIT/ERROR | | ER(cf):drops fly, see Outcome table or flyout, no advance | | | | | |
| GB | | grounder to secondbaseman ER/EB:bobble, see Outcome table or AR:4-6-3 DP 3A, CH:R2:hold, 3A | | | | | |
| CHANCES | | thrower + | out on steal of home | CP | BK * | EB * | * |

FIG. 86

| P2 | 73 | a b c d e f g h i j k l m n o p | | | | | |
|---|---|---|---|---|---|---|---|
| ! | | TROUBLE | | | | | |
| - | | fly to leftcenter (PO 8), SD:2A, 3A | | | | | |
| ON | | liner in the hole to left, SINGLE 2PL 7-2 2GA2 | | | | | |
| TROUBLE | | deep fly (lhb:PO8 rhb:PO9), 1PL, 2A, 3A | | | | | |
| DEEP TROUBLE | | fly to deep rightcenter, TRIPLE | | | | | |
| BLAST | | deep drive to power field, HOME RUN 35', 30HR:opposite field 25' | | | | | |
| !? | | if player on opposing team was hit by pitch, pitcher warned for retaliation, otherwise pitcher warned for throwing at batter | | | | | |
| SAC BUNT | | ball, SUI:foul SFT:to the mound, lead runner out on FC | | | | | |
| BUNT FOR HIT | | ball | | | | | |
| HIT&RUN | | swing and miss, runners try to steal | | | | | |
| HIT/ERROR | | ER(cf):drops fly, see Outcome table or flyout, no advance | | | | | |
| GB | | grounder half-hopped by secondbaseman, AR:4-6-3 DP, CH:R2:hold, full:4-2-3 DP | | | | | |
| CHANCES | | thrower + | out on steal of home | CP | BK * | EB * | * |

FIG. 87

| P2 | 74 | a b c d e f g h i j k l m n o p | | | | | |
|---|---|---|---|---|---|---|---|
| ! | | BLAST, low HR batter: get – result | | | | | |
| - | | fly to center, SD:2A, 3A | | | | | |
| ON | | liner in the hole to right, CH(2B+*):one-hopped on routine play or SINGLE 2G2A2 SD:A2 | | | | | |
| TROUBLE | | rhb:liner down leftfield line, DOUBLE 2GA3<br>lhb:liner to deep center, DOUBLE 2GA3 | | | | | |
| DEEP TROUBLE | | fly to deep rightcenter, TRIPLE | | | | | |
| BLAST | | deep drive to power field, HOME RUN 35', 10HR:power-center 1' | | | | | |
| !? | | grounder to infielder of choice, second base not covered, out at first A1, if playing in:ground ball, contact misplay, invent play details, if first base is empty take another card | | | | | |
| SAC BUNT | | ball if runner on first only or on suicide, otherwise, FC nabs lead runner (2-5 or 1-2), SUI:foul | | | | | |
| BUNT FOR HIT | | ball | | | | | |
| HIT&RUN | | swing and miss, runners try to steal | | | | | |
| HIT/ERROR | | ER(cf):drops fly, see Outcome table, or flyout 2A, 3A | | | | | |
| GB | | rhb:bouncer in the hole gloved by shortstop, AR:SD:6-4, R2:CH:hold, 3A<br>lhb:grounder to secondbaseman, AR:SD:4-6-3 DP, 2A, 3A | | | | | |
| CHANCES | | thrower + | out on steal of home | SD: | BK * | EB * | * |

53
54
55
56
57
58

FIG. 88

21 22

| P2 | 75 | a b c d e f g h i j k l m n o p | | | | | |
|---|---|---|---|---|---|---|---|
| ! | | BLAST, low HR batter: get – result | | | | | |
| - | | fly to center, 3PL 8-2 DP | | | | | |
| ON | | liner in the hole to right, CH(2B*):diving stop or SINGLE SD:A2 | | | | | |
| TROUBLE | | rhb:liner down leftfield line, DOUBLE 2GA3<br>lhb:liner to deep rightcenter, DOUBLE 2GA3 | | | | | |
| DEEP TROUBLE | | fly to deep rightcenter, TRIPLE | | | | | |
| BLAST | | deep drive to power field, HOME RUN 35', 10HR:center CH:leaping catch at wall or 1' | | | | | |
| !? | | runner picked off first or second, SD:runner steals on pickoff attempt, if bases are empty take another card | | | | | |
| SAC BUNT | | misses pitch if runner on first only or suicide, otherwise SH:misses pitch or FC nabs lead runner (2-5 or 1-2) | | | | | |
| BUNT FOR HIT | | ball | | | | | |
| HIT&RUN | | swing and miss, runners try to steal | | | | | |
| HIT/ERROR | | ER(lf):bad throw or throws runner out, see Outcome table | | | | | |
| GB | | rhb:slow grounder to shortstop, CH:6 FC, 2A, 3A<br>lhb:smash to secondbaseman, AR:4-3 DP 3A | | | | | |
| CHANCES | | thrower + | ER(p):on steal, wide throw on pickoff attempt, runner safe or no pickoff attempt | SD: | BK * | EB * | * |

43

FIG. 89

| HP | 76 | | | | | | |
|---|---|---|---|---|---|---|---|
| ! | | HP:hit-by-pitch | | | | | |
| - | | fly to center, 3A | | | | | |
| ON | | liner by firstbaseman into right, CH(1B+*):stopped or SINGLE A2 | | | | | |
| TROUBLE | | rhb:liner down leftfield line, DOUBLE 2GA3<br>lhb:liner to deep rightcenter, DOUBLE 2GA3 | | | | | |
| DEEP TROUBLE | | liner to deep rightcenter, DOUBLE A3, PL 9-6-5 or stretched TRIPLE | | | | | |
| BLAST | | deep drive to power field, HOME RUN 40', 10HR:center 1' | | | | | |
| !? | | bat breaks in half, invent play details | | | | | |
| SAC BUNT | | foul if runner on first only or suicide, otherwise SH:foul or FC nabs lead runner (2-5 or 1-2) | | | | | |
| BUNT FOR HIT | | ball | | | | | |
| HIT&RUN | | swing and miss, runners try to steal | | | | | |
| HIT/ERROR | | ER(cf):bad throw or throws runner out, see Outcome table | | | | | |
| GB | | rhb:chopper to shortstop, AR:6-4-3 DP 3A, 3A<br>lhb:chopper to secondbaseman, CH:4 FC, 2A, 3A | | | | | |
| CHANCES | | thrower + | on steal, pickoff attempt by pitcher MV: | SD: | BK * | EB * | * |

59

FIG. 90

| P3 | 77 | a b c d e f g h i j k l m n o p | | | | | |
|---|---|---|---|---|---|---|---|
| ! | | SO called | | | | | |
| - | | fly to center, 2PL 8-5 DP, 3PL 8-2 DP | | | | | |
| ON | | rhb:smash in the hole to left, SINGLE SD:A2<br>lhb:smash up the middle, SINGLE SD:A2 | | | | | |
| TROUBLE | | rhb:liner down leftfield line, DOUBLE 2GA3<br>lhb:liner to deep rightcenter, DOUBLE 2GA3 | | | | | |
| DEEP TROUBLE | | liner to deep rightcenter, TRIPLE | | | | | |
| BLAST | | deep drive to power field, HOME RUN 40', 10HR:center 5' | | | | | |
| !? | | fielders asleep, runner from second or first tries to advance, CP | | | | | |
| SAC BUNT | | foul if runner on first only or suicide, otherwise ball CRN:FC nabs lead runner (2-5 or 1-2) | | | | | |
| BUNT FOR HIT | | misses pitch | | | | | |
| HIT&RUN | | swing and miss, runners try to steal | | | | | |
| HIT/ERROR | | ER(rf):bad throw or throws runner out, see Outcome table | | | | | |
| GB | | grounder to secondbaseman, AR:4-6-3 DP 3A, 2A, 3A | | | | | |
| CHANCES | | thrower + | on steal, pickoff attempt by pitcher MV: | SD: | BK * | EB * | * |

FIG. 91

| P3 | 78 | a b c d e f g h i j k l m n o p | | | | | |
|---|---|---|---|---|---|---|---|
| ! | | SO swinging | | | | | |
| - | | liner to center, CH( ):SINGLE A2 or caught, 3A | | | | | |
| ON | | rhb:grounder in the hole to left, SINGLE A2<br>lhb:grounder up the middle, SINGLE A2 | | | | | |
| TROUBLE | | rhb:liner down leftfield line, DOUBLE 2GA3<br>lhb:liner to rightcenter, DOUBLE | | | | | |
| DEEP TROUBLE | | liner to deep rightcenter, TRIPLE | | | | | |
| BLAST | | deep drive to power field, HOME RUN 40', 10HR:center 5' | | | | | |
| !? | | argument and ejection, invent play details, see Ejection table | | | | | |
| SAC BUNT | | ball, SUI:foul SFT:FC nabs lead runner (2-5 or 1-2) | | | | | |
| BUNT FOR HIT | | misses pitch | | | | | |
| HIT&RUN | | swing and miss, runners try to steal | | | | | |
| HIT/ERROR | | ER(cf):misplays SINGLE or SINGLE without error, see Outcome table | | | | | |
| GB | | grounder up the middle gloved by secondbaseman, AR:SD:4-6-3 DP 3A, 2A | | | | | |
| CHANCES | | thrower + | on steal, pickoff attempt by pitcher MV: | SD: | BK * | EB * | * |

FIG. 92

| P3 | 79 | a b c d e f g h i j k l m n o p | | | | | |
|---|---|---|---|---|---|---|---|
| ! | | SO swinging | | | | | |
| - | | GD:5-4-3 DP 3A, or fly to shallow center (PO 8), SD:3A | | | | | |
| ON | | rhb:grounder in the hole to left, SINGLE 2A2<br>lhb:grounder up the middle, SINGLE 2A2 | | | | | |
| TROUBLE | | rhb:liner down leftfield line, DOUBLE<br>lhb:liner to rightfield wall, DOUBLE 2GA3 | | | | | |
| DEEP TROUBLE | | liner to deep rightcenter, TRIPLE | | | | | |
| BLAST | | deep drive to power field, HOME RUN 45', 10HR:center 10' | | | | | |
| !? | | argument, invent play details | | | | | |
| SAC BUNT | | called strike, SUI:foul SFT:FC nabs lead runner (1-2) | | | | | |
| BUNT FOR HIT | | misses pitch | | | | | |
| HIT&RUN | | swing and miss, runners try to steal | | | | | |
| HIT/ERROR | | centerfielder misplays SINGLE, see Outcome table | | | | | |
| GB | | hard grounder to third base, CH( ):SINGLE 2GA2 or gloved AR:SD:5-4-3 DP, R-12:5 FC, SD:2A, R3:CH:hold | | | | | |
| CHANCES | | thrower/ relay man + | on steal, strikeout DP | SD: | BK * | EB * | * |

FIG. 93

| P3 | 80 | a b c d e f g h i j k l m n o p | | | | | |
|---|---|---|---|---|---|---|---|
| ! | | SO called | | | | | |
| - | | liner to center, SD:3A, R1:AR(P)1-6-3 DP | | | | | |
| ON | | rhb:grounder in the hole to left, SINGLE 2A2<br>lhb:grounder up the middle, SINGLE 2A2 | | | | | |
| TROUBLE | | rhb:liner down leftfield line, DOUBLE<br>lhb:fly to deep rightfield wall, DOUBLE 2GA3 | | | | | |
| DEEP TROUBLE | | liner to deep rightcenter, TRIPLE | | | | | |
| BLAST | | deep drive to power field, HOME RUN 45', 10HR:center 15' | | | | | |
| !? | | argument, invent play details | | | | | |
| SAC BUNT | | 1-6-3 DP, SUI:FC 1-2, SFT:FC 1-2 | | | | | |
| BUNT FOR HIT | | misses pitch | | | | | |
| HIT&RUN | | swing and miss, runners try to steal | | | | | |
| HIT/ERROR | | ER(cf):misplays SINGLE or SINGLE without error, see Outcome table | | | | | |
| GB | | chopper to secondbaseman, 4-6-3 DP 3A, SD:2A, R3:CH:4-2 or 4-3 A1 | | | | | |
| CHANCES | | thrower/ relay man + | on steal, strikeout, DP? | SD: | BK * | EB * | * |

FIG. 94

23

| P3 | 81 | a b c d e f g h i j k l m n o p | | | | | |
|---|---|---|---|---|---|---|---|
| ! | | SO called | | | | | |
| - | | liner to center (PO 8), 3A | | | | | |
| ON | | rhb:liner to left, SINGLE 2GA2<br>lhb:liner up the middle, SINGLE 2A2 | | | | | |
| TROUBLE | | rhb:liner down leftfield line, DOUBLE<br>lhb:fly to deep rightfield wall, DOUBLE 2GA3 | | | | | |
| DEEP TROUBLE | | liner to deep rightcenter, TRIPLE | | | | | |
| BLAST | | deep drive to power field, HOME RUN 45', 10HR:center 20' | | | | | |
| !? | | argument, invent play details | | | | | |
| SAC BUNT | | play for lead runner fails, all runners safe on FC, SFT:FC 1-2 | | | | | |
| BUNT FOR HIT | | foul | | | | | |
| HIT&RUN | | swing and miss, runners try to steal | | | | | |
| HIT/ERROR | | grounder up the middle pursued by shortstop, bad hop, SINGLE<br>R2:holds, 3A | | | | | |
| GB | | GD:6-4-3 DP, 3A, or slow grounder to secondbaseman, 2A, 3A | | | | | |
| CHANCES | | thrower/ relay man * | out on steal of home | SD: | BK * | EB * | * |

FIG. 95

| P3 | 82 | a b c d e f g h i j k l m n o p | | | | | |
|---|---|---|---|---|---|---|---|
| ! | | SO swinging | | | | | |
| - | | rhb:fly to right (PO 9), 2A, 3A<br>lhb:fly to shallow center | | | | | |
| ON | | rhb:liner to left, SINGLE 2A2<br>lhb:liner up the middle, SINGLE 2A2 | | | | | |
| TROUBLE | | rhb:fly to deep wall in leftcenter, DOUBLE 2GA2<br>lhb:fly to deep wall in rightcenter, DOUBLE | | | | | |
| DEEP TROUBLE | | liner to deep rightcenter, TRIPLE | | | | | |
| BLAST | | deep drive to power field, HOME RUN 50', 10HR:center 25' | | | | | |
| !? | | argument and ejection, invent play details, see Ejection table, | | | | | |
| SAC BUNT | | play for lead runner fails, all runners safe on FC, SFT:FC 1-2 | | | | | |
| BUNT FOR HIT | | foul | | | | | |
| HIT&RUN | | swing and miss, runners try to steal | | | | | |
| HIT/ERROR | | ER(rf):drops fly, see Outcome table or flyout, no advance | | | | | |
| GB | | use - result above | | | | | |
| CHANCES | | thrower/ relay man * | out on steal of home | SD: | BK * | EB * | * |

FIG. 96

| P3 | 83 | a b c d e f g h i j k l m n o p | | | | | |
|---|---|---|---|---|---|---|---|
| ! | | SO swinging | | | | | |
| - | | rhb:flo to right (PO 9), 3A<br>lhb:fly to left, 3A | | | | | |
| ON | | rhb:liner to left, SINGLE 2G2A2<br>lhb:liner up the middle, SINGLE 2A2 | | | | | |
| TROUBLE | | rhb:fly to deep leftcenter, DOUBLE A3<br>lhb:liner to rightfield wall, DOUBLE | | | | | |
| DEEP TROUBLE | | hard liner to rightcenter, DOUBLE A3, PL 9-6-5 or stretched TRIPLE | | | | | |
| BLAST | | deep drive to power field, HOME RUN 50', 10HR:center (for distance, take another card) | | | | | |
| !? | | third strike swinging, catcher holds foul tip | | | | | |
| SAC BUNT | | play for lead runner fails, all runners safe on FC | | | | | |
| BUNT FOR HIT | | called strike | | | | | |
| HIT&RUN | | swing and miss, runners try to steal | | | | | |
| HIT/ERROR | | ER(lf):misplays SINGLE or SINGLE without error, see Outcome table | | | | | |
| GB | | grounder to secondbaseman CH( ):SINGLE 2GA2 or gloved SD:2A, 3A | | | | | |
| CHANCES | | thrower/ relay man * | out on steal of home | SD: | BK * | EB * | * |

FIG. 97

| P3 | 84 | a b c d e f g h i j k l m n o p | | | | | |
|---|---|---|---|---|---|---|---|
| ! | | SO called | | | | | |
| - | | rhb:liner to right (PO 9), 2A, 3A<br>lhb:liner to left (PO 7), 3A | | | | | |
| ON | | rhb:liner to left, SINGLE 2G2A2 SD:A2<br>lhb:liner up the middle, SINGLE SD:A2 | | | | | |
| TROUBLE | | rhb:fly to deep leftcenter, DOUBLE 2GA3<br>lhb:liner to rightfield wall, DOUBLE | | | | | |
| DEEP TROUBLE | | hard liner to rightcenter, TRIPLE | | | | | |
| BLAST | | deep drive to power field, HOME RUN 50', 10HR:opposite-centerfield CH:leaping catch at wall or 1' | | | | | |
| !? | | strikeout swinging on low pitch, A1 BA1, wild pitch | | | | | |
| SAC BUNT | | SH:pop to pitcher or FC nabs lead runner (2-5 or 1-2), SUI:foul | | | | | |
| BUNT FOR HIT | | called strike | | | | | |
| HIT&RUN | | swing and miss, runners try to steal | | | | | |
| HIT/ERROR | | grounder up the middle pursued by secondbaseman, bad hop, SINGLE A1 | | | | | |
| GB | | hard grounder gloved by shortstop, 6-4-3 DP 3A, R2:choice of (CP 6-5 or all safe OR 6-3 | | | | | |
| CHANCES | | thrower/ relay man * | out on steal of home | SD: | PB +, SD for advance | EB * | * |

FIG. 98

| P3 | 85 | a b c d e f g h i j k l m n o p | | | | | |
|---|---|---|---|---|---|---|---|
| ! | | SO swinging | | | | | |
| - | | rhb:fly to right (PO 9), 2A, 3A<br>lhb:fly to left (PO 7), 3A | | | | | |
| ON | | rhb:grounder in the hole to left, SINGLE 2A2<br>lhb:liner to rightcenter, SINGLE A2 | | | | | |
| TROUBLE | | rhb:liner to deep leftcenter, DOUBLE<br>lhb:smash through first, DOUBLE 2GA3 | | | | | |
| DEEP TROUBLE | | hard liner to rightcenter, TRIPLE | | | | | |
| BLAST | | deep drive, invent direction and distance HOME RUN, 10HR:opposite-centerfield 5' | | | | | |
| !? | | strikeout called, ball glances off catcher's glove, A1 BA1, passed ball | | | | | |
| SAC BUNT | | pop to pitcher CRN:FC nabs lead runner (2-5 or 1-2), SUI:misses pitch | | | | | |
| BUNT FOR HIT | | ball | | | | | |
| HIT&RUN | | – result | | | | | |
| HIT/ERROR | | bouncer in the hole at short fielded by thirdbaseman, SINGLE A1 | | | | | |
| GB | | grounder to shortstop ER/EB:bobble, see Outcome table or 6-4-3 DP 3A | | | | | |
| CHANCES | | thrower * | out on steal of home | SD: | PB + | EB * | * |

FIG. 99

| P3 | 86 | a b c d e f g h i j k l m n o p | | | | | |
|---|---|---|---|---|---|---|---|
| ! | | SO swinging | | | | | |
| - | | fly to right, CH(-):SINGLE A2 or caught 2A, 3A | | | | | |
| ON | | rhb:liner in the hole to left, SINGLE 2A2<br>lhb:liner to rightcenter, SINGLE 2A2 2GA2 | | | | | |
| TROUBLE | | rhb:liner to deep leftcenter, DOUBLE<br>lhb:smash through first and down the line, DOUBLE 2GA3 | | | | | |
| DEEP TROUBLE | | hard liner to rightcenter, TRIPLE | | | | | |
| BLAST | | deep drive to power field, HOME RUN 55', 10HR:opposite-centerfield (for distance, take another card) | | | | | |
| !? | | strikeout called, catcher drops ball, tags batter | | | | | |
| SAC BUNT | | toward mound ER(p):batter safe on bobble or 1-4 A1, SFT:FC 1-2 | | | | | |
| BUNT FOR HIT | | ball | | | | | |
| HIT&RUN | | – result | | | | | |
| HIT/ERROR | | ER(rf):misplays DOUBLE or DOUBLE without error, see Outcome table | | | | | |
| GB | | grounder gloved by shortstop, AR:SD:6-4-3 DP 3A, full:6-2-3 DP | | | | | |
| CHANCES | | thrower * | out on steal of home | SD: | PB + | EB * | * |

FIG. 100

| P3 | 87 | a b c d e f g h i j k l m n o p | | | | | |
|---|---|---|---|---|---|---|---|
| ! | | SO swinging | | | | | |
| - | | fly to shallow rightcenter (PO 9) 2PL 9-5 DP, 3PL 9-2 DP | | | | | |
| ON | | rhb:liner to left, SINGLE A2<br>lhb:liner to rightcenter, SINGLE 2A2 | | | | | |
| TROUBLE | | rhb:liner to wall in rightcenter, DOUBLE 2GA3<br>lhb:smash through first and down the line, DOUBLE 2GA3 | | | | | |
| DEEP TROUBLE | | hard liner to rightcenter, TRIPLE | | | | | |
| BLAST | | deep drive to power field, HOME RUN 60+', 10HR:opposite field CH:leaping catch at wall or 1' | | | | | |
| !? | | strikeout swinging at ball in dirt, catcher tags batter | | | | | |
| SAC BUNT | | toward mound ER(p):batter safe on bobble or 1-4 A1, SFT:FC 1-2 | | | | | |
| BUNT FOR HIT | | misses pitch | | | | | |
| HIT&RUN | | – result | | | | | |
| HIT/ERROR | | ER(rf):misplays DOUBLE or DOUBLE without error, see Outcome table | | | | | |
| GB | | rhb:chopper to shortstop, AR:6-4-3 DP 3A, 3A<br>lhb:smash to secondbaseman, AR:4-6-3 DP 3A | | | | | |
| CHANCES | | thrower * | out on steal of home | SD: | PB + | EB * | * |

FIG. 101

| P3 | 88 | a b c d e f g h i j k l m n o p | | | | | |
|---|---|---|---|---|---|---|---|
| ! | | SO swinging | | | | | |
| - | | fly near rightfield line, 3PL 9-2 DP | | | | | |
| ON | | rhb:liner to left, SINGLE A2<br>lhb:liner to rightcenter, SINGLE 2G2A2 | | | | | |
| TROUBLE | | rhb:liner one-bounces to rightfield corner, DOUBLE A3<br>lhb:smash through first and down the line, DOUBLE | | | | | |
| DEEP TROUBLE | | hard liner to rightcenter, TRIPLE | | | | | |
| BLAST | | deep drive to power field, HOME RUN 60+', 10HR:opposite field (for distance, take another card) | | | | | |
| !? | | strikeout called, catcher drops ball, tags batter | | | | | |
| SAC BUNT | | toward mound ER(p):throwing misplay, see Outcome table, or 1-4 A1, SFT:FC 1-2 | | | | | |
| BUNT FOR HIT | | misses pitch | | | | | |
| HIT&RUN | | – result | | | | | |
| HIT/ERROR | | ER(rf):drops fly, see Outcome table or flyout, no advance | | | | | |
| GB | | rhb:hopper to shortstop, AR:6-4-3 DP 3A, 3A<br>lhb:chopper to secondbaseman, CH:4 FC, 2A, 3A | | | | | |
| CHANCES | | thrower * | out on steal of home | SD: | PB + | EB * | * |

FIG. 102

| P3 | 89 | a b c d e f g h i j k l m n o p | | | | | |
|---|---|---|---|---|---|---|---|
| ! | | SO swinging | | | | | |
| - | | liner to rightfield, CH( ) or (-):SINGLE A2 or caught, SD:2A, 3A | | | | | |
| ON | | rhb:liner to left, SINGLE 2A2<br>lhb:liner to right, SINGLE A2 | | | | | |
| TROUBLE | | rhb:liner rolls to rightfield corner, DOUBLE 2GA3<br>lhb:smash through first and down the line, DOUBLE | | | | | |
| DEEP TROUBLE | | hard liner to rightcenter, TRIPLE | | | | | |
| BLAST | | deep drive to power-centerfield, HOME RUN 1' | | | | | |
| !? | | strikeout called, catcher drops ball, tags batter | | | | | |
| SAC BUNT | | toward mound ER(p):batter safe on bobble or 1-3 A1, SFT:FC 1-2 | | | | | |
| BUNT FOR HIT | | foul | | | | | |
| HIT&RUN | | – result | | | | | |
| HIT/ERROR | | ER(rf):drops fly, see Outcome table, or flyout 2A, 3A | | | | | |
| GB | | hard grounder near shortstop, CH( ):SINGLE 2G2A2 or gloved SD:2A, 3A | | | | | |
| CHANCES | | thrower * | ER(p):on steal, low throw on pickoff attempt, runner safe or no pickoff attempt | SD: | PB + | EB * | * |

40

FIG. 103

| P4 | 90 | a b c d e f g h i j k l m n o p | | | | | |
|---|---|---|---|---|---|---|---|
| ! | | SO swinging | | | | | |
| - | | GD:1-6(or 4)-3 DP or fly to rightfield, SD:2A, 3A | | | | | |
| ON | | rhb:liner to left, SINGLE 2A2<br>lhb:liner to right, SINGLE A2 | | | | | |
| TROUBLE | | rhb:looper to right, DOUBLE 2GA3<br>lhb:smash through first and down the line, DOUBLE | | | | | |
| DEEP TROUBLE | | liner to rightcenter, TRIPLE | | | | | |
| BLAST | | deep drive to power-centerfield, HOME RUN 1' | | | | | |
| !? | | strikeout swinging, catcher drops ball, tags batter | | | | | |
| SAC BUNT | | play for lead runner ER(p):all safe on bad throw or 1-4 A1, SFT:FC 1-2 | | | | | |
| BUNT FOR HIT | | foul | | | | | |
| HIT&RUN | | – result | | | | | |
| HIT/ERROR | | ER(rf):misplays SINGLE or SINGLE without error see Outcome table | | | | | |
| GB | | grounder gloved by shortstop, AR:6-3 DP 3A, 2A, 3A | | | | | |
| CHANCES | | thrower * | on steal, ER(baseman): drops ball | SD: | PB *, SD: advance 2 or 1 | EB * | * |

FIG. 104

| P4 | 91 | a b c d e f g h i j k l m n o p | | | | | |
|---|---|---|---|---|---|---|---|
| ! | | BB | | | | | |
| – | | in advanced game, take another card, liner to right, SD:3A | | | | | |
| ON | | rhb:liner to left, SINGLE 2A2<br>lhb:liner to right, SINGLE A2 | | | | | |
| TROUBLE | | rhb:liner rolls to rightfield corner, DOUBLE 2GA3<br>lhb:smash down firstbase line, DOUBLE A3 | | | | | |
| DEEP TROUBLE | | liner to rightcenter, TRIPLE | | | | | |
| BLAST | | deep drive to power-centerfield, HOME RUN 5' | | | | | |
| !? | | strikeout swinging on pitch in dirt, catcher throws batter out | | | | | |
| SAC BUNT | | play for lead runner ER(p):all safe on bad throw or lead runner out on FC | | | | | |
| BUNT FOR HIT | | called strike | | | | | |
| HIT&RUN | | – result | | | | | |
| HIT/ERROR | | righfielder misplays SINGLE, see Outcome table | | | | | |
| GB | | bouncer to shortstop, rhb:6 FC and 3A, lhb:3A | | | | | |
| CHANCES | | thrower * | on steal, pickoff att by pitcher MV: | SD: | PB *, SD for advance | EB * | * |

FIG. 105

| P4 | 92 | a b c d e f g h i j k l m n o p | | | | | |
|---|---|---|---|---|---|---|---|
| ! | | BB | | | | | |
| – | | GD:1-6(or 4)-3 DP or fly to right, SD:3A | | | | | |
| ON | | rhb:liner to left, SINGLE 2A2<br>lhb:liner to right, SINGLE A2 | | | | | |
| TROUBLE | | rhb:liner to rightfield corner, DOUBLE 2GA3<br>lhb:smash down firstbase line, DOUBLE A3 | | | | | |
| DEEP TROUBLE | | liner to rightcenter, TRIPLE | | | | | |
| BLAST | | deep drive to power-centerfield, HOME RUN 5' | | | | | |
| !? | | strikeout called, catcher drops ball, throws batter out | | | | | |
| SAC BUNT | | near plate ER(c):throwing misplay, see Outcome table, or 2-4 A1 | | | | | |
| BUNT FOR HIT | | called strike | | | | | |
| HIT&RUN | | – result | | | | | |
| HIT/ERROR | | ER(rf):misplays SINGLE or SINGLE without error, see Outcome table | | | | | |
| GB | | rhb:bouncer in the hole gloved by shortstop, 6-4, R2:CH:hold, 3A<br>lhb:grounder to secondbaseman, AR:SD:4-6-3 DP 3A, 2A, 3A | | | | | |
| CHANCES | | thrower * | on steal, pickoff attempt by pitcher MV: | SD: | PB * | EB * | * |

FIG. 106

| P4 | 93 | a b c d e f g h i j k l m n o p | | | | | |
|---|---|---|---|---|---|---|---|
| ! | | BB | | | | | |
| – | | !? result | | | | | |
| ON | | rhb:liner to left, SINGLE 2A2<br>lhb:liner to right, SINGLE A2 | | | | | |
| TROUBLE | | rhb:liner rolls to rightfield corner, DOUBLE 2GA3<br>lhb:smash down firstbase line, DOUBLE 2GA3 | | | | | |
| DEEP TROUBLE | | liner to rightcenter, TRIPLE | | | | | |
| BLAST | | deep drive to power-centerfield, HOME RUN 10' | | | | | |
| !? | | strikeout called, catcher drops ball, throws batter out | | | | | |
| SAC BUNT | | play for lead runner ER(c):all safe on bad throw or 2-4 A1, SUI:misses pitch | | | | | |
| BUNT FOR HIT | | called strike | | | | | |
| HIT&RUN | | – result | | | | | |
| HIT/ERROR | | grounder in the hole at shortstop fielded by thirdbaseman, late throw, SINGLE A1 | | | | | |
| GB/FB | | !? result | | | | | |
| CHANCES | | thrower * | on steal, pickoff attempt by pitcher MV: | SD: | PB * | EB * | * |

FIG. 107

| P4 | 94 | a b c d e f g h i j k l m n o p | | | | | |
|---|---|---|---|---|---|---|---|
| ! | | BB | | | | | |
| – | | !? result | | | | | |
| ON | | rhb:liner to left, SINGLE 2A2<br>lhb:liner to right, SINGLE 2A2 | | | | | |
| TROUBLE | | fly (lhb:PO7 rhb:PO8) 1PL, 2A, 3A | | | | | |
| DEEP TROUBLE | | liner to rightcenter, TRIPLE | | | | | |
| BLAST | | deep drive to power-centerfield, HOME RUN 15' | | | | | |
| !? | | catcher picks off lead runner, if bases are empty—strikeout swinging, catcher drops ball, throws batter out | | | | | |
| SAC BUNT | | near plate ER(c):batter safe on bobble or lead runner out on FC | | | | | |
| BUNT FOR HIT | | called strike | | | | | |
| HIT&RUN | | – result | | | | | |
| HIT/ERROR | | grounder in the hole at shortstop who makes diving stop CP 6-4 or if safe, SINGLE A1 | | | | | |
| GB/FB | | !? result | | | | | |
| CHANCES | | thrower * | on steal, pickoff attempt by pitcher MV: | SD: | PB * | EB * | * |

FIG. 108

24

| P4 | 95 | a b c d e f g h i j k l m n o p | | | | | |
|---|---|---|---|---|---|---|---|
| ! | | BB | | | | | |
| – | | !? result | | | | | |
| ON | | rhb:liner to left, SINGLE 2A2<br>lhb:grounder in the hole to right, SINGLE A2 | | | | | |
| TROUBLE | | rhb:liner rolls to rightfield corner, DOUBLE<br>lhb:smash down firstbase line, DOUBLE 2GA3 | | | | | |
| DEEP TROUBLE | | liner to rightcenter, TRIPLE | | | | | |
| BLAST | | deep drive to power-centerfield, HOME RUN 20' | | | | | |
| !? | | strikeout called, catcher drops ball, throws batter out | | | | | |
| SAC BUNT | | HB:hit-by-pitch or ball SUI:misses pitch | | | | | |
| BUNT FOR HIT | | HB:hit-by-pitch or ball | | | | | |
| HIT&RUN | | – result | | | | | |
| HIT/ERROR | | grounder in the hole at shortstop, bad hop, SINGLE A1 | | | | | |
| GB/FB | | !? result | | | | | |
| CHANCES | | thrower * | on steal, pickoff attempt by pitcher MV: | SD: | PB * | EB * | * |

50

FIG. 109

| P4 | 96 | a b c d e f g h i j k l m n o p | | | | | |
|---|---|---|---|---|---|---|---|
| ! | | BB | | | | | |
| – | | !? result | | | | | |
| ON | | rhb:liner to left, SINGLE<br>lhb:liner in the hole to right, SINGLE A2 | | | | | |
| TROUBLE | | rhb:liner rolls to rightfield corner, DOUBLE<br>lhb:smash down firstbase line, DOUBLE | | | | | |
| DEEP TROUBLE | | liner to rightcenter, TRIPLE | | | | | |
| BLAST | | deep drive to power-centerfield, HOME RUN 25' | | | | | |
| !? | | third strike swinging, catcher holds foul tip | | | | | |
| SAC BUNT | | check WP, BK, or PB rating, otherwise ball SUI:misses pitch | | | | | |
| BUNT FOR HIT | | check WP, BK, or PB rating,otherwise ball | | | | | |
| HIT&RUN | | – result | | | | | |
| HIT/ERROR | | hard grounder in the hole between first and second handcuffs shortstop, SINGLE A1 | | | | | |
| GB/FB | | !? result | | | | | |
| CHANCES | | thrower * | | SD: | PB * | EB * | * |

FIG. 110

| SN | 97 | | | | | |
|---|---|---|---|---|---|---|
| ! | | SN(pitcher):ON | | | | |
| – | | Use HIT/ERROR result on next card | | | | |
| ON | | rhb:liner to leftcenter, SINGLE 2A2<br>lhb:grounder in the hole to right, SINGLE A2 | | | | |
| TROUBLE | | rhb:liner rolls to rightfield corner, DOUBLE, if batter is a pitcher DEEP TROUBLE<br>lhb:smash down firstbase line, DOUBLE, if batter is a pitcher DEEP TROUBLE | | | | |
| DEEP TROUBLE | | liner to rightcenter, TRIPLE | | | | |
| BLAST | | deep drive to power-centerfield, HOME RUN 30' | | | | |
| !? | | game suspended due to rain, then resumed, invent details | | | | |
| SAC BUNT | | batter misses bunt sign, takes pitch for strike | | | | |
| BUNT FOR HIT | | misses pitch | | | | |
| HIT&RUN | | – result | | | | |
| HIT/ERROR | | hard grounder up the middle handcuffs secondbaseman, SINGLE A1 | | | | |
| GB/FB | | Use HIT/ERROR result on next card | | | | |
| CHANCES | thrower * | on steal, strikeout, DP? | SD: | PB * | EB * | * |

FIG. 111

| DL | 98 | | | | | |
|---|---|---|---|---|---|---|
| ! | | DL(pitcher):TROUBLE | | | | |
| – | | Use HIT/ERROR result on next card | | | | |
| ON | | rhb:liner to leftcenter, SINGLE<br>lhb:liner in the hole to right, SINGLE A2 | | | | |
| TROUBLE | | liner to rightfield corner CH(RF+*):routine play or DOUBLE | | | | |
| DEEP TROUBLE | | liner to rightcenter, TRIPLE | | | | |
| BLAST | | deep drive to opposite-center field, HOME RUN 1' | | | | |
| !? | | game suspended due to rain, then resumed, invent details | | | | |
| SAC BUNT | | batter misses bunt sign, takes pitch for ball | | | | |
| BUNT FOR HIT | | misses pitch | | | | |
| HIT&RUN | | – result | | | | |
| HIT/ERROR | | rhb:grounder in the hole at shortstop, late throw, SINGLE A1<br>lhb:slow grounder between first base and the mound, SINGLE A1 | | | | |
| GB/FB | | Use HIT/ERROR result on next card | | | | |
| CHANCES | thrower * | on steal, strikeout, DP? | SD: | PB * | EB * | * |

FIG. 112

| TE | 99 | | | | | |
|---|---|---|---|---|---|---|
| ! | | TP(pitcher):DEEP TROUBLE, zero triple batter or pitcher: get – result | | | | |
| – | | Use HIT/ERROR result on next card | | | | |
| ON | | rhb:liner to center, SINGLE 2A2 2GA2<br>lhb:grounder in the hole to right, SINGLE 2GA2 | | | | |
| TROUBLE | | liner down rightfield line, DOUBLE, if batter is a pitcher DEEP TROUBLE | | | | |
| DEEP TROUBLE | | liner to rightcenter, TRIPLE, ER(cf):mishandles ball, batter scores | | | | |
| BLAST | | deep drive to opposite field, HOME RUN 1' | | | | |
| !? | | game suspended due to rain, then resumed, invent details | | | | |
| SAC BUNT | | batter misses bunt sign, swings and misses | | | | |
| BUNT FOR HIT | | foul | | | | |
| HIT&RUN | | – result | | | | |
| HIT/ERROR | | rhb:grounder in the hole at shortstop, late throw, SINGLE A1<br>lhb:slow grounder on the right side gets past pitcher, SINGLE A1 | | | | |
| GB/FB | | Use HIT/ERROR result on next card | | | | |
| CHANCES | | thrower * | on steal, strikeout, DP? | SD: | PB * | EB * | * |

37

FIG. 113

| HM | 100 | | | | | |
|---|---|---|---|---|---|---|
| ! | | HM(pitcher):BLAST, low HR batter: get – result | | | | |
| – | | Use HIT/ERROR result on next card | | | | |
| ON | | rhb:liner to center, SINGLE 2A2 2GA2<br>lhb:liner in the hole to right, SINGLE | | | | |
| TROUBLE | | liner down rightfield line, DOUBLE, if batter is a pitcher DEEP TROUBLE | | | | |
| DEEP TROUBLE | | to rightcenter, TRIPLE, ER(rf):mishandles ball, batter scores | | | | |
| BLAST | | deep drive to opposite field, HOME RUN 5' | | | | |
| !? | | game suspended due to rain, then stopped | | | | |
| SAC BUNT | | batter misses bunt sign and swings, get a play result as usual | | | | |
| BUNT FOR HIT | | foul | | | | |
| HIT&RUN | | – result | | | | |
| HIT/ERROR | | rhb:grounder in the hole at shortstop, late throw, SINGLE A1<br>lhb:slow grounder on the left side past the mound, SINGLE A1 | | | | |
| GB/FB | | Use HIT/ERROR result on next card | | | | |
| CHANCES | | thrower * | on steal, strikeout, DP? | SD: | PB * | EB * | + |

35

FIG. 114

| | | | | | | |
|---|---|---|---|---|---|---|
| see at right | 101 | if second is open, CP(p):pickoff at first<br>1-3 (see Pickoff table) or safe<br>on BSR or PSR checks, good pitch movement, check another card<br>on BLAST checks, check another card | | | | |
| | | | | | | |
| ON | | 1-57:Use HIT/ERROR result on next card,<br>58-114:foul pop near dugout PO 3 | | | | |
| TROUBLE<br>DEEP TROUBLE<br>BLAST | | good pitch to hit, take another card | | | | |
| !? | | soft liner to pitcher, runner doubled off first, if first is empty lead runner doubled off | | | | |
| SAC BUNT<br>BUNT FOR HIT<br>HIT&RUN | | pitcher shakes off catcher, take another card | | | | |
| HIT/ERROR | | if runner on first, grounder, FC at second, misplay receiving throw at first, see Outcome table, if first is empty take another card | | | | |
| GB/FB | | 1-57:Use HIT/ERROR result on next card,<br>58-114: take another card | | | | |
| CHANCES | safe | on steal, out at third or home | safe | WP + | ER + | + |

FIG. 115

| | | | | | | |
|---|---|---|---|---|---|---|
| see at right | 102 | pickoff attempt at choice of second or third,<br>CP(p):pickoff (see pickoff table) or safe<br>on BSR or PSR checks, hanging pitch, check another card<br>on BLAST checks, check another card | | | | |
| | | | | | | |
| ON | | popout to short | | | | |
| TROUBLE<br>DEEP TROUBLE<br>BLAST | | good pitch to hit, take another card | | | | |
| !? | | soft liner to pitcher | | | | |
| SAC BUNT<br>BUNT FOR HIT<br>HIT&RUN | | batter steps out of the box, take another card | | | | |
| HIT/ERROR | | if runner on first, grounder, FC at second, misplay receiving throw at first, see Outcome table, if first is empty take another card | | | | |
| GB | | GD:6-4-3 DP, or grounder to shortstop, 3A | | | | |
| CHANCES | safe | on steal, out at third or home | safe | WP + | ER + | + |

51

FIG. 116

| | | | | | | | |
|---|---|---|---|---|---|---|---|
| see at right | 103 | if this is the first result card on a play, check WP, BK, or PB rating<br>on BSR or PSR checks, hanging pitch, check another card<br>on BLAST checks, check another card | | | | | |
| | | | | | | | |
| - | | GD:6-4-3 DP, or grounder to shortstop, 3A | | | | | |
| ON | | good pitch to hit, take another card | | | | | |
| TROUBLE | | | | | | | |
| DEEP TROUBLE | | | | | | | |
| BLAST | | | | | | | |
| !? | | hard liner to pitcher | | | | | |
| SAC BUNT | | pitcher rubs up the ball, take another card | | | | | |
| BUNT FOR HIT | | | | | | | |
| HIT&RUN | | | | | | | |
| HIT/ERROR | | if runner on first, grounder, FC at second, misplay receiving throw at first, see Outcome table, if first is empty take another card | | | | | |
| FB | | popout to short | | | | | |
| CHANCES | | runner + | on steal, out at third or home | safe | WP +, SD:adv 1 or 2 | ER * | + |

25

FIG. 117

| | | | | | | | |
|---|---|---|---|---|---|---|---|
| see at right | 104 | if this is the first result card on a play, check WP, BK, or PB rating<br>on BSR or PSR checks, hanging pitch, check another card<br>on BLAST checks, check another card | | | | | |
| | | | | | | | |
| - | | rhb:fly to left, 3A<br>lhb:smash to secondbaseman, AR:4-6-3 DP 3A | | | | | |
| ON | | good pitch to hit, take another card | | | | | |
| TROUBLE | | | | | | | |
| DEEP TROUBLE | | | | | | | |
| BLAST | | | | | | | |
| !? | | soft liner to pitcher | | | | | |
| SAC BUNT | | batter steps out of the box, take another card | | | | | |
| BUNT FOR HIT | | | | | | | |
| HIT&RUN | | | | | | | |
| HIT/ERROR | | if runner on first, grounder, FC at second, misplay receiving throw at first, see Outcome table, if first is empty take another card | | | | | |
| GB/FB | | rhb:smash to secondbaseman, AR:4-6-3 DP 3A<br>lhb:fly to left, 3A | | | | | |
| CHANCES | | runner + | on steal, pickoff attempt by pitcher MV: | safe | WP *, SD for advance | ER * | + |

FIG. 118

| | | | | | | | |
|---|---|---|---|---|---|---|---|
| see at right | 105 | if this is the first result card on a play, check WP, BK, or PB rating<br>on BSR or PSR checks, pulls the string, check another card<br>on BLAST checks, check another card | | | | | |
| | | | | | | | |
| - | | rhb:fly to center, 3A<br>lhb:chopper to secondbaseman, CH:4 FC, 2A, 3A | | | | | |
| ON | | pitch hangs, take another card | | | | | |
| TROUBLE | | | | | | | |
| DEEP TROUBLE | | | | | | | |
| BLAST | | | | | | | |
| !? | | soft liner to pitcher | | | | | |
| SAC BUNT | | pitcher steps off the rubber, take another card | | | | | |
| BUNT FOR HIT | | | | | | | |
| HIT&RUN | | | | | | | |
| HIT/ERROR | | if runner on first, grounder, misplay receiving throw at second, see Outcome table, if first is empty take another card | | | | | |
| GB/FB | | rhb:chopper to secondbaseman, CH:4 FC, 2A, 3A<br>lhb:fly to center, 3A | | | | | |
| CHANCES | | runner * | on steal, out at third or home | safe | WP * | ER * | * |

FIG. 119

| | | | | | | | |
|---|---|---|---|---|---|---|---|
| see at right | 106 | if this is the first result card on a play, check PT rating<br>on BSR or PSR checks, gets the pitch up, check another card<br>on BLAST checks, check another card | | | | | |
| | | | | | | | |
| - | | rhb:fly to right, 2A, 3A<br>lhb:grounder to secondbaseman, AR:SD:4-6-3 DP 3A, 2A, 3A | | | | | |
| ON | | pitch hangs, take another card | | | | | |
| TROUBLE | | | | | | | |
| DEEP TROUBLE | | | | | | | |
| BLAST | | | | | | | |
| !? | | soft liner to pitcher | | | | | |
| SAC BUNT | | umpire dusts off plate, take another card | | | | | |
| BUNT FOR HIT | | | | | | | |
| HIT&RUN | | | | | | | |
| HIT/ERROR | | if runner on first, grounder, misplay receiving throw at second, see Outcome table, if first is empty take another card | | | | | |
| GB/FB | | rhb:grounder to secondbaseman, AR:SD:4-6-3 DP 3A, 2A, 3A<br>lhb:fly to right, 2A, 3A | | | | | |
| CHANCES | | runner * | on steal except home<br>ER(c):overthrow A2 | safe | WP * | ER * | * |

49

FIG. 120

| | | | | | | |
|---|---|---|---|---|---|---|
| see at right | 107 | if this is the first result card on a play, check PT rating<br>on BSR or PSR checks, gets the pitch up, check another card<br>on BLAST checks, check another card | | | | |
| | | | | | | |
| - | | rhb:popup in shallow leftcenter (PO 6)<br>lhb:bouncer in the hole gloved by secondbaseman, AR:SD:4-6-3 DP 3A, 2A, 3A | | | | |
| ON | | pitch hangs, take another card | | | | |
| TROUBLE | | | | | | |
| DEEP TROUBLE | | | | | | |
| BLAST | | | | | | |
| !? | | invent double play, if bases empty or two out take another card | | | | |
| SAC BUNT | | pitcher steps off the rubber, take another card | | | | |
| BUNT FOR HIT | | | | | | |
| HIT&RUN | | | | | | |
| HIT/ERROR | | if runner on first, grounder, misplay receiving throw at second, see Outcome table, if first is empty take another card | | | | |
| GB/FB | | rhb:bouncer in the hole gloved by secondbaseman, AR:SD:4-6-3 DP 3A, 2A, 3A<br>lhb:popup in shallow leftcenter (PO 6) | | | | |
| CHANCES | | runner * | | safe | WP * | ER * | * |

FIG. 121

| | | | | | | |
|---|---|---|---|---|---|---|
| pitcher shakes off catcher | 108 | take another card<br>on BSR or PSR checks, gets the pitch up, check another card<br>on BLAST checks, check another card | | | | |
| | | | | | | |
| - | | bouncer to secondbaseman, 2A, 3A | | | | |
| ON | | pitch hangs, take another card | | | | |
| TROUBLE | | | | | | |
| DEEP TROUBLE | | | | | | |
| BLAST | | | | | | |
| !? | | invent double play, if bases empty or two out take another card | | | | |
| SAC BUNT | | pitcher shakes off catcher, take another card | | | | |
| BUNT FOR HIT | | | | | | |
| HIT&RUN | | | | | | |
| HIT/ERROR | | if runner on first, grounder, misplay receiving throw at second, see Outcome table, if first is empty take another card | | | | |
| FB | | foul pop to the right side (PO 3) | | | | |
| CHANCES | | runner * | | safe | WP * | EB + | * |

FIG. 122

| | | | | | | |
|---|---|---|---|---|---|---|
| batter steps out of the box | 109 | take another card<br><br>on BSR or PSR checks, low pitch, check another card<br>on BLAST checks, check another card | | | | |
| | | | | | | |
| - | | bouncer to shortstop, AR:6-4-3 DP, 3A | | | | |
| ON | | gets the pitch up, take another card | | | | |
| TROUBLE | | | | | | |
| DEEP TROUBLE | | | | | | |
| BLAST | | | | | | |
| !? | | invent double play, if bases empty or two out take another card | | | | |
| SAC BUNT | | batter steps out of the box, take another card | | | | |
| BUNT FOR HIT | | | | | | |
| HIT&RUN | | | | | | |
| HIT/ERROR | | take another card | | | | |
| FB | | flyout to center, 3A | | | | |
| CHANCES | | thrower + | | safe | WP * | EB + | * |

FIG. 123

| | | | | | | |
|---|---|---|---|---|---|---|
| pitcher rubs up the ball | 110 | take another card<br><br>on BSR or PSR checks, low pitch, check another card<br>on BLAST checks, check another card | | | | |
| | | | | | | |
| - | | bouncer to first, 2A | | | | |
| ON | | gets the pitch up, take another card | | | | |
| TROUBLE | | | | | | |
| DEEP TROUBLE | | | | | | |
| BLAST | | | | | | |
| !? | | take another card | | | | |
| SAC BUNT | | pitcher rubs up the ball, take another card | | | | |
| BUNT FOR HIT | | | | | | |
| HIT&RUN | | | | | | |
| HIT/ERROR | | take another card | | | | |
| FB | | pop to second | | | | |
| CHANCES | | thrower + | on steal, strikeout, DP? | safe | BK + | EB * | * |

FIG. 124

| | | | | | | | |
|---|---|---|---|---|---|---|---|
| batter steps out of the box | 111 | take another card<br><br>on BSR or PSR checks, good pitch, check another card<br>on BLAST checks, check another card | | | | | |
| | | | | | | | |
| – | | foul pop to the right side (PO 3) | | | | | |
| ON | | gets the pitch up, take another card | | | | | |
| TROUBLE | | | | | | | |
| DEEP TROUBLE | | | | | | | |
| BLAST | | | | | | | |
| !? | | take another card | | | | | |
| SAC BUNT | | batter steps out of the box, take another card | | | | | |
| BUNT FOR HIT | | | | | | | |
| HIT&RUN | | | | | | | |
| HIT/ERROR | | take another card | | | | | |
| GB | | bouncer to secondbaseman, 2A, 3A | | | | | |
| CHANCES | | thrower * | on steal, pickoff attempt by pitcher MV: | safe | BK * | EB * | * |

FIG. 125

| | | | | | | | |
|---|---|---|---|---|---|---|---|
| pitcher steps off the rubber | 112 | take another card<br><br>on BSR or PSR checks, good pitch, check another card<br>on BLAST checks, check another card | | | | | |
| | | | | | | | |
| – | | GD:4-6-3 DP 3A, or pop back of first | | | | | |
| ON | | gets the pitch up, take another card | | | | | |
| TROUBLE | | | | | | | |
| DEEP TROUBLE | | | | | | | |
| BLAST | | | | | | | |
| !? | | take another card | | | | | |
| SAC BUNT | | batter steps out of the box, take another card | | | | | |
| BUNT FOR HIT | | | | | | | |
| HIT&RUN | | | | | | | |
| HIT/ERROR | | take another card | | | | | |
| GB | | slow grounder to third, 2A, 3A | | | | | |
| CHANCES | | thrower * | | safe | BK * | EB * | * |

FIG. 126

| | | | | | | | |
|---|---|---|---|---|---|---|---|
| umpire dusts off plate | 113 | take another card<br><br>on BSR or PSR checks, low pitch, check another card<br>on BLAST checks, check another card | | | | | |
| | | | | | | | |
| - | | rhb: popout to third<br>lhb: liner to pitcher | | | | | |
| ON | | low pitch, take another card | | | | | |
| TROUBLE | | | | | | | |
| DEEP TROUBLE | | | | | | | |
| BLAST | | | | | | | |
| !? | | take another card | | | | | |
| SAC BUNT | | batter steps out of the box, take another card | | | | | |
| BUNT FOR HIT | | | | | | | |
| HIT&RUN | | | | | | | |
| HIT/ERROR | | take another card | | | | | |
| GB | | GD:4-6-3 DP 3A, or slow grounder to first, 2A, 3A | | | | | |
| CHANCES | | thrower * | | safe | PB * | EB * | * |

FIG. 127

| | | | | | | | |
|---|---|---|---|---|---|---|---|
| pitcher steps off the rubber | 114 | take another card<br><br>on BSR or PSR checks, low pitch, check another card<br>on BLAST checks, check another card | | | | | |
| | | | | | | | |
| - | | flyout to center, 3A | | | | | |
| ON | | low pitch, take another card | | | | | |
| TROUBLE | | | | | | | |
| DEEP TROUBLE | | | | | | | |
| BLAST | | | | | | | |
| !? | | take another card | | | | | |
| /SAC BUNT | | pitcher steps off the rubber, take another card | | | | | |
| BUNT FOR HIT | | | | | | | |
| HIT&RUN | | | | | | | |
| HIT/ERROR | | take another card | | | | | |
| GB | | bouncer to shortstop, AR:6-4-3 DP, 3A | | | | | |
| CHANCES | | thrower * | | safe | PB * | EB * | * |

FIG. 128

BASEBALL GAME

BACKGROUND

1. Field of Invention

This invention relates to baseball board games that simulate the performances of real-life teams and players.

BACKGROUND

2. Description of Prior Art

Of the table baseball games that re-create the season statistics of real-life players, the most popular ones are based on the concepts incorporated in U.S. Pat. No. 1,536,639 by Clifford van Beek (1925). The baseball game of Clifford van Beek involved the following:

The rolling of two different dice to produce a two-digit number between 11 and 66.

Using the number as an index into a set of play result symbols on a baseball player card. For example, dice roll number 12 on Babe Ruth's card might yield play result number 14.

Using the play result symbol to look up a play result on a playing board. For example, play result 14 might yield a strikeout.

The baseball games that derive in part from van Beek's baseball game include the APBA Major League Baseball Game (by Richard Seitz), The APBA Major League Baseball Master's Game, Strat-O-Matic Baseball, and U.S. Pat. No. 4,822,043 (1989) to Carter. Although van Beek's concept and its various later developments have many obvious strengths, as is witnessed by their market appeal, the concept has certain limitations. These limitations are the following, each of which is appears in one or more of these baseball games:

The heavy reliance upon tables, which take up space, creates a space limitation. If a gamemaker attempts to include every essential characteristic of baseball in a table game, he discovers he must leave something out. Sometimes rich, natural language descriptions of baseball are excluded in order to make room for tables. This characteristic reflects an absence of emphasis on presentation, unlike the effort to enhance the sports event which we witness when Major League Baseball is presented by its own players in their act of playing a game on the field or by radio and television sports announcers. Often features other than natural language play descriptions are excluded from a game due to the space limitations created by its structure. For example, in all table baseball games, the ability to reproduce a pitcher's earned run average suffers from such limitations.

The use of 36 two-digit numbers from 11 to 66 as generated by two dice to encode the characteristics of baseball players apparently limits the number of characteristics that can be easily encoded, thus maximizing the list of symbols needed to encode the characteristics.

The minimal play procedure is needlessly complex and requires the following steps and often many more:

1. Load different types of dice into a shaker or pick them up.
2. Shake the dice.
3. Roll the dice.
4. Read the result from the dice in a prescribed manner to produce a two-digit number.
5. Locate a prescribed column on a playing board or card and use the two-digit number as a row index to locate a specific row.

6. Read the intermediate or final result from the specified row.

The play-by-play results of a game of baseball come from the numbered rows in several tables, which involves the person playing the game in the activity of looking up numbers in the columns and rows of the tables.

The heavy reliance upon tables has encouraged complication. For example, the advanced version of a baseball game may add many features of baseball onto the basic game, but it accomplishes this by adding one additional table per feature, which forces the game player to look up a sequence of results in tables, adding considerably to his effort. In addition, the restrictiveness of the tabular game structure leads to unusual conventions which are contrary to reality. In one game, many baseball plays were allowed to occur only in severely limited situations. Because only 41 possibilities with at most three slight variations among them could occur with the bases empty, only about 41 plays were possible in that situation. In another game, the effect of the "pitcher tired" heading is only felt with a runner on base, not with the bases empty.

The heavy reliance upon tables makes the playing procedure for producing an out often more complex than the playing procedure to produce hit. The tendency of real-life baseball to become a game of outs rather than of exciting base runner advances is enhanced in the table games.

The reliance upon the use of two dice, each die representing a digit, to produce 36 possible random numbers is not a very effective aspect of game structure because it requires the repetition of all 36 numbers along with their corresponding results on the card for each baseball player, which uses up valuable space which could be better used and because it allows only 36 base possibilities to be encoded. This builds in a restriction on the number of play possibilities that must be overcome through further layers of structuring—and too often this results in more tables.

The reliance upon numbers as opposed to non-numeric symbols leads to the inclusion of numeric calculations which must be performed by game players, producing tedium and fatigue. For example; some plays require the game player to perform at least two separate subtraction operations such as 51-23-12 to produce a play result such as whether a runner stretches a single.

Great detail is lacking in the events of a game. Many events that occur in real-life baseball, such as realistic rundown plays, or dogs on the field, are excluded from a table game. Other events which consist of complex sequences such as unusual error followed by unusual error followed by unusual runner advance, are excluded from table games.

The limitations in Clifford van Beek's concept entail that any instantiation which attempts to incorporate the full range of novelty and detail found in a real-life baseball game will encounter many obstacles in its design-most likely the game will be extremely complicated or else linguistically inexpressive, as is evident in the marketed versions of table baseball games for adults.

OBJECTS AND ADVANTAGES

Several objects and advantages of the present invention are the following:

To provide a highly efficient method of encoding player characteristics and a highly efficient basic game-playing procedure, which together reduce the experience of complexity for the game player, thus making possible and facilitating the accomplishment of the other objects of this invention and producing the other advantages.

To provide a baseball game which incorporates a sufficient number of important characteristics of the real-life game of baseball to qualify as advanced, in the minds of advanced users.

To provide a baseball game that includes rich natural language play descriptions.

To provide a baseball game that reproduces the statistics of real-life baseball players including the earned run average of pitchers with greater accuracy than in other games.

To provide a richly featured baseball game which evenso can be played at different levels of complexity depending upon the level of advancement or age of the game player.

To encode player characteristics into non-numeric symbols, with each symbol capable of encoding many characteristics without subordinating the encoding of any one characteristics to any other.

To arrange play results in short lists rather than in tables of many rows and columns.

To incorporate a multitude of features into the elemental structure of the game instead of by adding on one table with many rows and columns per feature, thus avoiding table lookup operations that occur along two axes.

To provide a playing procedure for producing outs which is often easier than the playing procedure for producing hits. Thus, the experience of playing the game will be is one in which exciting plays are emphasized and dull plays; are deemphasized.

To limit table lookups in tables of many rows and columns to only rare occurrence.

To distribute play results across 100 cards, which avoids the "36" limitation imposed by using two dice to produce two digits. See FIGS. 15 through 128.

To produce over 100 verbally detailed results of each type of hit (single, double, and so on), in order to increase realism and to allow the inclusion of over 100 different specific results among each of the most exciting result types: singles, doubles, triples, and home runs.

To avoid requiring game players to perform successive additions and subtractions to produce routine play results.

To require the game player to perform simple visual reference operations primarily, thus limiting the complexity of the atomic tasks required to play the game.

To provide for the occurrence of many event combinations which, if specified by simple enumeration instead of by combination, would be impossible to include because they are too great in number.

Further objects and advantages of this invention will become apparent from a consideration of the drawings and ensuing description.

DESCRIPTION OF DRAWINGS

FIG. 3 shows a sample pitcher card with a special rating of "GB."

FIG. 4 shows a sample fielding card for a team.

FIG. 5 shows a sample park ratings chart.

FIG. 6 shows a Hit-and-Run table.

FIG. 7 shows a Pickoff table and a Rundown table.

FIG. 8 shows an Infield In or Corner In table and an Outfield Assists table.

FIG. 9 shows an Invent Play table.

FIG. 10 shows an Ejection table.

FIG. 11 shows a Great Play table.

FIG. 12 shows an Outcome table.

FIG. 13 shows an Injury table.

FIG. 14 shows a Type of Injury table.

FIGS. 15–128 show the result cards.

SUMMARY

The present baseball game represents the first comfortably playable baseball simulation game aimed at an adult audience of sophisticated baseball students which provides both a reproduction of the widest range of characteristics of real-life baseball and rich natural language play descriptions. This baseball game produces an experience which imitates real-life baseball in every way. In accomplishing this feat, this baseball game makes no consequential sacrifices—through its design, this baseball game makes possible the production of even more accurate statistics than the other games with a minimum of mental effort required of the game player, and, in its simplified version, is rapidly played by children of ten or older as well as by adults. In order to play the game comfortably, one must play approximately five to ten startup games to learn the playing procedure. After the procedure is learned, when played at a normal pace the simplified version of the game is playable in 20 to 35 minutes. The advanced game is playable in 40 to 55 minutes.

DESCRIPTION OF INVENTION

The game consists of the following:

Batter cards. Each batter card represents the statistical performance of batter in batting and fielding.

Pitcher cards. Each pitcher card represents the statistical performance of a pitcher in pitching and fielding.

Fielding cards. Each fielding card represents the statistical performances in fielding for all players on a team.

Ballpark ratings chart. The ballpark rating chart represents the statistical tendencies for home runs to be hit in different ballparks.

114 result cards. Each result card provides a portion of the range of results that can occur in a baseball game.

Tables. Each table finely details a portion of a small subset of results that can occur in a baseball game.

Note: The Invent Play table, shown in FIG. 9 and described in the section "Invent Play" allows a game player use his own imagination to insert plays into the baseball game currently going on, which ensures that every possible play can occur in the game.

Figure 1:
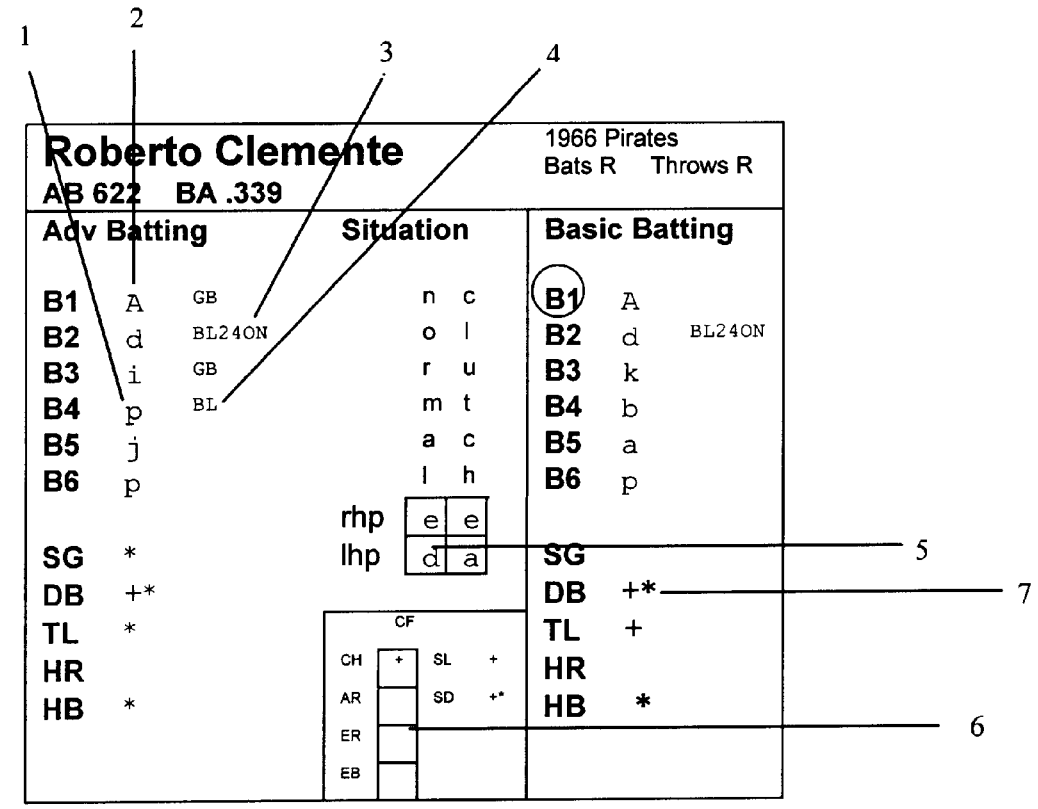
FIG. 1 shows a sample batter card.

FIG. 1 illustrates a batter card. On the upper left of FIG. 1, under the heading "Adv Batting" are the batting ratings that are used in the advanced version of the game. The rating names "B1" through "B6" appear. To the right of the rating names are the B1 through B6 ratings. These ratings represent the broad statistical characteristics of a real-life batter-for example, a batting average in the range from 0.240 to 0.250.

Below the rating name "B6" are the rating names "SG," "DB," "TL," and "HR." To the right of these rating names are the SG through HR ratings. These ratings finely detail the statistical characteristics of a real-life batter to more closely simulate of his real-life performance-for example, a batting average of 0.246.

Below the HR rating name is the rating name "HB." To the right of this rating name is the HB rating, which represents the frequency of the batter to be hit by a pitch.

An important structural fact of the game is that real-life statistics are encoded into non-numeric symbols instead of numbers. Specifically, a letter of the alphabet may have encoded within it up to four independent statistics. (The adjective "independent" indicates that the statistics are not related to each other. For example, if a batter hits more singles, that fact does not cause him to hit more doubles, because doubles and singles are independent of each other. However, hitting more singles does increase runs batted in, because runs batted in is dependent on singles.) For example, the letter may have the following encoded independent statistics:

6 doubles per×plate appearances 12 home runs per×plate appearances 12 singles per×plate appearances 24 singles per×plate appearances The encoding of up to four statistics into a single letter compresses the encoding so that few ratings are needed to encapsulate information. As a result, more ratings can be included into the game without resulting in excessive complication of the play procedure. Once the play procedure is mastered, a person can play multiple games in the same sitting without fatigue.

How are statistics encoded? The symbols B1, B2, B3, B4, B5, and B6 are each associated with a subset of result cards and each symbol labels the subset of result cards. For example, there is a subset of result cards labeled "B1." (See FIGS. 15 through 30). Each symbol such as B 1 is associated with a batter rating and labels the batter rating. For example, there is a batter rating labeled "B1." (See 2 on FIG. 1.) Each batter rating encodes four yes or no decisions about four batter statistics.

Each subset of result cards is further subdivided into subgroups. Each card in a specific subgroup contains the same type of potential play result as other cards in that subgroup, a play result such as "ON" (which usually results in a single, see 13 on FIG. 15) or TROUBLE (which usually results in a "double"). Whether the potential play result becomes an actual play result depends upon the yes or no information encoded into the batter rating for the subgroup of cards in which that potential play results resides.

(FIGS. 15 and 16 are a subgroup of ON results in the subset of B1 cards. A subgroup is constituted by result cards that have identical subset symbols such as B 1, indentical types of results such as "ON," and identical locations for the underlining under the string of letters "a" through "p" at the top of the result card.)

For example, suppose that the B1 subset of cards contains the following subgroups:

ON result (2 cards)

Strikeout result (2 cards)

Strikeout result (4 cards)

Strikeout result (8 cards)

Suppose the batter's B1 rating is "d" and the batter's "d" rating encodes the decisions "yes," "yes," "no," and "no" respectively to the four subgroups of results in this list. The method of encoding "yes" and "no" decisions is as follows.

Each result card contains a string of actualization symbols, the letters "a" through "p" (see 27 on FIG. 15), which correspond to the possible batter ratings, "a" through "p." On each result card, some of the actualization symbols in the string are associated with the potential play result on the same result card. These actualization symbols are highlighted with underlining, meaning that the underlined actualization symbols are active on the current result card. (See 12 on FIG. 15). If the batter rating matches an active actualization symbol, the play associated with the actualization symbol occurs.

It is clear that this encoding method allows the encoding of several independent statistics without subordinating the encoding of any one statistic to that of any other.

A random item generator, which is a result card (see FIG. 15), when drawn at random provides a symbol which indicates the subset to which a result card belongs, actualization symbols, and play results such as ON. There is a necessary association between these entities. The symbol on a result card is associated with the type of play result on its card. A symbol is also associated with certain actualization symbols which are active on its result card. Thus, the random item generator must generate symbol, associated active actualization symbol, and associated play result simultaneously. Drawing of a card appears to be the preferable way to accomplish these tasks.

The SG, DB, TL, and HR ratings refine the output of batter statistics for singles, doubles, triples, and home runs respectively. Each of the ratings SG, DB, TL, and HR is associated with exactly one result card, which represents 6 events in x plate appearances (rougly six events per real-life season). When during the course of play, the result card is consulted, the batter's rating for that type of result is tested. For example, if the batter has an SG rating of "+*," the rating always wins the test and an ON result occurs. If the batter has an SG rating of "*," the batter wins the test ⅔ of the time. If the batter has a SG rating of "+," the batter wins the test 1/3 of the time. If the batter has an SG rating of " ", the batter never wins the test.

The statistics encoded for batters using letters or the symbols "+," "*," and "+*" include singles, doubles, triples, home runs, walks, strikeouts, stolen bases, and instances of hit by pitch.

Under the "Situation" heading is a set of situational ratings. The situational ratings modify the advanced batting ratings to simulate the performance of a batter in several different situations including his performance against right-handed pitching, his performance against left-handed pitching, his performance with second and third bases unoccupied (non-clutch situations), and his performance with either second or third base occupied (clutch situations). The real-life statistics representing two abilities-performance dependent upon which arm the pitcher throws with and performance in clutch or non-clutch situations-are merged in each situational rating. That is, a rating such as "a" represents two abilities.

The merging of two situational abilities of a batter into a single letter compresses information. As a result, a single manual test for the effect of a specific situational rating performs double-work and reduces playing effort. In this manual test, the actualization symbols double as "comparison symbols" and are used in performing the comparison. Specifically, the string of comparison symbols are split by extra spacing into two segments to indicate which symbols win the comparison and which symbols lose the comparison.

Below the situational ratings are the fielding ratings. On the left of the fielding ratings are the rating names "CH," "AR," "ER," and "EB." The CH rating represents the ability of the player to field the ball successfully. For outfielders the CH rating represents an ability to make putouts. For infielders, the CH rating represents the ability to produce assists. To the right of the rating names are columns of ratings, one column for each position played by the player. The AR rating represents the ability of an outfielder to produce assists or the ability of an infielder to produce double plays. The ER and EB ratings together represent the tendency of a player to commit errors.

Statistics are encoded for fielders without using letters, but using the symbols "+," "*," and "+*." These symbols represent steps of increasing ability. Use of these ratings allows quantitative tests to be performed without requiring game players to perform mental arithmetic themselves. No comparison of numbers is required. This differs from the practice of other games, which typically ask a game player to compare numbers. Is 2 less than 4? The present baseball game asks the game player to take a random card and check if the fielder's rating appears on the card. For example, the result card symbols "+" and "*" both appear in the rating "+*," so either passes the test if "+*" is the rating tested. Thus, a simple visual reference operation takes the place of a mathematical computation.

To the right of the fielding ratings are the rating names "SL" and "SD." The SL rating represents the ability of a layer to steal bases. The SD rating represents a player's baserunning expertise and ability.

On the right of FIG. 1, under the heading "Basic Batting," the fall set of batter rating names appears again. To the right of the rating names are the batting ratings that are used in the basic version of the game instead of the advanced batting ratings.

Figure 2:
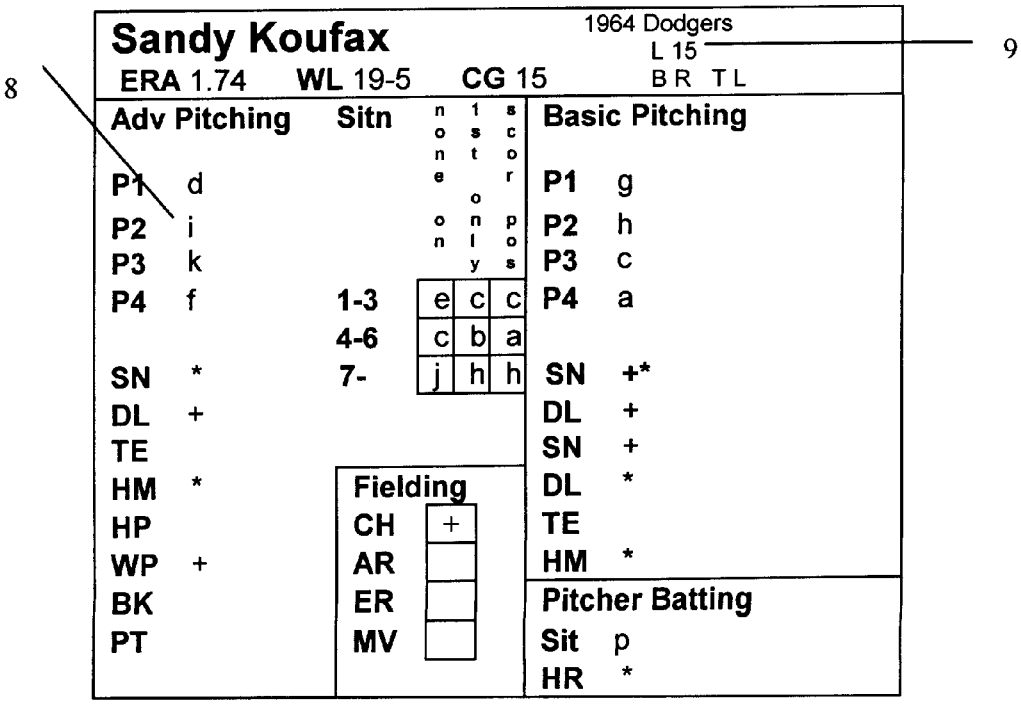
FIG. 2 shows a sample pitcher card.

FIG. 2 illustrates a pitcher card. On the upper left of FIG. 1, under the heading "Adv Pitching" are the pitching ratings that are used in the advanced version of the game. The rating names "P1" through "P4" appear. To the right of the rating names are the P1 through P4 ratings. These ratings represent the broad statistical characteristics of a real-life pitcher—for example, the characteristic of giving up between 10 and 20 home runs in a full season.

Below the rating name "P4" are the rating names "SN," "DL," "TE," and "+." To the right of these rating names are the SN through HM ratings. These ratings finely detail the statistical characteristics of a real-life pitcher to more closely simulate his real-life performance—for example, the characteristic of giving up 16 home runs over a full season.

Below the HM rating name are the rating names "HP," "WP," "BK," and "PT." To the right of these ratings names are the HP through PT ratings. The HP rating represents a pitcher's statistical tendency to hit batters with pitches. The WP rating represents a pitcher's statistical tendency to throw wild pitches. The BK rating represents a pitcher's statistical tendency to commit balks. The PT ("pitch") rating refines the simulation of a pitcher's statistical tendency to throw wild pitches or commit balks.

The method of encoding statistics for pitchers is identical to the method for batters. Specifically, a letter may have encoded within it up to four pitcher statistics.

The symbols P1, P2, P3, and P4 are each associated with a subset of result cards and with a pitcher rating. The method of encoding statistics into pitcher ratings is identical to the method used to encode statistics into batter ratings.

The P1 through P4 ratings are each letters "a" through "p." Each letter represents a set of "yes" and "no" indications as to the presence of specific pitching characteristics.

The ratings SN, SL, TE, HM refine the encoding of pitcher statistics for singles, doubles, triples, and home runs, respectively. These statistics are encoded for pitchers using the symbols "+," "*," and "+*" (identical to the method of encoding into these symbols described for batters) include singles, doubles, triples, home runs, walks, strikeouts, balks and wild pitches.

Under the "Situation" heading is a set of situational ratings. The situational ratings modify the advanced pitching ratings to simulate the performance of a pitcher in several different situations including his performance over three stages of the usual span of innings he pitches—early, middle, and late. The situational ratings also simulate the performance of a pitcher with the bases empty, with a runner on first only, and with a runner in scoring position. The real-life statistics representing two abilities-performance in different stages of the game and performance in different base-occupied situations—are merged in each situational rating. That is, a rating such as "a" represents two abilities.

The merging of two situational abilities of a pitcher into a single letter compresses information. As a result, a single manual test for the effect of a specific situational rating performs double-work and reduces playing effort.

The inclusion of no less than three base situation ratings and no less than three inning-effectiveness ratings for a pitcher increases the ability of the game to reproduce the real-life earned run average of the pitcher. This results from the fact that the more real-life measurements that a game incorporate with realism, the more realistic will be any statistics that depend upon those measurements. It is clear that earned run average, which represents the number of runs unassisted by misplays that a pitcher allows in a nine-inning game, is dependent upon the statistics that measure his effectiveness with bases empty, with runners on first, with bases full, and also dependent upon the statistics that measure his effectiveness at different stages of the game. For example, if a pitcher allows a high batting average in situations in which a runner has already advanced as far as second base, his earned run average will increase more than it will if allows that high batting average when the bases are empty. Furthermore, it is clear that for a starting pitcher who rarely lasts until the seventh inning, if he allows a high batting average in the early innings his earned run average will increase more than if he allows a high batting average in the late innings, in which he rarely even appears. The more measurements or "snapshots" of a pitcher's performance that the inventor of a table baseball game can incorporate into his game, the better will be the ability of the game to reproduce earned run average.

Below the situational ratings are the fielding ratings. On the left of the fielding ratings are the rating names "CH," "AR," "ER," and "MV." The CH rating represents the ability of the pitcher to produce assists. The AR rating represents the ability of the pitcher to produce double plays. The ER ratings represents the tendency of a pitcher to commit errors. The MV rating represents the ability of the player to pick off runners.

On the right of FIG. 1, under the heading "Basic Pitching," the full set of pitcher rating names appears again. To the right of the rating names are the pitching ratings that are used in the basic version of the game instead of the advanced pitching ratings.

FIG. 4 illustrates a fielding card. At the top of the fielding card are rating names. Most of these rating names ("CH," "AR," "ER," "EB," "SL," and "SD) have been discussed. The "PB" rating represents a catcher's statistical tendency to commit passed balls. The "GS" and "G" columns provide season statistics for games started and games played. The left column of a fielding card lists player names.

FIG. 5 illustrates a ballpark rating chart. The ballpark rating chart produces realistic variations in the number of home runs hit in each ballpark.

FIG. 15 through 128 illustrate result cards. See FIG. 15. "B1" appears in the top left of the card, at 11 in FIG. 15. The box in the top left is called the "B/P box." The value in this box indicates which batter or pitcher rating controls the play. In FIG. 15, "B1" indicates that the B1 batter rating controls the play.

To the right of the B/P box is the random box, 26 on FIG. 15. This box contains a random number that is used at various points in play.

To the right of the random box is the letter box, 27 on FIG. 15, which contains the main simulation devices in the game.

Below the B/P box are different headings for rows on a result card.

The "!" (bang) heading labels the row that contains the play result to be used when the batter or pitcher has the rating specified in the B/P box.

The "–" (minus) heading labels the row that contains the play result to be used when the batter or pitcher does not have the rating specified in the B/P box. Usually the "–" results are outs. The play result is expressed in English, with detail to provide color. See 53 on FIG. 88.

The "ON" heading labels the row that contains the play result to be used when a! heading on the preceding card specified ON as the result. ON results are usually singles. The play result is expressed in English, with detail to provide color. See 54 on FIG. 88.

The "TROUBLE" heading labels the row that contains the play result to be used when a! heading on the preceding card specified TROUBLE as the result. TROUBLE results are usually doubles. The play result is expressed in English, with extra detail to provide color because doubles are exciting plays. The purpose is to increase the relative intensity of the experience of doubles. See 55 on FIG. 88.

The "DEEP TROUBLE" heading labels the row that contains the play result to be used when a! heading on the preceding card specified DEEP TROUBLE as the result. DEEP TROUBLE results are usually triples. The play result is expressed in English, with extra detail to provide color because triples are exciting plays. The purpose is to increase the relative intensity of the experience of triples. See 56 on FIG. 88.

The "BLAST" heading labels the row that contains the play result to be used when a! heading on the preceding card specified BLAST as the result. BLAST results are often ho me runs. The play result is expressed in English, with maximum detail to provide color because home runs are exciting plays. The purpose is to increase the relative intensity of the experience of home runs. See 57 on FIG. 88.

The "!?" heading labels the row that contains the play result to be used when a! heading on the preceding card specified !? as the result. The !? plays are often colorful, unusual, surprising plays. The play result is expressed in English, with detail to provide color because such plays are exciting plays. The purpose is to increase the relative intensity of the experience of these plays. See 58 on FIG. 88.

The "SAC BUNT" heading labels the row that contains the play result to be used when the offensive game player chooses to try a sacrifice bunt.

The "BUNT FOR HIT" heading labels the row that contains the play result to be used when the offensive game player chooses to try to bunt for a hit.

The "HIT & RUN" heading labels the row that contains the play result to be used when the offensive game player chooses to try a hit and run play.

The "HIT/ERROR" heading labels the row that contains the play result to be used when a ! heading on the preceding card specified HIT/ERROR as the result. These plays are often infield hits or errors. The play result is expressed in English, with detail to provide color because such plays are exciting plays. The purpose is to increase the relative intensity of the experience of these plays. See 59 on FIG. 90.

The "FB" heading labels the row that contains the play result to be used when an "FB" result was derived from a batter or pitcher card. ("TB" alternates with "GB" on result cards.)

The "CHANCES" heading labels a row to be used in various circumstances, which are described in the section "How to Play the Baseball Game."

In the CHANCES row are the following:

Close play box, 28 on FIG. 17

Steal box, 29 on FIG. 17

Outfield box, 30 on FIG. 17

Pitch box, 31 on FIG. 17

ER/EB box, 32 on FIG. 17

Chances box, 33 on FIG. 17

FIG. 6 is the Hit and Run table. The Hit and Run table provides the runner advance results when the offensive game player attempts a hit and run.

FIG. 7 is the Pickoff table and the Rundown table. These tables provide results when a runner is caught off base.

FIG. 8 is the Infield In or Corners In table and the Outfield Assists table. The Infield In or Corners In table provides results when the defensive manager plays one or more infielders in on the grass. The Outfield Assists table provides results when an outfielder makes a throw to a base.

FIG. 9 is the Invent Play table allows one or both players are to invent a novel play, which can include any level of detail, even balloons on the field.

FIG. 10 is the Ejection table. The Ejection play provides results when one or more players are ejected.

FIG. 11 is the Great Play table, which provides results when a defensive player has made a great play.

FIG. 12 is the Outcome table, which provides results in miscellaneous circumstances, and provides for the occurrence of many event combinations which, if specified by simple enumeration instead of by combination, would be impossible to include because they are too great in number.

FIG. 13 is the Injury table, which provides results when a player is injured.

FIG. 14 are the Type of Injury tables, which provide information about the type of an injury.

How to Play the Baseball Game

This baseball game is two games in one—a basic game and an advanced game. Both games play fast but the basic game plays faster. Both provide realistic statistics but the advanced game has more detail.

To start out, you and another game player choose teams and arrange the batting orders, or if you are playing alone, you do this for two teams. You can use any baseball scoresheet. Enter the batting order. Shuffle the deck of result cards well the first time you play. As you play cards from the deck, discard them into two other piles. When you have played all cards in the main deck, put the two discard piles together into a single deck, cut the deck, and continue.

The Basic Game

Let's try a sample at bat with Roberto Clemente at the plate. See the card that represents Clemente, FIG. 1. You draw a card. For example, see FIG. 15.

B1, at 11 in the upper left of FIG. 15, dictates that you look up the batter's B1 rating. (When playing the basic version of the game, use the ratings under "Basic Batting.") Under "Basic Batting," the B1 rating at 2 in FIG. 1 is "A." Check the row of letters at the top of the same result card, at 12 in FIG. 15, to see if the rating is underlined. It is.

If a rating is underlined and on the same result card the ! (pronounced "bang") result is a walk or a strikeout, that is the play result. If the ! result is ON, TROUBLE, DEEP TROUBLE, or BLAST, you find the play result by reading the ! result on the next result card. In this case, the ! result is ON, at 13 in FIG. 15, so you take another card and look up the ON result. Suppose the next result card is the card in FIG. 19.

The ON result at 14 on FIG. 19 is as follows:

grounder in the hole to left, SINGLE 2PL 7-2 PLB 7-5-4 2GA2

Roberto Clemente is on. Following the word SINGLE are the details of runner advance. 2PL 7-2 means that a runner on second may be involved in a play at the plate. PLB means the batter tries to advance to second on a throw home. On the play at the plate the throw can be cut off to try for the batter advancing to second on the throw. If the batter is out on the close play, the play goes 7-5-4. 2GA2 means that with two gone (2G) all runners advance two bases.

Assume that instead of a rating of "A," the B1 rating for Clemente turned out to be "p," which was not underlined on the result card. If a rating is not underlined, the play result comes from the "–" (minus) result on the next result card. A "–" result (such as "grounder to shortstop") is always an out unless otherwise indicated.

With Clemente at the plate, assume that you draw the result card shown in FIG. 68. DB, at 18 in the upper left of FIG. 68, means to check Clemente's DB rating in the "Basic Batting" section, which is +*, at 7 in FIG. 1. Take another result card. Suppose you get the card in FIG. 42. Examine the chances box, the box in the bottom right of a result card, at 17 in FIG. 42.

In the chances box, you will find either a + or a *, in this case +. If the character you find is contained in the player's rating, the player wins the test. Clemente's DB rating of +* wins the test, so you use the ! result on the result card where you found DB in the upper left. See FIG. 68. On this card, the ! result is DB(batter):TROUBLE. Take another result card and use the TROUBLE result Clemente may have smacked an extra-base hit.

If the first result card on a play instructs you to check a pitcher rating such as P1, check the P1 rating of the pitcher under "Basic Pitching" and otherwise proceed as with a batter rating to get the final play result.

Special Ratings

Many batters and pitchers have special ratings. For example, suppose you are checking the B4 result on Clemente'2 card, which is "p" at 1 in FIG. 1, and when you take a result card you find that the "p" rating is not underlined on the result card. In this case, use the special rating BL (blast) which follows on the B4 line of Clemente's card, at 4 in FIG. 1. As special ratings, TROUBLE, DEEP TROUBLE, and BLAST are abbreviated TB, DT, and BL, respectively.

Special ratings for batters can appear after the B1–B6 ratings or after the SG, DB, TL, and HR ratings. For example, if an SG+ rating is followed by BL and the CHANCES test for + does not win the test (yields no ON result), use BLAST as the result.

Special ratings for pitchers can appear after P1–P4 ratings or after SN, DL, TE, and HM ratings.

The special rating PG indicates a grounder to the pitcher and an out at first. When the PG special rating comes up as a result, only forced runners advance. HB indicates a hit-by-pitch. BK indicates a balk. If bases are empty when BK occurs, ignore the BK and get an "–" result.

DP indicates a double play if less than two are out and a runner is on first. Otherwise, ignore the DP result and get a "–" result. If DP comes up and a runner is on first, assign a 6-4-3 double play if the batter is batting right. Assign a 4-6-3 double play if the batter is batting left. A runner on third scores. If the infield is in on the grass, ignore the DP result and get a "–" result.

Some players have ratings like BL24ON (resultsymbol-number-resultsymbol). See 3 on FIG. 1. If you were checking Clemente's B2 rating of "d," and "d" was not underlined on the result card, you would use the BL24ON rating. Take another card and get a number from the random box (second box from left at top of card). See 24 of FIG. 109. If the number is 24 or less, use the BL symbol. If the number is greater than 24, use ON as the result symbol.

These are the basics of Ninth-Inning Rally, but there can be more to it.

The Advanced Game

When you play the advanced game, use the ratings under "Adv Batting" on the batter's card and "Adv Pitching" on the pitcher's card. In addition, use the situational ratings.

Situational Ratings (Advanced Game Only)

Situational ratings reproduce a batter's abilities against right-handed pitching, left-handed pitching, and his clutch hitting ability. They reproduce a pitcher's ability in the clutch as well as his stamina and, with great accuracy they reproduce his ERA. They do so by turning some hits and walks into outs. Here is a quick look at the play sequence for the advanced game:

1. Try to obtain a result symbol (ON, TROUBLE, DEEP TROUBLE, BLAST, BB, SO, DP, GB, FB, PG). If you fail, get a "–" result.
2. If the symbol indicates a possible walk or hit (BB, ON, TROUBLE, DEEP TROUBLE, or BLAST), check situational ratings. If the situational test fails, get a "–" result.
3. If the result still indicates a possible home run, check the park rating to see if the ball clears the fence. If the ball fails to clear the fence, it is caught by an outfielder.

The following steps walk you through the sequence:

1. Try to obtain a result symbol as in the basic game. Obtaining a result symbol represents a batter getting a pitch that looks hittable or not.
2. If the result is ON, TROUBLE, DEEP TROUBLE, or BLAST, take another result card. Suppose Roberto Clemente is batting against a left-handed pitcher with the bases empty. You have obtained the result symbol ON from checking whether Clemente's B I rating is underlined at the top of a result card, and you take another result card. See FIG. 32.

Look for the words "Check BSR or PSR" on the result card, shown at 16 in FIG. 32. You find those words, so you check the situational rating on Clemente's card.

You get the "normal/hp" rating from Clemente, which is "d," at 5 in FIG. 1, and locate the rating in the string of letters on the same result card, at 15 in FIG. 32. ("Normal" means a runner is not in scoring position, not on second or third.) On the result card, the rating appears to the left of the split in the string, so the ON result symbol is valid.

Take a result card and look up the ON result, probably a single. If Clemente's "normal/hp" rating were a "m," which appears right of the split on this result card, the ON result would be invalid. You would take a card and use the "–" result, probably an out.

When you find the words "Check BSR or PSR" and you look up a situational rating, if you obtained the result symbol from the batter's card, get the situational rating from the batter's card. If you obtained the result symbol from the pitcher's card, get the situational rating from the pitcher's card.

3. Suppose there is a runner on first in the first inning. Sandy Koufax is pitching. You draw a result card. See FIG. 89.

Because P2 is in the upper left of the card in FIG. 89, at 21, you check the P2 rating of Koufax, shown at 8 in FIG. 2.

The P2 rating for Koufax is "i," and "i" is underlined on the result card, at 22 in FIG. 89, and the ! result is a BLAST. You take a result card. See FIG. 95. On the card, you look for "Check BSR or PSR" but those words are absent under the string of letters, at 23 in FIG. 95, so the situational test is done. The BLAST is sailing deep into the outfield.

4. Only one step remains. Check if the ball clears the wall of the park where the game is being played. Take a result card and look for the words, "on BLAST, check park." See FIG. 70. You find those words, at 20 in FIG. 70, so you check the park rating, in FIG. 5.

Find the rating for the park on the park list, and see if the rating is left of the string of letters on the same result card. Since you are playing this game in the Dodger Stadium, the park rating is "o" and "o" is right of the split in the string, at 19 in FIG. 70, so the ball has cleared the wall for a home run.

Now you have the idea. If you need a refresher at any time, refer to the following summary of the play sequence for the advanced game:

1. Try to obtain a result symbol (BB, ON, TROUBLE, DEEP TROUBLE, BLAST, SO, DP, GB, FB, or PG). Obtaining a result symbol represents a batter getting a pitch that looks hittable or not.

Take a result card and get the batter or pitcher rating indicated in the B/P box in the upper left. (A capital rating such as "A" matches either "A" or "a.") If you are checking a B 1–B6 rating or a P1–P4 rating, and the rating is underlined at the top of the result card, your result symbol is on the ! line. If the rating is not underlined, obtain any result symbol that appears after the B or P rating on the batter or pitcher card.

If the rating in the B/P box is SN, DL, TE, HM, SG, DB, TL, or HR, test the rating as described in the section "Testing a Rating Against a Result." If the test succeeds, use the result symbol on the ! line. If the test fails, obtain any result symbol that appears after the rating on the batter or pitcher card.

If the result symbol is PG, DP, GB, or FB, see the section "Special Ratings" and the section "Special Ratings (Advanced Game Only)."

If the result symbol is SO, the batter strikes out. If you do not have a result symbol yet, take a card and use the "–" result, usually an out. If the symbol indicates a possible walk or hit (BB, ON, TROUBLE, DEEP TROUBLE, or BLAST), take a card and check situational ratings as follows.

2. Do the words "Check BSR or PSR" appear under the row of letters at the top of the result card? If not, does the word "Visitor" appear under the row of letters? If it does and the batting team is the visitor, take another card and use the "–" result.

If you see "Check BSR or PSR" and the first result card asked you to check a batter's rating (B1–B6, SG, DB, TL, or HR) check if the batter's situational rating appears right of the split in the row of letters on the card where you read "Check BSR or PSR." If the first result card asked you to check a pitcher's rating—P1–P4, SN, DL, TE, or HM—check the same with the pitcher's situational rating. (Hint: "a" is always left of the split. "p" never is.) If the rating is right of the split, take a card and use the "–" result. If the rating is left of the split and your result symbol is BB, the batter walks. If the rating is left of the split (or you were not asked to check situational ratings) and your result symbol is ON, TROUBLE, or DEEP TROUBLE, take another card and look up that result, usually a hit. If the result symbol is BLAST, the ball is sailing deep towards the outfield wall! Whether it goes over the wall depends on how far away the fences are. Check the park rating as follows.

3. Take a card and see if the words "on BLAST, check park" are under the row of letters, and if they are, check if the park rating (the rating for the park you are playing in) is right of the split. If it is, the result is a flyout. If not, the result is a home run. (See the section "BLAST Results.") Take a card and find the details of the BLAST.

Note: Suppose you are looking up a B1 rating. On the batter's card you read, "B1 a BL." On the result card, "a" is underlined, and it leads to an ON result. You check a BSR to see if the batter gets a single, but due to the situational rating the batter gets a "–" result. You would use the "–" result, and ignore the BL that appeared after the batter's B1 rating. Only use special ratings after a batter or pitcher rating is NOT underlined. When you check a batter's situational ratings, "normal" means second and third are empty, "clutch" means a runner is on second or third or both. The word "rhp" or "lhp" means the batter is facing a right-handed or left-handed pitcher, respectively.

When you check a pitcher's situational rating, look in the cell of the table corresponding to the base situation and the inning. The "1$^{st}$ only" column applies if there is only one runner and he is on first. The "clutch" column applies if a runner is on second or third or both. For a starting pitcher, the inning labels refer to the inning of the game. For a relief pitcher, the inning labels are usually "r1, r2, and r3-." These refer to the first, second, and third (on up) innings pitched. If a reliever takes over with two outs, use the r1 rating for the next inning also. If a pitcher is both a starter and a reliever, he usually has the inning labels of a starter. When he relieves, use the same inning labels to refer to the inning pitched after he entered the game. For example, if the reliever entered in inning 4, a "1–6" column would apply to innings 4–9. If a relief pitcher starts, use the r1 and r2 ratings for the first and second innings and use the r3 rating for inning 3 and after.

If a player has no situational ratings at all, there are none to apply for him, so ignore the situational rating feature when it comes up. (You would still apply any situational ratings for the batter or pitcher opposing him.)

On a batter's card, the "vs. RHP" percentage indicates how often the batter faces right-handed pitchers in his total at bats. If you use the percentage as a guideline for each batter (the league average is 75%), you will get more realistic results.

Important: There are only three instances in which you refer twice to the same result card. (1) When you loot up a batting or pitching rating such as B2 or P3, check for the underlining on the SAME result card that had the B or P in the upper left corner. (2) When you check a situational rating or a park rating, look for the split in the string on the SAME result card where you found the words, "Check BSR or PSR" or "on BLAST, check park." (3) When you look up a base stealing result, you first check the steal box, then if necessary you check the close play box on the SAME result card. In all other instances, take a DIFFERENT result card for each check you perform.

BLAST Results (Advanced Game Only)

When looking up a BLAST result you might find the following result. This result is on FIG. 65.

deep drive to power field, HOME RUN 25', 30HR:power-center 1'

You would read "deep drive to power field." The possible locations are as follows:

| Location | Right-Handed Batter | Left-handed Batter |
|---|---|---|
| power field | leftfield | rightfield |
| power-centerfield | leftcenterfield | rightcenterfield |
| opposite-centerfield | rightcenterfield | leftcenterfield |
| opposite field | rightfield | leftfield |

If the result is a flyout, runners on second and third advance.

If the result is a flyout to leftcenter or rightcenter, assign the flyout to the centerfielder.

If the result is a home run, a footage result indicates how far past the wall the ball was when it dropped below the fence or landed.

Even if the park rating indicates a home run result, the ball still may be caught. See the following BLAST result. This is the BLAST result on the card shown in FIG. 89:

deep drive to power field, HOME RUN 35', 10HR:center CH:leaping catch at wall or 1'

You read this result "deep drive to power field," then take another card and check the park. Based on the park rating, a flyout might result. However, if a flyout does not result from the park rating and if the batter hit more than 10 HR in the season (see the statistics at the bottom of the batter's card), you would perform a CH test on the centerfielder to see if the ball was caught at the wall. On the following result, you would use the table above to decide which outfielder tries for the catch. This is the BLAST result shown on the card in FIG. 98.

deep drive to power field, HOME RUN 50', 10HR:opposite-centerfield CH:leaping catch at wall or 1'

Special Ratings (Advanced Game Only)

The split-fingered fastballs of Bruce Sutter produce grounders. The rising fastballs of Nolan Ryan produce flyouts. Examine FIG. 3.

Suppose you are checking the P2 rating for Bruce Sutter and the P2 rating of "b" is not underlined on the result card. In this case, use the special rating GB (groundball) that appears on the P2 line. At 10 of FIG. 3. The rating GB means that the result must be a ground ball out. To find the final play result, take the next result card and use any result labeled GB near the bottom of the card. If you find a FB result instead, use the "–" result as the play result.

A fastball pitcher such as Nolan Ryan may have an FB rating. When the FB rating comes up, the result is aflyball out. To find the final play result, take the next result card and use any result labeled FB near the bottom of the card. If you find a GB result instead, use the "–" result as the play result. In some cases, the FB result turns up a ground ball double play (GD) test. Perform the test.

Routine Outs

On a "–" result, if a flyout or a groundout occurs and the play is at first, the play at first is not specified. On any fly ball that occurs on a "–" result, assume the result is an out unless told otherwise. On any grounder that occurs on a "–" result, assume the result is an out at first unless told otherwise.

Runner Advance Results

Here are the different advances that can occur:

| | |
|---|---|
| 2A | runner on second advances one |
| 3A | runner on third advances one and if the play is an infield grounder, a runner on second also advances |
| A1 | all runners advance one |
| A2 | all runners advance two |
| A3 | all runners advance three |
| 2A2 | runner on second advances two |
| 1A2 | runner on first advances two |
| 1A3 | runner on first advances three |
| 2GA2 | with two gone all runners advance two |
| 2GA3 | with two gone all runners advance three |
| 2G2A2 | with two gone, a runner on second advances two |
| 2GA3 | with two gone, a runner on first advances three |
| CP | runner involved in a close play if he tries to advance and if the defense throws the ball |
| CPB | batter involved in a close play |
| 1PL | there may be a play for a runner from first advancing |
| 2PL | there may be a play for a runner from second advancing |
| 3PL | there may be a play for a runner from third advancing |
| PLB | batter will try to advance if the runner goes |
| BA2 | batter advances two |
| BA3 | batter advances three |
| R1 | result if a runner is on first |
| R2 | result if a runner is on second only |
| R3 | result a runner is on third |
| R-12 | result if runners are on first and second |
| full | result if bases are full |

On infield grounders, several types of runner results can appear, in the following order:

1. A result for a runner on first.
2. A result for a runner on second who is the only baserunner.
3. A result for a runner on third, forced or not.

Here is a sample runner result on a ground ball. It shows the three types of runner results:

grounder gloved by secondbaseman, AR:4-6-3 DP 3A, CH:R2:hold, 3A

The first result is for a runner on first. AR: means to test the AR rating of the secondbaseman (4 is the first player listed after AR:) for a DP. See the section "Testing a Rating Against a Result." On the DP attempt, a runner on third scores. If the test succeeds, the result is a 4-6-3 DP. If the test fails, the result is a 4-6 FC. (On a ground ball, a failed AR test for a DP is always an FC. A failed AR test for an FC is always an out at first.)

The second result, CH:R2:hold, is used when there is a runner on second only.

The third result, 3A, is for a runner on third, and in this example it is only used if a double play attempt does not occur. An unforced runner always holds third unless the play result indicates he advances. A forced runner tries to advance.

If runners are on second and third only, a 3A result on a groundball out indicates that both runners advance.

You can always throw to first. For example, if there is a play at third and two are out, you would throw to first for the easy out.

You can always choose between using a result for a runner on first and a result for a runner on third. However, if the infield is playing in on the grass, always use the Infield In or Comers In table, described later.

Observe the following rules to determine runner advance on infield grounders:

1. A forced runner always tries to advance. If no play for the runner is indicated, he advances.
2. An unforced runner always holds second or third unless the play result indicates he tries to advance.

Whenever the defense tries to turn a groundball DP (for example: 6-4-3 DP 3A or AR:4-6-3 DP), a runner on third scores only if "DP" is immediately followed by "3A." On the following result a runner on third does not score on the double play attempt: "groundball to second AR:4-6-3, 2A, 3A." In this example, "3A" is the result for a runner on third if no DP is possible.

Testing a Rating Against a Result

A two-letter rating name followed by a colon (as in AR:) means that you need to test a letter rating against a result. For example, if a grounder is hit with a runner on first and the result is AR:4-6, test thesecondbaseman's AR rating to see if an out at second occurs. Perform the test by taking another result card and reading the result in the chances box. If the BAR rating for the fielder contains the result on the result card, the player wins the test.

Note: If the result is a + or an * and the player's rating is +*, he wins the test. The only possible results in the chances box are + and 1. Thus, a player's rating of +* always wins a test and a blank player's rating never wins a test, so in these cases you do not need to take a result card and check.

If a player's rating wins the test, use the first result shown. For example, if the test is AR:4-6-3 DP or 4-3 and the secondbaseman wins the AR test, the result is a double play. If the secondbaseman loses the test, the result is 4-3. In obvious cases, you may find no second result given. For example, "AR:R2:holds" means that if the fielder wins the test, the runner on second holds. If the fielder loses the test, the runner on second advances.

Here is another example: R3:SD:3-1 or 3-2. If a runner on third wins the SD (speed) test, he is safe at home and the batter is out at first 3-1. If the runner loses the test he is out at home 3-2. When an SD test is indicated, only perform the test on the runner involved in the play.

Another example is ER(c):drops pop. This means if the catcher's ER rating wins, an error occurs.

If two tests are indicated, as in AR:SD:4-6-3 DP, do the first test and if the test leads you on to the second test, do the second test also. In this example, do the AR test first to see if the fielder can try for a double play, then do the SD (speed) test on the batter to see if the batter beats it out. (On any test for a ground ball DP, SD means to test the batter unless otherwise indicated, as in AR:SD(R1):4-6-3 DP, which means to test the runner on first.)

The result SD:A2 on a single means test for each runner advancing, starting with the lead runner.

If a grounder to the pitcher or firstbaseman or thirdbaseman occurs with two out, assume an out at first occurs (1-3 or PO 3). If a test for an FC (as in AR:SD:4-6) occurs with two out, assume an out at first occurs. If a test for a DP (as in AR:5-6-4 DP) occurs with two out, assume an FC occurred. In these cases, avoid performing a test.

What to Do If No Result Appears

If you take a card and do not find the result you were seeking (for example, you look up a !? result and it is apickoff, but no runners are on base), take another card.

Pitchers Batting

When a pitcher bats, use the Pitcher's Batting Card. Each pitcher card contains a situational rating for use whenever a BSR rating is called for with that pitcher at bat. Each pitcher card contains an HR rating for use when that pitcher is at bat.

Various Results

The following table gives an explanation of various results that appear on result cards.

| Result | What to Do |
|---|---|
| check WP, BK or PB rating (see 25 on FIG. 117) | If you are taking the first result card for a play, you may find instructions in place of the row of letters at the top of the card. In this example, take a card and read the pitch box, which tells you which rating to test. For example, PB + means that if the PB rating of the catcher has a plus (+) the result is a passed ball. If the "check WP . . . " card occurs after you have taken the first result card on a play, ignore it. Similarly, use "pickoff attempt . . . " cards only if one comes up as the first result card on a play. Ignore these results at the top of a result card if you are using a tactic, such as stealing or bunting. |
| GD:5-4-3 DP 3A or fly to deep center (see 34 on FIG. 84) | If first base is empty or two are out, ignore the GD test. If the infield is in on the grass, ignore the GD test. |
| HM(pitcher):BLAST, low HR batter:get – result (see 35 on FIG 114) or BL special rating on a pitcher's card | If the words "low HR" appear on a batter's card, he cannot hit a home run from the HM rating on a result card. Get a "–" result instead. |
| TL(batter):DEEP TROUBLE, zero triple batter or pitcher: get – result (see 36 on FIG. 69) or TP(pitcher):DEEP TROUBLE, zero triple batter or pitcher: get - result (see 37 on FIG. 113) | If the words "O TLs" appear on a pitcher's card below the HM rating, or if the batter's TL total was 0 for the year, the batter cannot hit a triple against this pitcher. Get a "–" result instead. |
| or any DT special rating on a batter's or pitcher's card | For slightly more accuracy, you can treat HBPs in the same way and use a "–" result instead of a HBP if a pitcher or batter has 0 HBPs for the year. The words "0 HBPs" appear on the cards of pitchers and batters who have totals of 0 HBPs for the year. |
| liner by thirdbaseman into left, CH(3B*):diving stop or SINGLE SD:A2 (see 38 on FIG. 15) | Check the thirdbaseman's CH rating. If it contains the rating *, the result is a diving stop and if the bases are empty, an out at first. (Both * and +* contain the rating *.) If runners are on base when a fielder takes away a hit, see the Great Play table for runner advance results. When a ball is stopped by an infielder, assume the ball hit the ground unless you are informed otherwise. |
| grounder to first base, CH( ):SINGLE A2 or scooped, AR:3-6-3 DP 3A or 3-6, if first is empty or two out PO 3, R2:CH:hold, full:3-2-3 DP (see 39 on FIG. 21) | Check the firstbaseman's CH rating. If it is blank, the ball is through for a single and runners advance two. |
| rhb:liner to leftfield lhb: liner to rightfield. (see 40 on FIG. 103) | For a right-handed batter, use the rhb result. For a left-handed batter, use the lhb result. If you know that a right-handed batter hits like a lefty, use the lhb: result. |
| fly to deep center, centerfielder collides with wall, ER(cf):CP 8-6-5 at home for inside-the-park HOME RUN or TRIPLE (see 41 on FIG. 19) | On any close play (CP), the offense can choose not to try to advance (unless forced) and the defense can choose not to throw. If both decide to try for it, take a card and check the close play box. Thrower, runner, or baseman will be followed by a + or *, so perform the test indicated. Test the thrower's AR rating, the runner's SD rating, or the baseman's CH rating. On a CP (close play) test, |

-continued

| Result | What to Do |
|---|---|
| | the first result listed, as in this example, is the out result. Use whichever result applies-if a thrower or baseman wins, use out, if runner speed wins, use safe. |
| SH:toward first CPB, A1, or misses pitch, CRN:lead runner out on FC (see 42 on FIG. 22) | On this sacrifice bunt attempt, the SH means test the batter's bunting ability and CRN is the result with corners in. See the section "Bunt, Safety Squeeze, Suicide Squeeze, and Pull the Corners In." CPB means the batter is involved in a close play, so proceed as for CP (explained immediately above). |
| fly to center, 3PL 8-2 DP (see 43 on FIG. 89) | See the section "Throwing to Get the Runner." |
| grounder in the hole to left, SINGLE 2PL 7-2 1A2 PLB 7-5-4 2GA2 (see 14 on FIG. 19) | See the section "Throwing to Get the Runner." |
| ER(1b):grounder, misplay receiving throw, see Outcome table see 44 on FIG. 22) | Test the ER rating of the firstbaseman for an error. If an error occurred, take another card and get the number in the random box. Use the random number to look up a result in the Outcome table. |
| bouncer to firstbaseman ER/EB:bobble, see Outcome table or use - result on this card (see 45 on FIG. 20) | Take a card and read the ER/EB box. For example, ER + means to check the ER rating of the firstbaseman. EB + means to check the EB rating of the firstbaseman. If his ER or EB rating wins, he bobbled the ball, so see the Outcome table. If his ER or EB rating loses, use the – result on the same result card for the out. |
| liner to left/to right, SINGLE 2PL 7-2/9-2 (see 46 on FIG. 29) | The results after the slash is for a left-handed pull hitter. Whether a hitter pulls the ball is indicated at the top of his card by the word "pulls." |
| runner out on pickoff play, invent play details, see Pickoff table (see 48 on FIG. 41) | The fielder with the ball has caught the lead runner off base. See the Pickoff Table and follow the instructions there. |
| WP *:SD (see 47 on FIG. 36) | Perform the WP test and if it succeeds, perform the SD test on each runner, starting with the lead runner. Some may advance, others may not. |
| check PT rating (see 49 on FIG. 120) | If you are taking the first result card for a play and the pitcher has a PT rating, use it. For example, if "PT BK+*" is the rating, a balk occurs. The result "PT WP +*" indicates a wild pitch, runners advance one. The result "PT PB:+" indicates that you perform a chances box test with the rating + to see if a passed ball (runners advance one) occurred. If the pitcher has no PT rating, but the catcher does, use the PT rating of the catcher. If both the pitcher and catcher have PT ratings, use the pitcher's PT rating. |
| !? result (see 50 on FIG. 109) | Take another card and use the !? result. If the !? does not fit the circumstances (for example: a triple play with bases empty), take another card. |
| pickoff attempt at choice of second or third, CP(p):pickoff (see 51 on FIG. 116) | Take a card and check the close play box. Thrower, runner, or baseman will be followed by a + or *, so perform the test indicated. Test the pitcher's MV (move) rating, the |

-continued

| Result | What to Do |
|---|---|
| | runner's SD rating, or the baseman's CH rating. Then see the Pickoff Table for more play details. |

Pickoff

Use the Pickoff table, shown in FIG. 7, to get the final result when any pickoff attempt CP yields an out result. This table can change an out to an error. Take a result card and get a random number from the random box. Use the number to look up a result in the pickoff table.

If the result was "runner out on pickoff play, invent play details," add the pickoff to the play that preceded. Remember that any fielder can pick a runner off base. An outfielder or infielder can snap a surprise throw at the end of a play, whether an out or hit, to catch a runner (including the batter) off base if the runner has rounded the base and gone too far. Outfielders usually catch runners off first or second. Avoid assigning thepickoff to the pitcher.

Rundown

Use the Rundown table, shown in FIG. 7, when instructed to do so by the Pickoff table. The letter "t" means the fielder who started the pickoff. Take a result card and get a random number from the random box. Use the number to look up a result in the rundown table. The left column of the table indicates the base the caught runner occupied.

Invent Play

Whenever it can affect the outcome of the game if the home team rather than the visiting team invents the play, use the Who Invents Play column of the Invent Play table, shown in FIG. 9. This table ensures that the creativity of the play inventor will not be restricted by his self-interest as a competitor whose main object is winning a game.

Use the End Result column of this table only when the result is "invent play details" (see 52 on FIG. 29) with no further information given. In this case, obtain a random number to find out who invents the play. Obtain a second random number to determine the end result of the play.

The player who invents the play must attempt to satisfy requirements in the order given until they are satisfied. You can add errors to what is specified here. Avoid exceeding the specified number of runs or outs. The rest is up to you. This is your opportunity to see to it that every possible play can occur in a game.

For information on "pickoff play, invent play details," see the section on Pickoff table.

Note: On a bunt, do not score the batter unless either three or four runs are allowed to score.

When the result is Invent Play Details, the result usually specifies some of the play details for you. In this case, avoid using the Invent Play table. Whatever is not specified you must invent on your own. Avoid adding outs or runs to what is specified. For example, if DOUBLE is specified and a runner is on second, the runner scores, but avoid advancing the batter beyond second on your own.

If the result is "argument, invent play details," "bat breaks in half, invent play details," "collision, invent play details," or "fielders asleep, runner from first or second tries to advance, CP", start the play procedure over and add the event to the next play. If it not possible to add a collision to the next play, add it to the first play on which it is possible. In the case of "fielders asleep, runner advances," here are some possibilities: a delayed steal, an advance on a fly, an advance from first to third or third to home on a ground ball out at first, or an advance from first to home on a single.

If the result is "invent double play," the defense must invent an unusual double play.

Ejection

If the result is "argument and ejection," use the Ejection table, shown in FIG. 10. Attach the argument or fight to the result of the previous play if possible. If not, invent a reason for the dispute. Take a result card and get a random number from the random box. Use the number to look up a result in the Ejection table.

Great Play

If an ON, TROUBLE, or DEEP TROUBLE result turns up a CH test that produces an out and no runner results are given, use the Great Play table, shown in FIG. 11, to determine runner results. Take a result card and get a random number from the random box. Use the number to look up a result in the Great Play table.

In the table, "shallow" and "deep" indicate that the words "shallow" and "deep" must appear in the play result. If the infield is in, use the Infield In or Comers In table in place of the Great Play table.

Outcome

The purpose of the Outcome table, shown in FIG. 12, is to fill in interesting play details on error plays and a few other plays when the result cards give less than fall information. Take a card to get a random number and use the number to look up information. For example, assume that a runner is on first when the following play occurs:

HIT/ERROR throwing misplay by infielder, invent play details, see Outcome table This play requires you to find who made the bad throw. Use the first row of the Outcome table to find out what the play was. Whenever a lookup gives you an unlikely result, such as a ground ball with a runner on first and a play at the plate, move rightward in the row (and when you reach the end, start over at the left end) until you arrive at a better result. Get another number and use the second row of the Outcome table to find who threw the ball. (An entry like P/LF means consider the pitcher, then if pitcher is inappropriate, consider the secondbaseman. If both were inappropriate, you would consider the C/CF next.) Then take another number and use the second row to find who received the ball. Assume that no hit occurred unless one is specified.

Also, use the Outcome table to lookup information when agroundout or flyout or no clear play results from an error test. For example, on a grounder, if an error test does not result in an error and no other result is specified, assume an out at first occurred. In this situation, use the fifth through seventh rows under INFIELD PLAYS to determine runner advance. For example, assume that a runner is on first when the following play occurs:

HIT/ERROR ER(1B):grounder, misplay receiving throw, see Outcome table

Perform the ER test for the firstbaseman. If no error results, use the fifth row under INFIELD PLAYS to find out if an FC at second preceded the throw to first. Take a random number. A number between 1 and 72 means an FC occurred. As for who threw the ball to second and then to first, this is up to the defense because its choice does not affect the number of outs or runs. If it could, you would need to use the first row of the Outcome table to find this information.

Injury

When the injury result occurs on a !? result, obtain a random number and look up the player injured in the Injury table, shown in FIG. 13. Obtain another random number and look up the duration.

If the type of injury is unknown, obtain another random number and look it up in one of the Type of Injury tables, shown in FIG. 14.

To invent the play on which the error occurs, run the next play through. Then alter it so that it involves the player who gets injured and make the same number of runs and outs occur as occurred on thenoninvented play.

Obtain a random number and look up the duration in the Injury table. No player can miss so many games that he misses more than ten games more than his quota of missed games. You are the expert here. Total the number of games you would expect him to miss in your season, add ten, and that is the player's limit. For example, if you would expect a platoon player to miss forty games out of sixty remaining, his injury limit is fifty (forty plus ten).

Having calculated a player's limit, calculate how long he stays out. Obtain a random number A player with a short-term injury misses the number of games equal to the random number divided by seven, ignoring any remainder. A player with a medium-term injury misses the number of weeks equal to the random number divided by eight, ignoring any remainder.

You can treat an indefinite-term injury as a medium-term injury, or you can use the following optional rule in your league: A player with an indefinite-tern injury is out for at least a month. At the end of each month, draw a random number. If the number is between 1 and 11, he returns after one more week. If the number is between 12 and 22, he returns after two more weeks. If the number is between 23 and 33, he returns after three more weeks. If the number is between 24 and 44, he returns after four more weeks. If the number is between 45 and 114, he is out for at least another month. As soon as his limit is reached, however, he returns automatically.

If a player is out for the season, he misses the number of games that his limit allows.

You may decide to treat "out for the season" differently. You may want to ignore the limit on games missed and lei, "out for the season" apply to any player other than your eight starting hitters, four starting pitchers, and stopper. You may want to let it apply only to players who normally play in a small number of games. Or only to any player who sat out the entire season in a past year on the real diamond. In that case, you may lose your best home run hitter or your best pitcher. Very realistic.

Fielding Ratings

Each team has a fielding card, which has the ratings for an entire team. See FIG. 4. Fielding ratings are also on the batter cards for use if you trade players from team to team. See 6 on FIG. 1. Use the GS (games started) statistics on the fielding cards as guidelines for how often to use players at different positions. Fielding ratings for pitchers are on the pitcher cards.

Pitcher Longevity

To prevent pitchers from pitching after they get tired, use the longevity (L) value on the card of starting pitchers. See 9 on FIG. 2. For a starting pitcher, when the total bases on hits and walks (for the batters, not the runners) given up in a game approach the longevity value, remove the pitcher. Use the longevity value only as long as it helps pitchers attain their real-life number of complete games. The value is the number of total bases per start, plus two, to give some leeway. A, similar rating is also given for relievers for use as a guideline for how long they should pitch.

Shuffling

Shuffling occurs automatically, as you discard into two piles, so there is no reason to shuffle cards in the usual way.

Tactics

The following tactics are available to each manager. To use a tactic, state your intention before a result card is drawn to start a play.

If you are playing the game alone, you need to decide whether the other team will counter your tactic (for example, play the comers in to counter your bunt). If your tactic is expected, assume the defense counters it. If your tactic is unexpected, assume not. If you are not sure, take a random number. A number between 1 and 57 indicates the defense is countering your tactic.

Steal a Base

To steal a base, indicate which player is stealing and proceed as with any CP result because a steal attempt is a close play. If two or more are stealing, the defense can throw for any runner who is stealing. The steal box may contain additional information about the steal attempt. If the steal box (a pickoff attempt, for example) yields no steal, out, or error result, use the CP result on the SANE card for the steal result, unless otherwise instructed. When using the CP result on a steal attempt, if instructed to check a runner rating, use his SL (steal) rating, not his SD (speed) rating.

Assume that the shortstop covers second against left-handed betters, the secondbaseman against right-handed batters unless you know better. For example, if an opposite-field hitter such as Wade Boggs is batting, you can make adjustments.

If asked to check a thrower's rating on a steal of home, check the pitcher's AR rating.

See the following example result:

on steal of second test

MV for out at second, but out at third or home

Test the pitcher's MV rating to see if the runner was out stealing. This is an ordinary steal attempt and the throw goes from catcher to second or shortstop.

If a WP or PB occurs on a steal attempt, give the runners a stolen base and perform an SD test on the lead runner to see if the runners advance another base.

If more than one runner is stealing, the defense can throw for any runner. If one is safe, all others are safe.

Bunt, Safety Squeeze, Suicide Squeeze, and Pull the Corners In

The defense can defend against any bunt by announcing before the offense calls the bunt that it is playing the corners in.

To bunt, take a card, read, and look up the SAC BUNT or BUNT FOR A HIT result. You can use the bunt for a hit tactic only once per at bat. You may need to check the batter's bunting ability to get the play result. If a bunter's B1 rating (P1 for a pitcher) is a capital letter, the batter is a good bunter. For a good bunter, use any SH: result that appears as the play result.

You can try to SAC BUNT a runner to second without advancing the runner on third.

If the defense has pulled the corners in, or if the defense has played the infield in on the grass, use any CRN result that appears. (If more than one result applies, such as both SH: and CRN:, use the last result in the sequence.)

If a player is in for the bunt, the batter may happen to swing away. If the batter swings away, on any ball hit to a player who is in, use the Infield In or Corners In table to see if a single occurred (see FIG. 8). Otherwise, use the normal play result.

If a runner is on third, the offense can try a safety or suicide squeeze. On a safety squeeze the runner on third wait, until the ball is bunted before heading home. On a suicide, the runner breaks with the pitch. To try a safety squeeze, call it and use any SFT result that appears. To try a suicide squeeze, call it and use any SUI result that appears. If no SFT or SUI result appears, use the result you see as is. A safety squeeze has less of a chance of scoring the runner, but if the corners are back, and if a pitcher is batting or if your chances of scoring are poor whatever you do, you might consider it.

If the batter misses a suicide bunt, the runner on third must try to steal home.

You can bunt for a hit with runners on base. If the result of bunting for a hit is "lead runner out" and the bases are empty, the batter is out.

Hit and Run

If a runner is on first only, second only, first and second only, or first and third only, the offense can choose to have the batter try a hit-and-run. If runners are on first and third, the runner on third does not break with the pitch so he receives no running advantage on the play. You can use the hit and run only once per at bat. Use the HIT & RUN result on the result card. If the result is "get play result," take another card and go through the usual procedure to get a play result, but use the Hit and Run table, shown in FIG. 6, to determine runner advance:

If the result is "get play result and ignore Hit-and-Run table," get a result as if the hit-and-run were not on.

If the result is "– result," take the next card and use the – result. Use the runner advance results shown in the table.

If the batter missed the pitch, go through the steal procedure for the any runner the defense chooses to throw for, and if there is another runner, he advances.

Ignore this table if HIT/ERROR is the result.

You can use the swing for a single tactic on the hit-and-run to offset the tendency of the hit and run to reduce batting average because the batter often swings at a bad pitch.

Swing for a Fly

The offense can try and hit a fly ball to score a runner from third. The offense can only swing for a fly if the batter's B2 rating is an uppercase letter, which indicates that he has sacrifice fly ability. To swing for a fly, take a card. If a string of letters containing a gap between two letters appears at the top of the card, the batter has hit the ball in the air. Take a card and use the FB result if it is a pop or fly. If not, take cards until you find one. If the batter does not succeed in hitting a fly ball, restart the normal play sequence.

Hold Runner

Whenever a CP comes up and the runner is not forced, the offensive team can hold the runner instead of trying to advance.

Throw to Get a Runner

A PL result indicates that there may be a play for a runner advancing an extra base or advancing on a fly. A PLB result means that the batter will try for an extra base on the throw if the runner tries to advance. On a PLB result, the defense must decide whether to cut off the throw for the runner and try for the batter.

In the eighth and ninth innings, the offense can choose to hold any runner on a PL result, avoiding any play at all. If a PL result occurs in innings one through seven, or if the offense decides not to hold runners, take a card and examine the outfield box. Obtain a random number and use the Outfield Assists table, shown in FIG. 8.

On any ball hit to the outfield, if the result for a runner on second is has a 2PL result, a runner on first can try for third on the throw. If the throw goes through to the plate, the runner on first advances to third. However, the defense can cut off the throw and try for the runner at third (test a throw for that runner instead). Usually thefirstbaseman cuts off a throw from right, the thirdbaseman cuts off a throw from left (unless he must cover third), and the pitcher cuts off a throw from center or left.

If two PL results are included in the same result, as in "fly to left 2PL 7-5 DP, 3PL 7-2 DP," use the outfield box only once to cover both PL results. For example, if the outfield box gives you an AR result, both runners take off. The defense must decide which runner to throw for.

If two throwers are involved on a play, as in 9-4-1-5, and the CP result reads "thrower," check the first thrower. If a CP result reads "thrower/relay man," check the relay man if there is one on the play.

If the result of a play will be a runner on third with two out (not a very useful situation), the offense has the option of holding a runner on second when 1PL results on an outfield single.

If a PLB appears without a PL (for example: DOUBLE A3 R1: PLB 7-6-1-5, which means if a runner was on first he scores and the batter tries for third on the throw), use the outfield box and the table in this section to get the result for the batter.

Ignore a PLB result if there is no runner on base to try for an extra base and draw a throw.

Pull the Infield In On the Grass or Pull the Corners In

When a runner is on third, the defense can play one or more infielders in close to increase its chances of throwing out a runner trying for the plate on a ground ball. If the defense is playing an infielder in and a grounder is hit to him, use the Infield In or Corners In table, shown in FIG. 8. Obtain a random number and use the number to look up a result. Avoid using this table after a HIT/ERROR result or after any error test. Use this table when appropriate on a hit-and-run, along with the Hit-and-Run table, shown in FIG. 6. Ignore any GD result on the result card.

Pull In the Outfield

With zero or one out and the winning run on third in the last half of the ninth inning, the defense can play the outfield in.

1. If the play result indicates a deep flyout, including any flyout resulting from a BLAST that stays in the park, it becomes a single and the runner scores the winning run.
2. If the play result indicates a line drive or fly single to the outfield, take a card to get a result from the chances box. A plus (+) indicates that the single was caught.

Note: Avoid overusing the following batter strategies. They are best reserved for clutch situations.

Swing for a Single

If a batter hit more than fifteen homers in a season, the offense can have the batter swing for a single, which reduces his chances of hitting an extra-base hit but increases his chances for a single. To swing for a single, when checking a BSR or PSR rating for an ON symbol, assume the split in the letter string occurs four letters right of where it actually occurs. For example, a split between letters "d" and "e" becomes a split between "h" and "i." When checking a TROUBLE, DEEP TROUBLE, or BLAST symbol, assume the split occurs four characters to the left.

Swing for a Double or Triple

The offense can have a batter swing for a double or triple. To swing for a double or triple, when checking a BSR or PSR rating for a TROUBLE or DEEP TROUBLE result, assume the split in the letter string occurs four letters right of where it actually occurs. For example, a split between letters "d" and "e" becomes a split between "h" and "i." When checking an ON or BLAST symbol, assume the split occurs four characters to the left.

Swing for a Homer

The offense can have a batter swing for a homer, which reduces his chances of hitting the ball but increases his chances of hitting a home run. To swing for a homer, when checking a BSR or PSR rating after a BLAST symbol, assume the split in the letter string occurs four letters right of where it actually occurs. For example, a split between letters "d" and "e" becomes a split between "h" and "i." When checking a TROUBLE or DEEP TROUBLE result, assume the split occurs four characters to the left. An ON symbol that results from a batter's rating becomes a strike-out.

Swinging for a homer may be useful late in the game when a homer is needed and the situation is so desperate that the chances of scoring a run in any way are poor, but you can use it at any time.

Conclusions, Ramifications, and Scope

The reader will see that the baseball game of this invention incorporates a large variety of characteristics of real-life baseball, which ranks with the largest in comparison with other games, and does so while providing rich natural language play descriptions. This is made possible by its highly efficient method of encoding player characteristics and highly efficient basic game-playing procedure. The efficiency of these features leads to a compactness which enables the game to incorporate many other desirable features that do not appear in other baseball games.

Player characteristics are encoded in non-numeric symbols, namely, in the letters of the English alphabet from "a" through "p" instead of numbers. The method of encoding player characteristics supports the encoding of several features into each symbol without subordinating the encoding of any one feature to any other. Since each letter "a" through "p" can be any of 16 different letters, this vastly increases the amount of information that the code (a letter) is capable of storing compared to the information that a digit, which can be only one of ten digits, is capable of storing. This baseball game uses a sequence of five letters to store any of $16^5$ or 1,048,576 possible sequences of information. Compare this with a sequence of five digits, which can only store at most only $10^5$ or 10,000 sequences of information. The method used in this baseball game avoids the limitation imposed by encoding player characteristics into 36 numbers each of which apparently facilitates the encoding of only one characteristic with accuracy.

The minimal play procedure is two steps shorter than in the games that use the van Beek design:

1. Take a result card and flip it over.
2. Read a symbol.
3. Use the symbol to look up a rating from a short list of four or six on a player's card.
4. Refer to the result card to see whether the player's rating is underlined.
5. Depending on whether the rating is underlined or not, look the play result up on the same result card in the ! or the "" row, respectively.

Because this minimal play procedure is repeated about 75 times per game, "two steps shorter" translates to 2*7=150 steps shorter over an entire game, or 33% less time devoted to the steps in the minimal play procedure, providing more time for the more enriching aspects of the game.

Together, the method of encoding player characteristics and the simple basic game-playing procedure reduce complexity for the game player, thus leading to the following additional advantages.

The statistics of real-life baseball players including earned run averages of pitchers are reproduced with great accuracy. The reason for this twofold: the compactness of the game structure leaves room for the incorporation ofsituational ratings for the pitcher that rate the pitcher on three different base situations and three different inning situations; the method for encoding the situational information for the pitcher encodes both the base situation and the inning situation into a single symbol. As a result, only one lookup operation is required to produce both situational effects.

Play-by-play results are arranged in a list with list item headers rather than placed in a table which has three or more column headers and thirty-six row headers. Use of the list makes it easier to look up play results. The reason for this is that it is easier to look up information in a list, using only an index into the list, than it is to look up information in a table using both a vertical index and a horizontal index. In addition, list elements are not numbered but are labeled with easy-to-read results such as "BUNT-FOR-HIT."

Features which in other games are included only by adding on more tables which require more table lookup operations are incorporated into the elemental structure of this baseball game. For example, other games may require two table lookup operations in sequence in order to produce a groundball or flyball out result. This baseball game requires only one "list lookup" unless the play is a hit and further detail of the play is welcomed due to the excitement it provides.

The playing procedure for producing outs is often easier than the playing procedure for producing hits. Thus, the experience of playing the game is one in which exciting plays are emphasized and dull plays aredeemphasized.

The procedures used to play the game are specifically designed for ease of use. For example, the sacrifice bunt, bunt for hit, hit and run, infield hit, and error results appear on the same result card where the out and hit results reside. Thus, the procedures for producing these plays usually do not require a different card or table to be consulted. The result card "has room" for these different plays because the result card is compact and thus does not "crowd out" the less commonly occurring plays.

Play results are distributed across 100 cards, which avoids the "36" limitation imposed by using two dice to produce two digits. See FIGS. 15 through 128. The baseball game provides over 100 distinct results of each type (single, double, and so on), which increases realism, allowing the inclusion of over 100 different singles, doubles, triples, and home runs, far more the total of approximately fifteen such different results in a game with the vanBeek structure.

The baseball game, due to its non-numerical orientation, does not require game players to perform successive additions and subtractions produce routine play results. For many people, this mental work, and especially its repetition, is fatiguing and uninteresting. The baseball game performs all numeric work transparently, and requests the game player to perform only visual reference operations.

Additional Embodiments

Although the description above contains many specificities, these should not be construed as limitations on the scope of the baseball game but rather as one preferred embodiment thereof. Many other variations are possible.

The game described here can easily be embodied in computer software. In fact, the description of the game provided in the section "How to Play the Baseball Game" constitutes an algorithm (a plan for) constructing a computer program that plays the game.

The game described here can be played using cards constructed to represent mythical athletes, or one's neighborhood team, as well as real-life athletes. All that is needed is a set of statistics for each athlete from which to generate performance ratings for the players.

Many of the advantages of the baseball game will be realized if the method of the baseball game is applied to produce a game for another sport. The compression of this method of storing player performance data and the accompanying method of play allows a table game to include more features than other games. Thus, while adding a specific feature might be a concern in a specific board game because the feature is too complex to be enjoyable, or takes up too much space or requires too much complexity to implement, the present game design might well allow the feature to be included. For example, a game might be able to include English-language descriptions of football or basketball plays. Greater compression opens up many different possibilities.

The techniques described here for economically storing statistical information in ratings by assigning several independent statistics to each rating can be embodied in any sports simulation game—football, basketball, hockey, golf, boxing, and so on. Two major types of play results are involved in these games:

Discrete (all-or-nothing) results, that is, results which represent total success or total failure, such as complete pass and incomplete pass, skates the length of the rink, and so on. Most baseball results are of this type.

Graduated results such as 5-yard gain or 6-yard gain, that is, results which represent degrees of success or failure.

The rating method described here rates both types of results effectively.

For example, see the ratings B1 through B6 on FIG. 1. A football game might use similar ratings to store player statistics, as follows:

a LP (long pass rating)
MP (medium pass rating)
SP (short pass rating)
R (run-from-scrimmage rating)
K (placekick rating)
P (punt rating)
KR (kickoff return rating)
PR (punt return rating)
. . .

What follows is one way of storing multiple statistics in a single rating to achieve the compression of information described in this patent application. A run-from scrimmage rating in a football game might store the following statistics:

4 of ten attempts succeed
3 of ten attempts succeed
2 of ten attempts succeed
1 of ten attempts succeed In various combinations, these four statistics can add up to any integer between 1 and 10.

As for discrete results, the method performs well. For example, a rating that combines the four statistics, such as a P (passing) rating can rate any player's pass completion percentage in steps of 10 from 10% to 100%. An additional rating, using the symbols "+" and "*," as described in the section "Description of Invention," can rate the player in steps of 1 from 1% to 10%. Together, the two ratings can rate a player in steps of 1 from 1% to 100%.

Thus, two ratings (each storing four statistics—for example, 4 of 10 and 2 of 100) could store the field goal percentage of a football placekicker or the field goal percentage of a basketball forward.

As for graduated results, the method performs well. For example, a rating such as R (run-from-scrinmmage) can make use of the ability to rate players in steps of 1 from 1% to 100% by using these fractional steps to simulate very precisely the average yards gained of a runner. Using a 100-card deck to produce a realistic distribution of the majority of run-from-scrimmage results from say, a loss of ten yards to a gain of nine (for a total of twenty different results), rating the total-yards-produced-by-possible-results using a rating method that produces differences of 1% with two ratings such as "c p" represents a major advantage. If the possible range of average yards gained per carry is from 1.0 to 7.0 over the 100-card deck, 1% of that range is only 0.06. Thus, the rating method distinguishes between an average gain of 4.5 and one of 4.56.

The rating of punters, kickoff returners, punt returners, and pass receivers advancing the ball would be similar to either the method for rating discrete results or the method for rating graduated results.

The division of result cards into subgroups and subsets would be similar to that described in this baseball game. Each player rating would encode an independent yes or no decision as to whether the results within the subsets within a subgroup can be actualized by the rated player. The following is a hypothetical example for a football rusher:

R2 Result Card Subset contains 20 cards:

5 result cards (one subset) that can produce 3-yard gains 5 result cards (one subset) that can produce 4-yard gains 5 result cards (one subset) that can produce 5-yard gains 5 result cards (one subset) that can produce 6-yard gains A rusher whose "g" rating represented "yes," "yes," "yes," and "no," respectively to these subsets would average 4.0 yards per running attempt based on the contribution of the twenty result cards in the subset. Possibly the "no" value would default to a league average rushing value for the five cards in the fourth subgroup. All twenty results from the R2 subset would be combined with those in other subsets and with those from other sources to produce and refine the player's overall rushing average.

The method for playing the game would be similar to the method for playing the baseball game:

1. Take a result card and flip it over.
2. Read a symbol which represents the subset of results to which a card belongs, such as B1.
3. Use the symbol to look up a rating from a short list of ratings on a player's card.
4. Refer to the result card to see whether the player's rating for that symbol is highlighted (as by underlining).

The highlighting indicates that the result associated with the subgroup of results among the specific subset to which the card belongs is active. If the rating is underlined (active) on this result card, and the player rating matches the underlined rating, the result occurs.

Thus the scope of the invention should be determined by the appended claims and their legal equivalents, rather than by the examples given.

What is claimed is:

1. A baseball game, comprising:

a) a set of result cards divided into a plurality of subsets, each card labeled with a symbol such as B1, B2, . . . or P1, P2, . . . which identifies its subset, the symbols further indicating whether the performance rating of a batter or a pitcher must be tested in order to arrive at a play result, each of these subsets of cards being further subdivided into subgroups, each card in one of said subgroups further containing a specific type of potential play result such as home run the actualization of which depends upon a predetermined non-numeric rating assigned to a batter or a pitcher to measure his performance, each card further containing a string of actualization symbols, some of the actualization symbols in the string associated with a specific play on the same result card, with means provided to indicate whether an actualization symbol is activated on a specific result card so that when the actualization symbol is compared with the appropriate batter or pitcher's rating during the course of play, the play associated with the actualization symbol occurs;

b) a random item generator comprising said set of result cards, said random item generator generating a set of items comprising symbols, each of which indicates the subset to which a result card belongs, actualization symbols, and play results such as home run which are associated with some of the actualization symbols;

c) a set of batter cards, each batter card containing a batting rating for a batter for each of the subsets of result cards which depends upon a predetermined rating assigned to a batter, the random item generator operating to produce one of said symbols which is used to look up a batter rating associated with that symbol on a batter card, said batter rating representing a plurality of yes or no decisions, each decision indicating whether the batter with that rating actualizes one of the types of results such as strikeout which appear on one of said subsets of result cards, said batter rating contributing to the production of a play result;

d) a set of pitcher cards, each pitcher card containing a pitching rating for a pitcher for each of the subsets of result cards which depends upon a predetermined rating assigned to a pitcher, the random item generator operating to produce one of said symbols which is used to look up a pitcher rating associated with that symbol on the pitcher card, said pitcher rating representing a plurality of yes or no decisions, each decision indicating whether the pitcher with that rating actualizes the results in one of said subsets of results, said pitcher rating contributing to the production of a play result.

2. A game as recited in claim 1 wherein said batters cards further include situational batting ratings which are comparison symbols corresponding to the actualization symbols on result cards, said actualization symbols acting in this instance as comparison symbols, the random item generator operating to produce a random actualization symbol which, when compared with the situationally appropriate comparison symbol on a batter's card, contributes to the production of a play result, said situational battings ratings rating the batter over situations including: right-handed pitcher is pitching and at least one runner is on second or third; left-handed pitcher is pitching and at least one runner is on second or third; right-handed pitcher is pitching and no runner is on second or third; left-handed pitcher is pitching and no runner is on second or third.

3. A game as recited in claim 1 wherein said pitchers cards further include situational pitching ratings which are comparison symbols corresponding to the actualization symbols on result cards, said actualization symbols acting in this instance as comparison symbols, the random item generator operating to produce a random actualization symbol which, when compared with the situationally appropriate comparison symbol on a pitcher's card, contributes to the production of a play result, said situational pitching ratings rating the pitcher over the nine situations: play is in an early inning and no runners are on base, play is in an early inning and a runner is on first base only; play is in an early inning and at least one runner is on second base or third base; play is in a middle inning and no runners are on base, play is in a middle inning and a runner is on first base only; play is in a middle inning and at least one runner is on second base or third base; play is in a late inning and no runners are on base, play is in a late inning and a runner is on first base only; play is in a late inning and at least one runner is on second base or third base.

4. A game as recited in claim 1 which includes, in addition, a ballpark ratings chart, which chart includes ballpark ratings that represent the difficulty of hitting home runs in different ballparks, said ballpark ratings being comparison symbols corresponding to the actualization symbols on result cards, said actualization symbols acting in this instance as comparison symbols, the random item generator operating to produce a random actualization symbol which, when compared with the situationally appropriate comparison symbol on a ballpark card, contributes to the production of a play result.

5. A game as recited in claim 2 or claim 3 or claim 4, in which a portion of said result cards each bear a set of comparison symbols, each set of comparison symbols containing a split which divides the set into two parts so that when a random card is drawn, if said situational batting rating of claim 2 or said situational pitching rating of claim 3 or said ball park rating of claim 4 occurs to the right of the split then an out result is selected.

6. A game as recited in claim 1 wherein said batters cards further include fielding ratings of the form "," (blank), + (low), * (medium), and +* (high) that represent the statistical performance of the player as a fielder at each position he can play in the following different categories of fielding play—chances accepted, ability to produce assists, tendency to commit errors-the random item generator operating to produce one of the symbols +, * , and +*, which is compared with the rating of the fielder who attempts to make the play to determine the result of the fielding play.

7. A game as recited in claim 1 wherein said pitcher cards further include fielding ratings of the form "", (blank), + (low), * (medium), and +* (high) that represent the statistical performance of the pitcher as a fielder at each position he can play in the following different categories of fielding play—chances accepted, ability to produce assists, tendency to commit errors, and ability to pick a runner off base—the random item generator operating to produce one of the symbols +, * , and +*, which is compared with the rating of the fielder who attempts to make the play to determine the result of the fielding play.

8. A game as recited in claim 1 wherein said symbols, each of which indicates the subset to which the result which is associated with the symbol on the same card belongs, comprise B1, B2, B3, B4, B5, B6, P1, P2, P3, and P4.

9. A game as recited in claim 1 wherein said actualization symbols correspond to said batter ratings and said pitcher ratings and comprise the letters "a" through "p."

10. A game as recited in claim 1 wherein the means of indicating that an actualization symbol on a result card is active is highlighting of symbols such as underlining.

11. A game as recited in claim 1 which further comprises an Invent Play table which provides a game player with play requirements that must be satisfied in the order given until they are satisfied, enabling the game player to construct plays of his own invention without sacrificing creativity to the game player's self-interest as a competitor whose main object is to win the game, whereby every play possible in the real-life sport is made possible in the imitating game.

12. A game as recited in claim 1 which comprises in addition an Outcome table which enables the game player to combine the occurrence of many event combinations of real-life baseball which, if specified by simple enumeration instead of by combination, would be impossible to include because they are too great in number.

13. A game as described in claim 1 which is implemented as computer software such that the entities referred to by the terms "result cards," "random item generator," "batting cards," and "pitching cards," which in claim 1 are concrete, non-software, entities, are components of the software.

14. A method for simulating an athletic contest between athletes, comprising the steps of:

a) providing means of representing the events in an athletic contest and the factors contributing to their actualization, said means comprising a set of result cards divided into a plurality of subsets, each result card labeled with a symbol that identifies its subset, each of said subsets of cards being further subdivided into subgroups, each card in each of said subgroups containing a specific type of potential event such is home run or five-yard gain the actualization of which depends upon a predetermined rating assigned to an athlete to measure his performance, each said result card further containing a string of actualization symbols, one or more of said actualization symbols being associated with a specific event such as home run or five-yard gain on the same result card, with means provided to indicate whether an actualization symbol is active on a specific result card so that when the actualization symbol is consulted during the course of the simulated athletic contest, the event associated with the actualization symbol occurs.

b) providing means of assigning to each athlete a plurality of performance ratings, each rating representing a plurality of yes or no decisions, each decision indicating whether the athlete with that rating actualizes the type of results on one of said subgroups of result cards, said athlete rating contributing to the production of an event in the simulated athletic contest c) providing means of generating random items, said means comprises said set of result cards, said means generating a set of items comprising symbols, each of which indicates the subset to which a result card belongs, actualization symbols, and event results such as home run or five-yard gain each of which is associated with one or more actualization symbols on the same result card d) providing means of representing the performance of athletes, said means comprising a set of athlete cards, each athlete card containing a performance rating for an athlete for each of said subsets of result cards, the result cards operating to produce one of said symbols which is used to look up the athlete's rating associated with that symbol on the athlete's card, said athlete rating representing a plurality of yes or no decisions, each decision indicating whether the athlete with that rating actualizes the results in one of said subgroups of results, said athlete rating thus contributing to the production of an event in the simulated athletic contest.

* * * * *